US008401445B2

(12) United States Patent
Uno et al.

(10) Patent No.: US 8,401,445 B2
(45) Date of Patent: Mar. 19, 2013

(54) DEVELOPER SUPPLY APPARATUS AND IMAGE FORMING APPARATUS

(75) Inventors: Takanori Uno, Aichi (JP); Mitsukiyo Okamura, Aichi (JP); Kenjiro Nishiwaki, Aichi (JP); Yasuhiro Maruyama, Aichi (JP); Tomoaki Hazeyama, Mie (JP); Masataka Maeda, Aichi (JP); Tomoaki Hattori, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 160 days.

(21) Appl. No.: 12/851,789

(22) Filed: Aug. 6, 2010

(65) Prior Publication Data

US 2011/0013947 A1 Jan. 20, 2011

Related U.S. Application Data

(63) Continuation-in-part of application No. PCT/JP2009/052038, filed on Feb. 6, 2009.

(30) Foreign Application Priority Data

| | | |
|---|---|---|
| Feb. 8, 2008 | (JP) | 2008-028367 |
| Mar. 18, 2008 | (JP) | 2008-069172 |
| Sep. 24, 2008 | (JP) | 2008-243524 |
| Sep. 24, 2008 | (JP) | 2008-243538 |

(51) Int. Cl.
*G03G 15/08* (2006.01)
*G03G 15/09* (2006.01)

(52) U.S. Cl. ..... 399/291; 399/266

(58) Field of Classification Search ..... 399/265, 399/266, 290, 291
See application file for complete search history.

(56) References Cited

U.S. PATENT DOCUMENTS

| | | | | |
|---|---|---|---|---|
| 4,598,991 | A | 7/1986 | Hosoya et al. | |
| 5,416,568 | A | 5/1995 | Yoshiki et al. | |
| 6,965,742 | B2 | 11/2005 | Miyamoto et al. | |
| 7,123,864 | B2 | 10/2006 | Miyaguchi et al. | |
| 8,095,052 | B2 * | 1/2012 | Nishiwaki et al. | 399/291 X |
| 2004/0240907 | A1 | 12/2004 | Miyaguchi et al. | |
| 2007/0147904 | A1 | 6/2007 | Maeda | |
| 2010/0028056 | A1 | 2/2010 | Nishiwaki | |
| 2011/0002716 | A1 | 1/2011 | Nishiwaki | |

FOREIGN PATENT DOCUMENTS

| | | | |
|---|---|---|---|
| JP | 59-181371 | A | 10/1984 |
| JP | 63-013079 | A | 1/1988 |
| JP | 5-019615 | A | 1/1993 |
| JP | 06-003937 | A | 1/1994 |
| JP | 2002-268375 | A | 9/2002 |
| JP | 2003084569 | A | 3/2003 |
| JP | 2004-287095 | A | 10/2004 |

(Continued)

OTHER PUBLICATIONS

JP Office Action dtd Jun. 29, 2009, JP Appln. 2008-028367, English translation. JP Office Action dtd Sep. 1, 2009, JP Appln. 2008-028367, English translation.

(Continued)

*Primary Examiner* — Sophia S Chen
(74) *Attorney, Agent, or Firm* — Banner & Witcoff, Ltd.

(57) ABSTRACT

A developer supply apparatus is provided which supplies a toner to a supply object, the developer supply apparatus including a developer storage body which stores a powdery developer, and a transfer body which transfers the developer along the developer transfer path with traveling wave electric fields. The developer includes a toner having a predetermined charging characteristic and an electric neutralizer having an opposite charging characteristic, which is opposite to the predetermined charging characteristic.

36 Claims, 21 Drawing Sheets

FOREIGN PATENT DOCUMENTS

| | | | |
|---|---|---|---|
| JP | 2005-022253 | A | 1/2005 |
| JP | 2007-178924 | A | 7/2007 |
| JP | 2008-026759 | A | 2/2008 |

OTHER PUBLICATIONS

JP Office Action dtd Nov. 24, 2009, JP Appln. 2008-028367, English translation.

Written Opinion of the International Searching Authority for International Application No. PCT/JP2009/052038, mailed May 19, 2009.

International Search Report mailed May 19, 2009, PCT/JP2009/052038, English translation.

JP Office Action dtd Jun. 9, 2009, JP Appln. 2008-028367, English translation.

International Search Report mailed May 28, 2009, PCT/JP2009/054280.

Non-Final Office Action mailed Oct. 2, 2012, U.S. Appl. No. 12/884,992.

* cited by examiner

DEVELOPER SUPPLY APPARATUS AND IMAGE FORMING APPARATUS

CROSS REFERENCE TO RELATED APPLICATION

This is a Continuation-in-Part of International Application No. PCT/JP2009/052038 filed Feb. 6, 2009, which claims priority from Japanese Patent Application No. 2008-028367 filed Feb. 8, 2008, Japanese Patent Application No. 2008-069172 filed Mar. 18, 2008, Japanese Patent Application No. 2008-243524 filed Sep. 24, 2008, and Japanese Patent Application No. 2008-243538 filed Sep. 24, 2008. The entire disclosures of the prior applications are hereby incorporated by reference herein their entireties.

TECHNICAL FIELD

This invention relates to a developer supply apparatus and an image forming apparatus.

BACKGROUND

Conventionally, in an image forming apparatus, many mechanisms to transfer charged powdery developers (so called a dry type toner: hereinafter simply referred to as "a toner") using traveling wave electric fields have been known (for example, Japanese Patent Provisional Publication No. SHO 59-181371, or Japanese Patent Provisional Publication No. HEI 05-19616).

Such a transferring mechanism includes a toner transfer body which is configured such that a plurality of linear transfer electrodes is provided on a substrate of an insulator. In this configuration, multi-phase alternating current voltages are sequentially applied to the plurality of linear electrodes, thereby forming traveling wave electric fields. Charged developers are transferred in a predetermined direction by effects of the traveling wave electric fields.

SUMMARY

However, in the above described mechanism, it is possible that the toner transfer state becomes worse. For example, because of charge-up on a surface of the toner transfer body, there may arise an area where the toner is not smoothly transferred. If such a situation arises, then it provides an adverse effect on image formation.

A toner supply apparatus according to an embodiment of the present invention can perform a toner transfer with traveling wave electric fields successfully, and an image forming apparatus including the toner supply apparatus can perform a successful image forming operation.

According to an embodiment of the present invention, there is provided a developer supply apparatus which supplies a toner to a supply object. The developer supply apparatus according to an embodiment of the present invention includes a developer storage body which stores a powdery developer including a toner having a predetermined charging characteristic, and a transfer body which transfers the developer along the developer transfer path with traveling wave electric fields. In addition, the developer includes an electric neutralizer having an opposite charging characteristic, which is opposite to the predetermined charging characteristic.

DETAILED DESCRIPTION OF EMBODIMENTS

Hereinafter, embodiments of the present invention are explained with reference to figures.

1. First Embodiment

1-1. Configuration of Laser Printer (Image Forming Apparatus)

Figure 1:
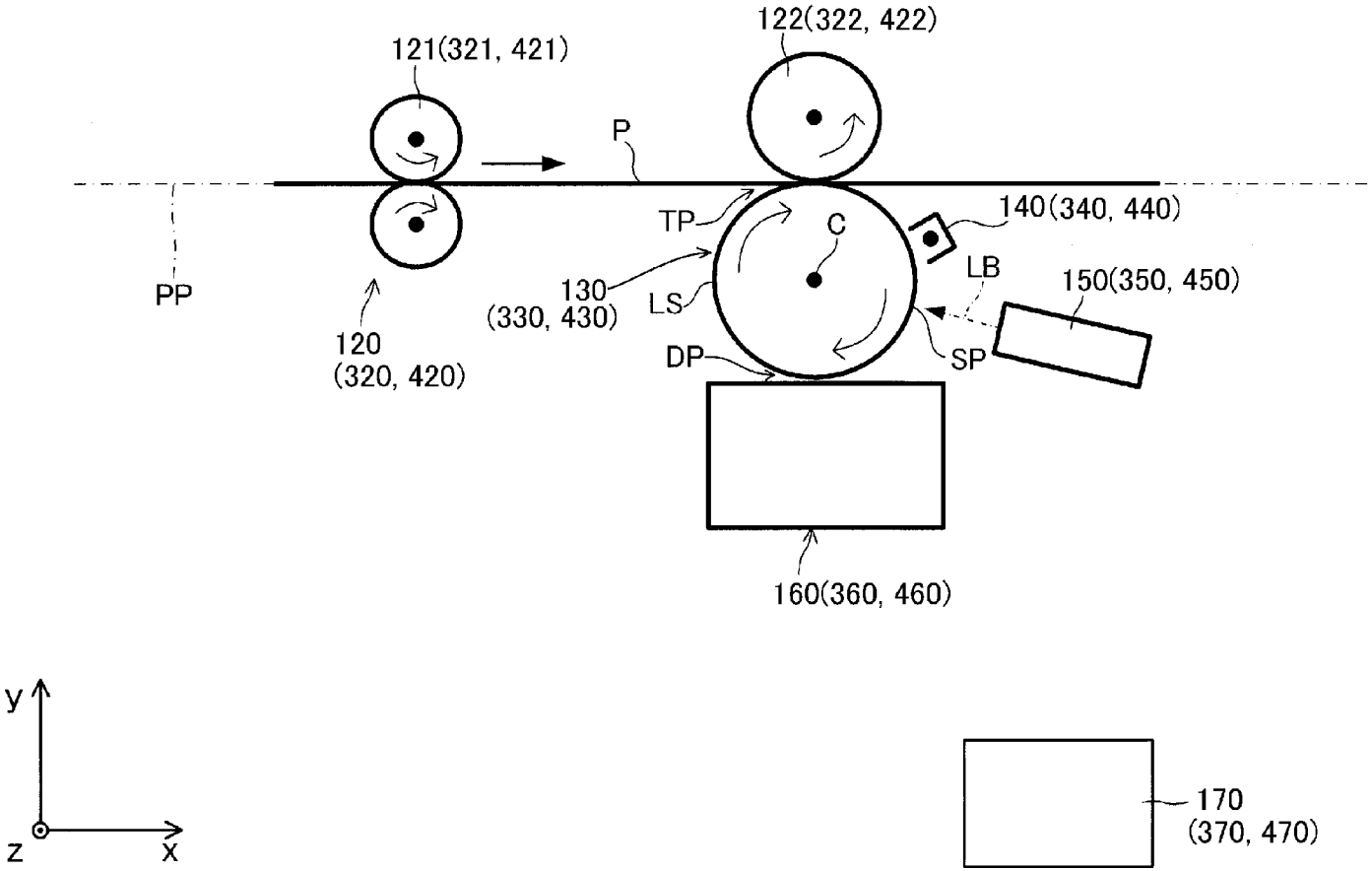
FIG. 1 is a side view illustrating a schematic configuration of an image forming unit in a laser printer according to a first embodiment of the invention.

FIG. 1 is a side view illustrating a schematic configuration of a laser printer 100 according to an exemplary first embodiment of the present invention. As shown in FIG. 1, the laser printer 100 (an image forming apparatus) includes a document transfer unit 120, an image forming unit 110, a fixing unit (not shown in the figure), and a controller 170.

Next, a detail of each portion of the laser printer 100 is explained.

In the explanation below, the present invention will be explained by taking the full color laser printer 100 as an example of an image forming apparatus according to a first embodiment of the present invention. However, a configuration of the image forming apparatus of the present invention is not limited to a configuration of the embodiment explained below. Namely, the image forming apparatus of the present invention can be an electrophotographic printer other than a laser printer (e.g., an LED printer), a copy machine, a facsimile device, or a multifunctional device including two or more of these functions. Further, an image forming apparatus according to the embodiment of the present invention is not limited with respect to a charging method used in a charging process in the electrophotographic system, a type of a light source or an exposing method of an exposure assembly used in an exposing process, a transferring method or a fixing method, provided that the image forming apparatus includes a developer supply apparatus according to the embodiment of the present invention. Further, the image forming apparatus can be a full color device or a monochrome device.

1-1-1 Image Forming Unit

Figure 2:
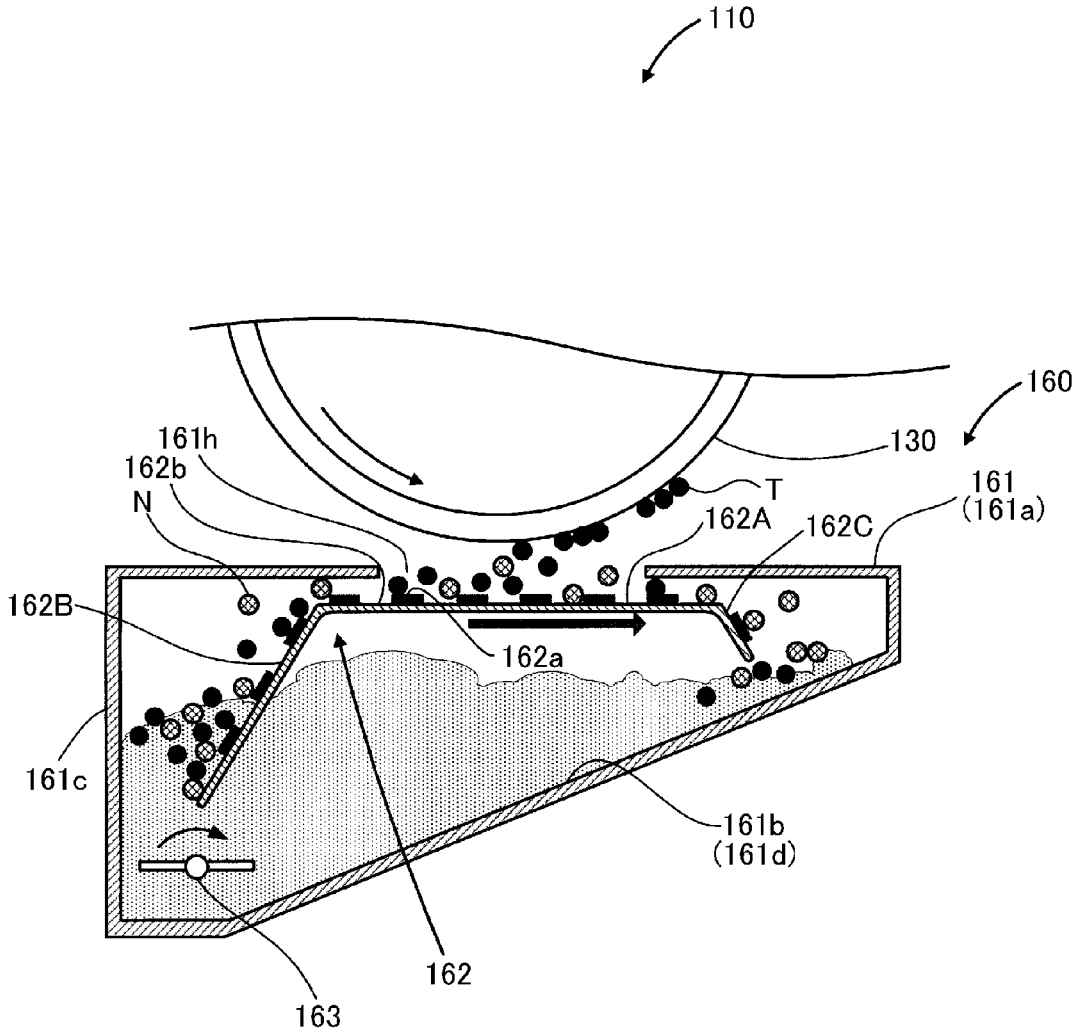
FIG. 2 is an outline side view of a toner supply apparatus according to the first embodiment of the invention.

A schematic configuration of an image forming unit 110 (to be more precise, image forming units for respective colors included in the image forming unit 110) according to the first embodiment of the present invention is shown in FIG. 2. The image forming unit 110 is an electrophotographic full-color image forming unit. The image forming unit 110 includes four image forming units for forming an yellow image, a magenta image, a cyan image, and a black image, corresponding to the colors of yellow, magenta, cyan, and black, respectively. These are arranged, for example, from paper supply side to the fixing unit of the document transfer unit 120 along a document transfer path PP, in this order of the yellow image forming unit, the magenta image forming unit, the cyan image forming unit, and the black image forming unit. Each image forming unit has substantially the same configuration except for the difference in the toner to be used (especially, a colorant included in the toner). Each image forming unit forms a toner image of one of the colors of yellow, magenta, cyan, or black, based on the image data of the corresponding color, and eventually transferring the toner image on a sheet of paper P. Each image forming unit includes, in addition to a photosensitive drum 130 and a toner supply apparatus 160 (a developer supply apparatus), a charger 140, a scanner unit 150 (an exposing device), a transfer roller 122, and a cleaning assembly and a discharging assembly that are not shown in the figures.

The photosensitive drum 130 (an electrostatic latent image carrying body) is a drum-shaped assembly having a photoconductive layer on the surface thereof, and is configured to be driven in a predetermined direction. The photo-conductive layer of the photosensitive drum 130 is configured to be charged to a predetermined voltage by the charger 140.

The charger 140 is for charging the surface of the photosensitive drum 130 uniformly. In this embodiment, a corona charger is used as the charger 140. The corona charger includes a conductive wire such as a tungsten wire, a metal shield board and grid board. In another embodiment of the present invention, another type of a charger 140, such as a charging roller, or a charging brush can be used.

The scanner unit 150 (an exposing assembly) exposes the surface of the charged photosensitive drum 130 based on the pixel data, thereby forming an electrostatic latent image. The scanner unit 150 is configured to input image data from the controller 170, and to form electrostatic images corresponding to respective pieces of image data on the photosensitive drum 130. In this embodiment, as the exposing assembly, a laser scanning unit (LSU) including a laser light source and a scanning mirror is used. In another embodiment of the present invention, an EL (electroluminescence) writing head or an LED writing head can be used as an exposing assembly.

The toner supply apparatus 160 (the developer supply apparatus) is for forming a toner image (a visible image) by developing the electrostatic latent image formed on the photosensitive drum 130 using a developer including a toner T. The toner supply apparatus 160 and the developer are explained later in detail.

The transfer roller 122 (a copying assembly) is for transferring the toner image on the photosensitive drum 130 to the sheet of paper P carried by the document carrying unit 120 described later. In this embodiment, a bias voltage having reversed polarization with respect to the toner T is applied to the surface of the copying roller. In this embodiment, the transfer roller is used as the transfer assembly, however, in another embodiment, another kind of a transfer assembly such as a corona transfer roller, or a transfer brush can be used. Further, in the image forming apparatus in accordance with this embodiment, a direct transfer method that directly transfers the toner image formed on the photosensitive drum 130 to the sheet of paper P is adopted, however, in another embodiment of the present invention, an intermediate transfer method can be adopted. Further, in this embodiment, a tandem method, in which images in respective colors are formed simultaneously by the plural image forming units provided for respective colors, is adopted, however, in another embodiment of the present invention, another method such as, for example, a four cycle method, in which images in respective colors are formed sequentially by a single image forming unit can be adopted.

The cleaning assembly is an assembly for removing toners T remaining on the photosensitive drum 130 after transferring an image to the sheet of paper P. In this embodiment, a cleaning blade is used as the cleaning assembly. The discharging assembly is an assembly for removing charges remaining on the surface of the photosensitive drum 130, and is placed behind of the cleaning assembly. In this embodiment, an LED lamp (a discharging lamp) is used as the discharging assembly. In another embodiment of the present invention, another type of a light source, such as an organic EL lamp or a fluorescent lamp, can be used as a discharging lamp, and further, a discharging assembly of another method such as, for example, contacting a grounded metal plate with the photosensitive drum 130.

1-1-2 Fixing Unit

The fixing unit includes a heating roller and a pressure roller, and when a sheet of paper P is carried to a nipped portion between them, a toner image is heated and pressure bonded on the sheet of paper P. The sheet of paper P which has been processed to fix the toner image with the fixing unit is ejected to an eject tray.

1-1-3 Document Transfer Unit

The laser printer 100 includes a document feeding tray not shown in figures on which sheet like documents P are stacked and stored. The document transfer unit 120 is configured to cause the documents P to be ejected from the document feeding tray and to carry the documents P along a predetermined document transfer path PP. The document transfer unit 120 includes a pair of resist rollers 121 and a transfer roller 122. Here, in this embodiment, the transfer roller 122 is, at the same time, an element of the image forming unit. The resist roller 121 is configured to be able to send out the documents P to a gap between the photosensitive drum 130 and the transfer roller 122 at a predetermined timing.

1-1-4 Toner Supply Apparatus

Next, the toner supply apparatus 160 is explained in detail. As shown in FIG. 2, the toner supply apparatus 160 includes a toner box 161 (a developer storage body) to store a developer including a toner T. The toner box 161 is a container like assembly including a top plate 161*a*, a bottom plate 161*b*, and a side plate 161*c*. The top plate 161*a* is a substantially rectangular plate and includes a passage hole 161*h* for a toner for development at a center portion neighboring the photosensitive drum 130. The toner box 161 includes therein an agitator 163 (an agitating assembly) for agitating a developer stored in the toner box 161 and a toner transfer body 162 for carrying a developer, namely, a toner T. Further, embodiments of the toner box 161 are not limited to the embodiment shown in FIG. 2, and can be modified appropriately in accordance with setup configurations of the image forming unit 110 or the toner supply unit 160 in the image forming apparatus.

The agitator 163 is placed in a neighborhood of a bottom end of a slanting bottom part 161*d* inside of the toner box 161, and can agitate a developer returned from the toner transfer body 162 to the inside of the toner box 161 and collected therein. Further, the agitator 163 can provide a developer to a component 162B upstream of the toner transfer body, while agitating the developer. The agitator 163 can further charge a toner T, which is a constituent of a developer, by frictional charging, while agitating the developer. Further, setup configurations or shapes of the agitator are not limited, particularly. In FIG. 2, as an example, a rotator having a plurality of blades is described, but it can be a screw-propeller or an auger.

The toner transfer body 162 is placed so that it faces with the photosensitive drum 130 at the passage hole 161*h* for a toner for development. The toner transfer body 162 includes a support film 162*b* having an insulator facing with the photosensitive drum 130 and a group of electrodes including a plurality of transfer electrodes 162*a* spaced apart equally on the surface of the support film 162*b* on the side of the photosensitive drum 130. The support film 162*b* includes a central component 162A which is substantially plate-shaped and facing to the photosensitive drum 130, an upstream component 162B which is bending toward the inside of the toner box 161 from an edge of the toner passage hole 161*h* (the left hand side in FIG. 2), and a downstream component 162C bending toward inside of the toner box 161 from the other end of the toner passage hole 161*h* (the right hand side in FIG. 2).

The upstream component 162B is bending toward the bottom end of the bottom part 161*d* of the toner box 161 from one end of the toner passage hole 161*h*. Namely, it is bending substantially toward the agitator 163. Therefore, a developer, which is collected at the bottom end of the bottom part 161*d* of the toner box 161 is agitated by the agitator 163 and is pushed toward the side of the toner passage hole 161*h*, thus the developer tends to be supplied to the toner transfer body 162. Further, the downstream component 162C is bending toward the neighborhood of the upstream of the bottom part 161*d* in the toner box 161. Therefore, a developer, which is returned from the toner transfer body 162 to the inside of the toner box 161, tends to be supplied to the agitator 163 through using the slant at the bottom part 161*d* of the toner box 161.

Each of the transfer electrodes 162*a* included in the group of electrodes arranged almost all over the surface of the support film 162 has a linear shape having a length almost equal to the width of the support film 162*b*. Each electrode 162*a* is arranged on the support film 162*b* such that its longer side is perpendicular to a transfer direction of a developer. Each of the electrodes 162*a* is connected to an alternate current power supply, not shown in figures, respectively. Traveling wave electric fields are formed on the surface of the toner transfer body 162 by applying a 4-phase alternating current whose phases are shifted, thereby enabling a developer to be carried to a developing area.

1-2 Developer

Next, a developer used for the toner supply apparatus 160 is explained. The developer includes a toner T having a predetermined electric charging characteristic. The developer can be a non-magnetic single component type or a magnetic two-component type including a toner T and a magnetic carrier. From the view point of reducing size of the toner supply apparatus or the image forming apparatus, a non-magnetic single component type is preferable. Further, in the explanation below, the explanation includes both of these two types. However, depends on necessity, explanations for the magnetic two-component type are supplemented.

The electric charging characteristic of the toner T, which is the developer, can be a positive charging characteristic or a negative charging characteristic. The electric charging characteristic of the toner T is determined mainly by a forming condition of an electrostatic latent image and an adhering condition of the toner to the electrostatic latent image. The toner T is preferably a toner T with a positive charging characteristic from the view point of preservation of environment (e.g., preservation of ozone). Further, components of the toner T and its manufacturing method are described later in detail. Further, if the developer is a magnetic two-component type, an appropriate magnetic conductive carrier is included. Typically, iron or ferrite is used as a carrier.

The developer includes an electric neutralizer N. An electric neutralizer N is a powder having an opposite charging characteristic with respect to the charging characteristic of the toner T. Having an opposite charging characteristic with respect to the charging characteristic of the toner T means that having a tendency to be charged to opposite polarity with respect to the polarity of the toner T by friction.

When the electric neutralizer N has the above charging characteristic in the relationship with the toner T, excessive charging (charge-up) caused by frictional charging among the toners T themselves can be effectively suppressed or avoided by coexisting with the toner T in the toner supply apparatus 160 through friction with the toner T. Therefore, in the toner transfer body 162, cohesion or a blocking of the toner T can be effectively suppressed or avoided, thereby enabling a smooth transfer of the developer.

It is preferable that the electric neutralizer N has an opposite charging tendency in comparison with the charging characteristic of the support film 162*b* of the toner transfer body 162 or the charging characteristic of the agitator 163. With indication of such a charging tendency of the electric neutralizer N, a charge-up caused by friction between the toner T and the support film 162*b* or the agitator 163 can be effectively suppressed or avoided. Therefore, cohesion or a blocking of the toner T at the toner transfer body 162 can be effectively suppressed or avoided.

As the electric neutralizer N, an electric neutralizer having the above charging characteristic is sufficient, and there is no particular limitation with respect to its material, composition, shape, or size. A person skilled in the art can decide an appropriate material by considering the charging characteristic of the toner T.

Further, the electric neutralizer N in the embodiments of the present invention does not include a carrier in a developer of a magnetic two-component type. A carrier in a developer of a magnetic two-component type and an electric neutralizer N in the embodiments of the present invention can be distinguished by the point that the electric neutralizer N does not have a magnetic property.

Since the electric neutralizer N itself is frictionally charged among the toners T, it is preferable that the electric neutralizer N itself is in a particle state. Further, the electric neutralizer N can be not in a state of a primary particle in a process of transfer, it can form a secondary particle together with the toner T to constitute a developer, or it can form a secondary particle with the electric neutralizer N themselves.

The electric neutralizer N can be a particle including at least an adhesive resin. Here, an adhesive resin means a resin which has a binding property. Further, the electric neutralizer N can be a particle in a state of a generating particle of the toner T (a form of toner) including at least an adhesive resin. Further, the form of toner in the electric neutralizer N can include a colorant, or it can include a wax for fixing. To give an appropriate color tone, a colorant can be included in the toner-like agent. The electric neutralizer N can be obtained easily (or at the same time) as the toner T, when the electric neutralizer N is the toner-like agent. Further, the electric charging characteristic can be easily controlled. When the electric neutralizer N is the toner-like agent, it can be the toner-like agent including an amount of additives which can provide a predetermined electric charging characteristic, as required. To provide a necessary electric charging characteristic to the electric neutralizer N, one of an electric charging control agent and an outer additive, or both of them, can be added to the generating particle of the toner, as required. When the electric neutralizer N is the toner-like agent, the toner generating particle including the adhesive resin can be in common with the toner generating particle of the toner T as an image forming agent, only the electric charging properties can be varied. By using an electric charging control agent or an outer additive having an opposite electric charging characteristic to the toner T, the electric neutralizer N can be easily produced.

It is preferable that the electric neutralizer N is adjusted so that it has a color tone which does not prevent image formation with the toner T, when the electric neutralizer N is provided to the sheet of paper P with the toner T. The electric neutralizer N is not provided to the photosensitive drum 130 as in the case of the toner T, because it has an opposite electric charging characteristic. However, if the color tone is adjusted as described above, then it does not prevent image formation, even if the electric neutralizer N is provided to the photosensitive drum 130. For example, the electric neutralizer N can be such that no colorant is added and it has almost no color tone or it completely does not have a color tone. For example, it can be colorless or close to colorless. For example, for the case of the toner T of cyan, it can have the same degree of colorfulness and brightness as that of the toner T, or it can have a higher degree or lower degree of brightness and/or colorfulness in comparison with that of the toner T. An appropriate color tone in the electric neutralizer N can be easily obtained by suitably changing the amount (with or without) of the colorant to be used or the type of the colorant agent to be used. Further, it is the most preferable that the electric neutralizer N itself is transparent, without including a colorant agent.

Further, not preventing image formation with the toner T means that an unexpected defect is at least not provided explicitly to a toner image. It cannot be said that image formation by the toner T is not prevented, if such a defect is explicitly provided. Here, "explicitly" means visually visible. Types of defects are not particularly limited, however, for example, a degradation of resolution such as a color unevenness or smearing can be considered.

It is preferable that the electric neutralizer N is spherical, taking into consideration of contact areas with the toner T, with the toner transfer body 162, and with the agitator 163, fluidity, or mixing uniformity with the toner T. To be exactly spherical is more preferable. Further, considering the durability, it is preferable to be a solid state body than a form of shell.

Further, a size of the electric neutralizer N is not particularly limited. It can be determined appropriately, taking into consideration of the mixing uniformity with the toner T. It is preferable that the average particle diameter of the electric neutralizer N is equivalent to or greater than the average particle diameter of the toner T, taking into consideration cohesion or blocking of the toner T. It is preferable that the average particle diameter of the electric neutralizer N is greater than or equal to 50% and less than or equal to 400% of the average particle diameter of the toner T. When the average particle diameter of the toner T is within this range, the toner T can be efficiently neutralized.

Further, it is preferable that the average particle diameter of the electric neutralizer N is greater than or equal to 5 μm and less than or equal to 25 μm. When the average particle diameter of the electric neutralizer N is within this range, the toner T which has the average particle diameter of greater than or equal to 5 μm and less than or equal to 25 μm can be effectively neutralized. It is more preferable that the average particle diameter of the electric neutralizer N is greater than or equal to 10 μm and less than or equal to 25 μm.

Further, for the average particle diameters of the toner T and the electric neutralizer N, a measurement method based on a pore electrical resistance method can be adopted. Further, in the measurement method, it is preferable to measure the volume average particle diameter by Coulter Multisizer II (aperture diameter of 100 μm) made by Beckman Coulter Corporation or by a device equivalent thereto. When comparing the average particle diameters of the toner T and the electric neutralizer N, it is preferable to use the average particle diameters measured by the same method of measuring average particle diameters, respectively.

As such an electric neutralizer N, one type can be used, and two or more types can be combined and used. When two or more types of the electric neutralizer N are used, it can be any kind of combination. The combination can be a combination of electric neutralizers N having differences in the material, in the particle structure, in the size, or in the electric charging characteristic, or a combination of electric neutralizers N having differences in two or more of the forgoing types can be used.

An included amount of the electric neutralizer N in the developer is not particularly specified. The developer can include the electric neutralizer N to the extent that cohesion or blocking of the toner T is suppressed by the effect of the neutralizer N, thereby suppressing or avoiding blocking of transfer of the developer. Usually, if an electric neutralizer N is included in a developer, a more significant transfer stimulating effect can be obtained by the electric neutralization effect. Preferably, in a developer, an electric neutralizer N is more than or equal to 10 parts by mass and less than or equal to 70 parts by mass with respect to 100 parts by mass of the total amount of a toner T and the electric neutralizer N (hereinafter, referred to simply as "total amount"). A suppressing effect or an avoiding effect against blocking of transfer of the developer (transfer stimulating effect) can be obtained significantly, by including an electric neutralizer more than or equal to 10 parts by mass and less than or equal to 70 parts by mass with respect to 100 parts by mass of the total amount. It is more preferable to include an electric neutralizer N more than or equal to 30 parts by mass. When an electric neutralizer N is more than or equal to 30 parts by mass, a transfer stimulating effect of more than or equal to seven times as much, in comparison with the case where the developer does not include the electric neutralizer N, is easily obtained. Further, it is much more preferable to include an electric neutralizer N more than or equal to 40 parts by mass. When an electric neutralizer N is more than or equal to 40 parts by mass, a transfer stimulating effect of more than or equal to ten times as much, in comparison with the case where the developer does not include the electric neutralizer N, is easily obtained. Further, it is preferable that an electric neutralizer N is less than or equal to 70 parts by mass. Even if more than 70 parts by mass is added, a significant transfer stimulating effect is not easily obtained any more. It is more preferable to include an electric neutralizer N less than or equal to 60 parts by mass. Based on the above, a preferred range of a compound ratio of the electric neutralizer N is more than or equal to 40 parts by mass and less than or equal to 60 parts by mass with respect to the total amount of 100 parts by mass. It is more preferable that the range is more than or equal to 45 parts by mass and less than or equal to 55 parts by mass, and it is the most preferable that the compound ratio is about 50 parts by mass.

Further, for example, a continuous transfer time in an evaluation system described in an embodiment can be used as an index of the transfer stimulating effect when the electric neutralizer N is used.

A developer can be obtained by mixing the above described electric neutralizer N and the toner T with, if necessary, a magnetic carrier. A method of mixing is not particularly specified. Thus a method usually used for this type of developer can be used. Further, for a developer, in addition to main components of the toner T, the electric neutralizer N and the carrier, a known additive can be added arbitrarily.

Next, a process of carrying the toner T by applying the above developer in the toner supply apparatus 160 of the image forming apparatus and a process of developing are explained. Further, in the example below, the process of developing, where an image forming operation to form a toner image corresponding to image information associated with an image forming instruction on a sheet of paper P is started, based on the image forming instruction from a PC terminal connected to LAN, is explained.

The controller 170 generates pieces of image information of respective colors of yellow, magenta, cyan, and black by performing color separation into respective colors, based on the image information associated with the image forming instruction, when a controller, not shown in figures, of the image forming apparatus receives the image forming instruction through the LAN with an interface.

Next, the following operations are performed in respective image forming units. First, the overall surface of the photosensitive drum 130 is charged by the charger 140. Then the photosensitive drum 130 is exposed corresponding to pieces of image information in respective colors by the exposing assembly, thereby forming an electrostatic latent image.

At the same time of, or prior to forming the electrostatic latent image, a preparation of a developer for developing is started in the toner supply apparatus 160. Namely, the agitator 163 in the toner box 161 starts rotating, thereby starting agitation of the developer stored in the toner box 161. The toner T in the developer is charged by frictional charging with the agitator 163, or by frictional charging among toners T themselves, through such agitation. On the other hand, because of the coexistence of the toner and the electric neutralizer N, an excessive charging of the toner T is suppressed through frictional charging between the toner and the electric neutralizer N.

Further, in the toner supply apparatus 160, a 4-phase alternating current having predetermined amount of phase shifts are applied to each of the electrodes 162*a* included in the group of electrodes arranged on the support film 162*b* of the toner transfer body 162, thereby forming traveling wave electric fields on the toner transfer body 162. In this manner, a developer, which has been in the toner box 161 of the toner supply apparatus 160 and gets on to the toner transfer body 162 from the upstream component 162B of the support film 162*b*, especially the toner T under developing, is carried, while moving among respective electrodes 162*a* by the effects of traveling wave electric fields. At this time, since the electric neutralizer N coexists in the developer, an excessive charging through frictional charging between the support film 162*b* and the toner T, or through frictional charging among the toners T themselves, can be suppressed or avoided. Namely, it is suppressed that the toner T and the toner transfer body 162 are charged in opposite polarities, respectively, and it is suppressed that the toner T adheres to the toner transfer body 162. Namely, cohesion or a blocking of the toner T on the toner transfer body 162 is suppressed, thereby suppressing or avoiding blocking of transfer caused by such cohesion and a like (transfer is stimulated).

Next, when the electrostatic latent image on the photosensitive drum 130 reaches to an area facing to the toner supply apparatus 160 by the rotation of the photosensitive drum 130, the electrostatic latent image contacts with the toner T carried on the electrodes 162*a* (the group of electrodes) arranged on the support film 162*b* of the toner transfer body 162 of the toner supply apparatus 160 by the effects of the traveling wave electric fields, and the toner T lands on the electrostatic latent image on the photosensitive drum 130. As a result, a toner image corresponding to the electrostatic latent image is formed on the photosensitive drum 130. Further, an adhesion type of the toner T can be a type in which the toner T is pressed into the area where the electric charges are removed by the exposure, or a type in which the toner T adheres to the area where the electric charges are retained through the exposure.

When the toner T is carried by the effect of the traveling wave electric fields, since the toner lands even if the toner transfer body 162 is not contacting with the photosensitive drum 130, a load on the toner T or a load on the photosensitive drum 130 by the contact with the photosensitive drum 130 is reduced. Further, the toner lands even if the toner transfer body 162 is not contacting with the photosensitive drum 130. As a result, a toner image corresponding to the electrostatic latent image is formed on the photosensitive drum 130.

After the toner image is formed on this photosensitive drum 130, a toner image is formed on the sheet of paper P provided to the transfer roller 122, when the toner image reaches to the transfer roller 122 by the rotation of the photosensitive drum 130.

The sheet of paper P is sequentially carried in the order of the image forming units of respective colors, and toner images of respective colors are formed on the sheet of paper P in this order.

As explained above, with the toner supply apparatus 160, which stores the above described developer, according to the embodiment of the present invention, since the electric neutralizer N with the toner T is included in the developer, an excessive charging of the toner T or of the toner transfer body 162 can be prevented, when the charged toner T is carried by the travelling wave electric fields, or when the toner T is agitated in the toner box 161. Therefore, cohesion or a blocking of the toner T on the toner transfer body 162 can be effectively suppressed or avoided, and as a result, the transfer of toner T can be stimulated, and the toner T is continuously carried for a long time.

Further, the toner supply apparatus 160 in the above described first embodiment is an example where a toner supply apparatus of the present invention is applied to a full color laser printer of a tandem type. However, a toner supply apparatus of the present invention is not limited to this, and it can be applied to other types of image forming apparatuses. Further, the toner supply apparatus makes up an image developing device with another image supporting body such as the photosensitive drum. In the above described first embodiment, a separate type image developing device, in which the image supporting body (photosensitive drum 130) and the toner supply apparatus 160 are separate bodies, is composed. However, an image developing device of the present invention is not limited to this, and it can be an integrated image developing device in which an image supporting body and a toner supply apparatus are integrated.

Further, in the above explanation, it is not explained about a method of producing the developer. However, according to the description of the toner T and the method of producing thereof described in details in the later part, the present invention can be implemented as a production method.

Hereinafter, the toner T, which is an essential component of the developer, and a method of producing thereof are explained. Further, as already explained, when the electric neutralizer N is a toner-like agent, the toner T and the method of producing thereof below are applied to the electric neutralizer N being the toner-like agent and a method of producing thereof. Further, as a production method of the toner T, known methods can be applied, in addition to the method explained below. For example, such as the mixing pulverization method, the solution suspension method, the suspension polymerization method, and the emulsification condensation method can be considered.

1-2-1 Toner

A toner T includes an adhesive resin, a wax and an electric charging control agent. Further, an electric neutralizer includes an adhesive resin, a wax and an electric charging control resin, but does not include a colorant. Further, an outer additive is added, depending on necessity.

An adhesive resin is not particularly specified, and a synthetic resin known as an adhesive resin is used. For example, a polyester resin, series of styrene resins (for example, styrene and derivatives thereof, such as polystyrene, poly-p-chlorostyrene, polyvinyl toluene, or for example, styrene-styrene derivative copolymer such as styrene-p-chlorostyrene copolymer, styrene-vinyltoluene copolymer, or for example, styrene-series copolymer such as styrene-vinylnaphthalene copolymer, styrene-acrylic acid series copolymer, styrene-methacrylic acid series copolymer, styrene-α-chlormethacrylic acid methyl copolymer, styrene-acrylonitrile copolymer, styrene-vinylmethylether copolymer, styrene-vinylmethylketone copolymer, styrene-vinylmethylketone, styrene-butadiene copolymer, styrene-isoprene copolymer, styrene-acrylonitrile-indene copolymer), acrylic resin, methacrylic resin, polyvinyl chloride resin, phenolic resin, naturally modified phenolic resin, natural resin modified maleate resin, polyvinyl acetate, silicone resin, polyurethane resin, polyamide resin, fran resin, epoxy resin, polyvinyl butyral resin, terpene resin, coumarane-indene resin, or petroleum-based resin can be considered. These can be used alone or in combination.

1-2-2 Colorant

A colorant is to give a desired color to a toner T, and his dispersed or percolated in the adhesive resin. As a colorant, the following can be considered: for example, carbon black; for example, an organic pigment such as quinophthalon yellow, hansa yellow, isoindorinon yellow, benzidine yellow, perinon orange, perinon red, perylene maroon, rhodamine 6G lake, quinacridone red, rose bengal, copper phthalocyanine blue, copper phthalocyanine green, diketopyrrolopyrrole series pigments; for example, an inorganic pigment or metallic powder such as titanium white, titanium yellow, ultramarine blue, cobalt blue, bengala, aluminum powder, bronze; for example, oil soluble dyestuff, or disperse dye such as azo series dyes, quinophthalone series dyes, anthraquinone series dyes, xanthene series dyes, triphenylmethane series dyes, phthalocyanine series dyes, indophenol series dyes, indoaniline series dyes; for example, rosine series dyes such as rosin, rosin modified phenol, rosin modified maleic acid resin. Further, dyes or pigments processed with a higher fatty acid or a resin can be considered.

These can be used alone or in combination depending on a desired color. For example, for a toner T of a single color with colorfulness, a pigment and a dye of the same series of colors, such as a pigment and a dye of rhodamine series, a pigment and a dye of quinophthalon series, a pigment and a dye of phthalocyanine series, for example, can be mixed, respectively. For 100 parts by mass of adhesive resins, a colorant is mixed in a ratio of, for example, 2-20 parts by mass, preferably in a ratio of 4-10 parts by mass.

1-2-3 Wax

A wax is added to improve toner T's ability to be fixed to a recording medium. In the case of a pressure heating method, in general, a wax is included inside of the toner T so that the toner T is easily detached from a heating medium. As a wax, for example, ester series waxes, hydrocarbon series waxes can be considered. As ester series waxes, for example, fatty series ester compounds such as stearic acid ester, palminate; for example, multifunctional ester compounds such as pentaerythritol tetramyristate, pentaerythritol tetrapalmitate, dipentaerythritol hexapalmitate, can be considered. As hydrocarbon series waxes, for example, polyolefin wax types such as low-molecular-weight polyethylene, low-molecular-weight polypropylene, low-molecular-weight polybutylene; for example, plant-derived natural waxes such as candelilla, carnauba, rice, sumac, jojoba; for example, petroleum-based waxes and their modified waxes such as paraffin-based wax, microcrystalline, petrolatum; for example, synthetic wax such as Aischer-Tropsch wax, can be considered.

These waxes can be used alone or in combination. It is preferable that among the above described waxes, waxes having melting points in the range of 50-100 degrees Celsius are considered. A wax having a lower melting point and lower melt viscosity, can prevent an offset by melting faster than the adhesive resin and bleeding on the surface of the toner T, even if a heating temperature of a fixing unit is low. More specifically, ester series waxes, paraffin series waxes can be considered. For 100 parts by mass of adhesive resins, a wax is mixed in a ratio of, for example, 1-30 parts by mass, preferably in a ratio of 2-15 parts by mass.

1-2-4 Electric Charging Control Agent

An electric charging control agent is used alone or in combination, among positive electric charging control agents or negative charging control agents, depending on an objective and a purpose. Further, for the toner T and the electric neutralizer N being the toner-like agent in the developer, one of or both of a positive electric charging control agent and a negative charging control agent can be used. By combining electric charging control agents having different charging properties, a charging characteristic can be easily adjusted, thus it is advantageous for obtaining the toner T and the electric neutralizer N for the developer. As the positive electric charging control agent, for example, nigrosine dye, quaternary ammonium compound, onium compound, triphenylmethane compound, a compound including a basic group, an acrylate series resin including a tertiary amino group, can be considered. As the negative electric charging control agent, for example, trimethylethane series dye, azo series pigment, copper phthalocyanine, a metal complex salt of salicylic acid, a metal complex salt of benzilic acid, perylene, quinacridone, a metal complex salt of azo series dye, can be considered. For 100 parts by mass of adhesive resins, the electric charging control agent is mixed in a ratio of, for example, 0.1-10 parts by mass, preferably in a ratio of 0.5-5 parts by mass.

1-2-5 Outer Additive

An outer additive is added to control a charging characteristic, fluidity, and preservation stability, and is composed of submicron particles with very small particle diameters with respect to that of the toner generating particle. The toner T in the developer of the present invention can be given a predetermined electric charging characteristic through the outer additive. Further, similarly, the electric neutralizer N being the toner-like agent in the developer of the present invention can be given an opposite electric charging characteristic with respect to that of the toner T through the outer additive.

As the outer additive, for example, an inorganic particle or a particle of synthetic resin can be considered. As an inorganic particle, for example, silica, aluminum oxide, titanium oxide, silicon aluminum oxide, silicon titanium oxide and hydrophobic compounds thereof can be considered. For example, a hydrophobic compound of silica can be obtained by processing a small powder body of silica with a silicone oil or a silane coupling agent (such as, dichloro(dimethyl)silane, hexamethyldisilazane, or tetramethyldisilazane).

Further, the above described outer additives have negative charging properties, however, as the outer additives having a positive charging properties, the following can be considered: aminosilane-silicone oil, aminoammonium-silicone oil, aminosilane-hexamethyldisilazane, aminoammonium-hexamethyldisilazane, aminosilane-dichlorodimethylsilane, aminoammonium-aminosilane-dichlorodimethylsilane, aminosilane-polydimethylsiloxane, aminoammonium-polydimethylsiloxane.

As a particle of a synthetic resin, for example, the following can be considered: a methacrylate ester polymer particle, an acrylic ester polymer particle, a styrene-methacrylic acid ester co-polymer particle, a styrene-acrylic ester co-polymer particle, a core shell type particle in which the core is a styrene polymer and the shell is a methacrylic acid ester polymer.

When the outer additive is added, the toner generating particle and the outer additive are agitated using, for example, a high speed agitator such as a Henshell Mixer. For example, for 100 parts by mass of toner generating particles, in general, the outer additive is added at a rate of 0.1-6 parts by mass.

Hereinafter, the present invention is explained through considering embodiments. Further, the present invention is not limited to the embodiments below.

1-3 Embodiments

1-3-1 First Embodiment

After mixing the following materials, a resin solution is prepared by heating at 45 degrees in Celsius.

| | |
|---|---|
| Polyester resin FC1565 (*1) | 17 parts by mass |
| Ester series wax (*2) | 1 part by mass |
| A dye of negrosine series (electric charging control agent) (*3) | 1 part by mass |
| Carbone black (colorant) (*4) | 1 part by mass |
| Methyl ethyl ketone | 80 parts by mass |

(*1) made by Mitsubishi Rayon Co., tg64° C., Mn (number average molecular weight), Nw (weight average molecular weight) 98000, gel (THF insolubles) 1.5 mass %, acid value 6.1 mgKOH/g (*2) Unister H 476, made by NOF Corporation (*3) Bontron NO4, made by Orient Chemical Industries Co.

(*4) #260 carbon black, made by Mitsubishi Chemical Corporation

A hydroxyl medium is prepared by mixing 100 parts by mass of distilled water with 1 part by mass of a solution of sodium hydroxide. After that, the solution is heated to 45 degrees in Celsius.

While maintaining 45 degrees in Celsius, 100 parts by mass of the resin solution and 100 parts by mass of aqueous vehicle are mixed. After that, an emulsified liquid is prepared by mixing the solution with Homogenizer DIAX900 (Heidolph Japan) at 16000 rpm for 30 minutes.

A suspension liquid is obtained by including 1600 parts by mass of the obtained emulsified liquid in a 2 L separable flask and removing the organic solvent by heating and agitating the liquid for 150 minutes at 70 degrees in Celsius, while nitrogen gas is sent to its gas phase. The average volume diameter of resin particles in the suspension liquid was 265 nm. Further, it was checked whether there existed any precipitate, but no precipitate was found. After that, 1600 parts by mass of the suspension liquid is prepared by diluting the suspension liquid with distilled water so that the solid content concentration of the suspension liquid becomes 10% by mass.

Then, 2.5 parts by mass of 0.2N aluminum chloride is added to 100 parts by mass of the suspension liquid and the liquid is mixed at a high speed for 10 minutes with a homogenizer. After that, the liquid is heated up to a liquid temperature of 45 degrees in Celsius, while the liquid is agitated with 6 flat turbine blades at 300 rpm. The liquid is agitated for 20 minutes. Then, 2.5 parts by mass of 0.2N aqueous sodium hydroxide is added to the suspension liquid and heated up to a liquid temperature of 90 degrees in Celsius. The suspension liquid is agitated for 5 minutes, until shapes of toner generating particles becomes exactly spherical. Then, it is cooled down. After it is cooled down, 2.5 parts by mass of 1N aqueous solution of hydrochloric acid is added to 100 parts by mass of the suspension liquid, the suspension liquid is agitated for 1 hour to the extent that the suspension liquid flows, then the suspension liquid is filtered and dried, thereby obtaining the toner generating particles.

A toner T with a positive charging characteristic is obtained by agitating and mixing 100 parts by mass of the obtained toner generating particle with 2.0 parts by mass of silica (MAP-013 (for providing positive electric charges), made by Tayca Corporation) using a Henshell Mixer. Further, the volume averaged particle diameter is measured with Coulter Multisizer II (aperture diameter of 100 μm) made by Beckman Coulter Corporation.

1-3-2 Second Embodiment

[Preparation of Electric Neutralizer]

A toner generating particle is obtained by the same operations as in the case of production of the toner T described in the first embodiment, except for two points that a resin solution with the composition below does not contain carbon black as a row material, and that as a cohesion preventing agent, half of 2.5 parts by mass (1.25 parts by mass) of a solution of 0.2N sodium hydroxide is used. A toner T with a negative charging characteristic is obtained by agitating and mixing 100 parts by mass of the toner generating particle with 2.0 parts by mass of silica (MSN-007 (for providing negative electric charges), made by Tayca Corporation) using a Henshell Mixer. The toner T with the negative charging characteristic is regarded as an electric neutralizer N1. The volume average diameter of the obtained toner T (by the same measurement method as in the first embodiment) was 20 μm. Further, the resin solution is prepared by mixing the following raw materials, and after that heated to 45 degrees in Celsius. For each raw material, the same raw material as in the first embodiment is used.

| | |
|---|---|
| Polyester resin FC1565 | 17 parts by mass |
| Ester series wax | 1 part by mass |
| A dye of negrosine series (electric charging control agent) | 1 part by mass |
| Methyl ethyl ketone | 80 parts by mass |

A toner generating particle is obtained by the same operations as in the producing method of the toner generating particle described in the first embodiment. Further, a toner T with a negative charging characteristic is obtained by agitating and mixing 100 parts by mass of the toner generating particle with 2.0 parts by mass of silica (MSN-007 (for providing negative electric charges), made by Tayca Corporation) using a Henshell Mixer. The toner T with the negative charging characteristic is regarded as an electric neutralizer N2. The volume average diameter of the obtained toner T (by the same measurement method as in the first embodiment) was 7.9 μm.

1-3-3 Third Embodiment

[Preparation of Developer]

Developers 1-8 are obtained by mixing the toner T obtained in the first embodiment with the electric neutralizer N1 or the electric neutralizer N2 in the mixing ratios (mass rations) shown in the table below, in a polyester bag of a suitable capacity. Further, a developer which only includes the toner T is used as a comparative example.

TABLE 1

| | Toner | | | Electric Neutralizer | | | Mixing Ratios of the Electric Neutralizer with respect to total | |
|---|---|---|---|---|---|---|---|---|
| Types of Developer | Raw Material | Polarity | Particle Diameter [μm] | Raw Material | Polarity | Particle Diameter [μm] | amount of Toner and Electric Neutralizer (mass ratios) | Continuous transfer time [min] |
| Comparative Example | Polyester | + | 7.5 | | | | | 6 |
| Developer 1 | Polyester | + | 7.5 | Polyester | − | 20 | 10 | 30 |
| Developer 2 | Polyester | + | 7.5 | Polyester | − | 20 | 30 | 40 |
| Developer 3 | Polyester | + | 7.5 | Polyester | − | 20 | 50 | 90 |
| Developer 4 | Polyester | + | 7.5 | Polyester | − | 20 | 70 | 35 |
| Developer 5 | Polyester | + | 7.5 | Polyester | − | 20 | 10 | 20 |
| Developer 6 | Polyester | + | 7.5 | Polyester | − | 20 | 30 | 22 |
| Developer 7 | Polyester | + | 7.5 | Polyester | − | 20 | 50 | 30 |
| Developer 8 | Polyester | + | 7.5 | Polyester | − | 20 | 70 | 15 |

Figure 3:
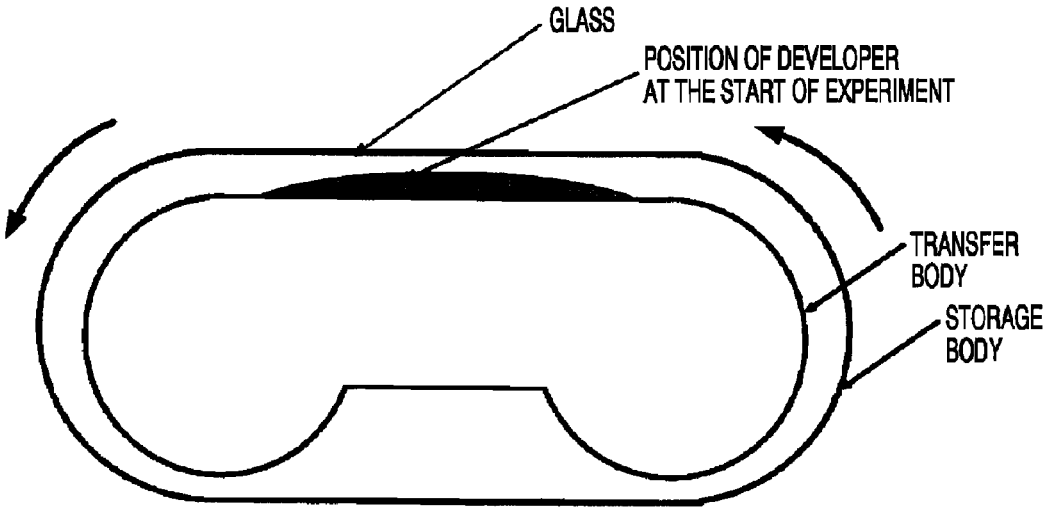
FIG. 3 is a diagram illustrating an outline of an apparatus to evaluate toner transfer by traveling wave electric fields.
Figure 4:
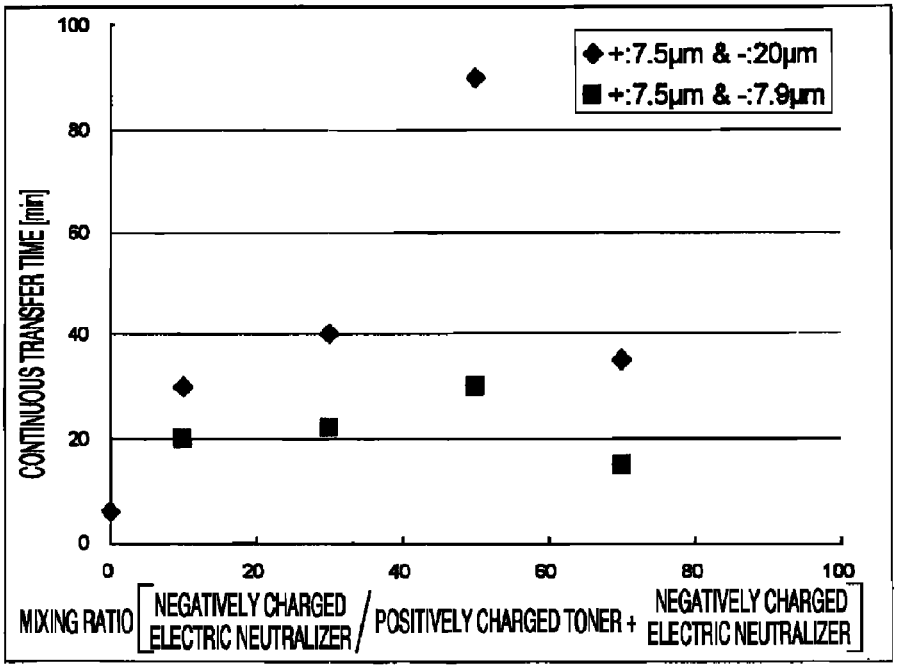
FIG. 4 is a diagram illustrating a result of an evaluation of continuous transfer time of a developer prepared in an example according to the first embodiment.

Next, experiments were conducted in which a constant volume of each obtained developer is supplied to a circular experimental device shown in FIG. 3. The circular experimental device has been created to simulate a transfer body used in the transfer method by the traveling wave electric fields. It is not shown in figures but a plurality of electrodes, which is arranged in the transfer direction, is placed inside. The circular experimental device is configured such that by applying a 4-phase alternating current whose phases are different to the plurality of electrodes sequentially, positively charged toners T can be carried by the effect of the traveling wave electric fields in the direction of the arrow in the figure. Further, the transfer body is set in an appropriate receptor. The top surface of the transfer body is covered with a transparent glass plate which is arranged at a constant height from the top surface, except for a time when developers are supplied.

In the evaluation, after a constant volume of each developer is supplied at the position shown in FIG. 3 at a time when the experiment is started, transfer of the toner by the traveling wave electric fields in the direction shown in FIG. 3 is started by applying voltages with a predetermined state. It is visually confirmed whether the developer is circulated on the surface of the transfer body. The time until the circulation is not confirmed is measured, and it is regarded as a continuous transfer time (minutes). The results are shown in FIG. 3.

As it is shown in FIG. 3, by adding a toner generating particle having a negative charging characteristic as an electric neutralizer N to a toner having a positive charging characteristic, the continuous transfer time is significantly extended. It is found that for the developers 1-8, the continuous transfer time is extended at least as much as 2.5 times.

Especially, for developers 1-4 in which the electric neutralizer N1 having a greater diameter is used, the extension effect of the continuous transfer time is higher, increasing from 5 times to 15 times. Among these, especially, when the mixing ratio of the electric neutralizer N with respect to the total amount of the toner T and the electric neutralizer N is, particularly, more than or equal to 30 parts by mass and less than or equal to 50 parts by mass, an extension effect of greater than or equal to 7 times and less than or equal to 15 times can be observed, and the best extension effect can be observed when the mixing ratio is 50 parts by mass.

Further, for developers 5-8 in which the electric neutralizer N2 having a smaller diameter, although the extension effect is relatively lower than that of the developers 1-4 where the electric neutralizer N2 is used, a fine extension effect of the continuous transfer time is observed, when the mixing ratio is in the range of more than or equal to 30 parts by mass and less than or equal to 50 parts by mass with respect to the total amount, and especially a good effect is obtained when the mixing ratio is 50 parts by mass.

Further, in these embodiments, it is assumed that a binder and a colorant are not included at the time when the toner generating particle is prepared. However, when the toner generating particle is prepared using the binder and the colorant, and similarly the toner T and the electric neutralizer N are prepared, it is confirmed that the same effect as described above can be obtained.

1-4 Modified Embodiments

1-4-1 Modified Embodiment 1

In the above described first embodiment, the developer including the toner T having the predetermined charging characteristic (for example, a positive charging characteristic) and the electric neutralizer N having the opposite charging characteristic (for example, a negative charging characteristic) is used. In the above described first embodiment, since the voltage biased in the same polarity as that of the toner is applied to the transfer electrode 162*a* placed near the current position DP, there is almost no possibility that the electric neutralizer N reaches to the photosensitive drum 130, thus it is rare that the electric neutralizer gives some effect to an image to be formed. Therefore, usually, it is not necessary to include a colorant in the electric neutralizer. However, if a high image quality is required, image quality degradation caused by very small quantity of the electric neutralizer N that can be transferred to a sheet of paper P can be a problem. In such a case, it is possible to reduce the image quality degradation and to form an image of a high image quality by including a colorant in the electric neutralizer N, and coloring the electric neutralizer in a same series of color (preferably the same color) as that of the toner T. The electric neutralizer N colored in this manner in the same series of color as that of the toner T is called, here, "a toner with an opposite charging characteristic."

The modified example 1 described below of the first embodiment of the present invention is an example of a laser printer 100 having the same configuration as that of the above described first embodiment except for the developer. In the modified example 1, the developer including a toner T1 having a positive charging characteristic that is positively charged by the agitation of the developer and a toner T2 having a negative charging characteristic that is negatively charged by the agitation of the developer is used. In this modified example, because the voltage biased positively is applied to the transfer electrode 162*a* placed at the current position DP, almost only the toner T1 with the positive charging characteristic reaches the photosensitive drum 130, and is used for developing an electrostatic latent image formed on the surface of the photosensitive drum 130. Namely, the toner T1 with the positive charging characteristic behaves like the toner T in the above described first embodiment, and the toner T2 with the negative charging characteristic behaves like the electric neutralizer N.

1-4-2 Modified Example 2

Figure 5:
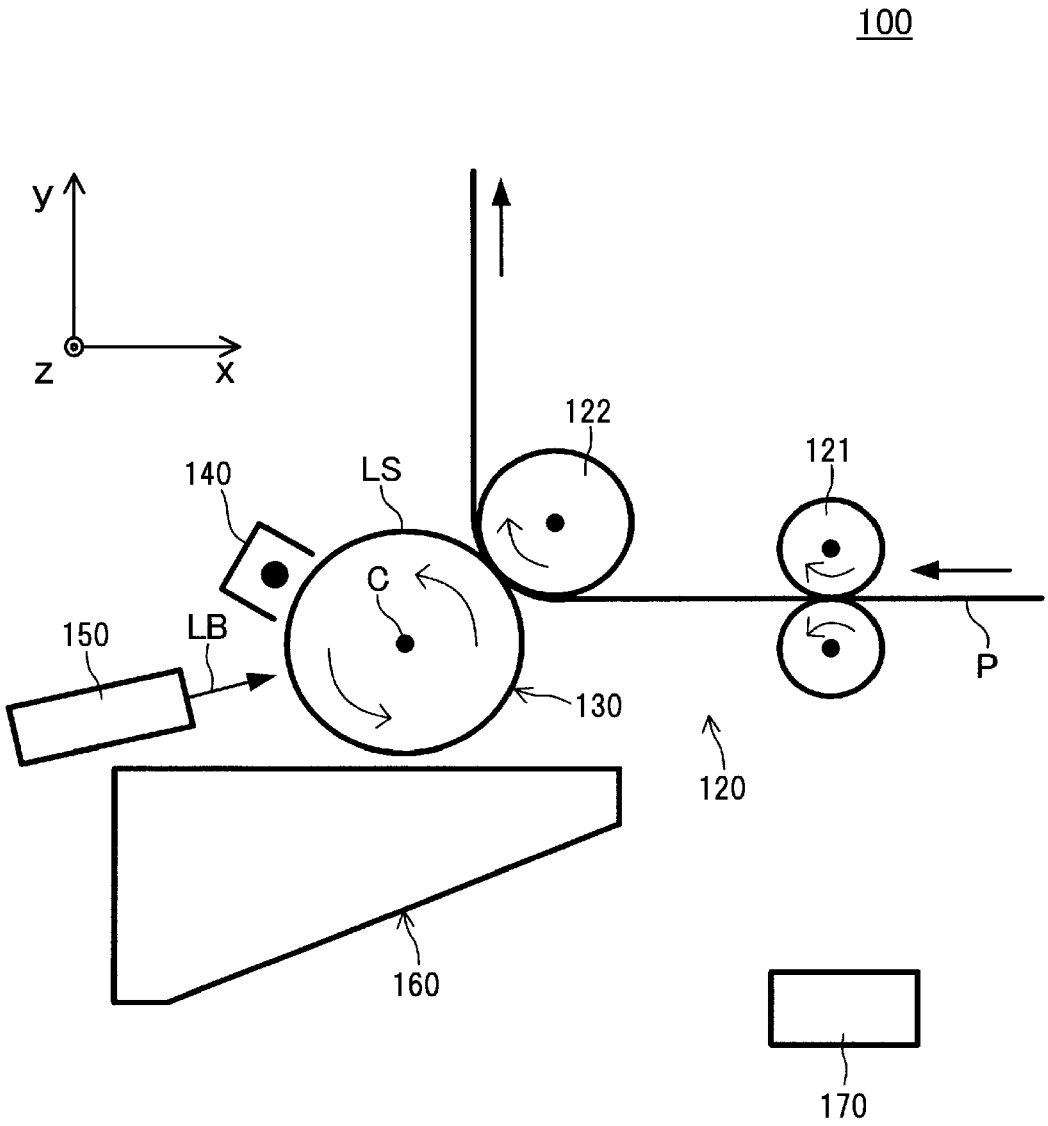
FIG. 5 is a diagram illustrating a schematic configuration of a modified example of an image forming unit according to the first embodiment of the present invention.

In the above described embodiment, as shown in FIG. 1, each element is arranged so that the sheet of paper is carried straight without making a turn at the image forming unit. However, an arrangement of the image forming unit of the present invention is not limited to the arrangement of the above described embodiment. For example, as shown in FIG. 5, an arrangement of the image forming unit of the present invention can be configured such that the transfer direction of the sheet of paper is changed at the image forming unit (about 90 degrees in the figure).

2 Second Embodiment

Next, the second embodiment of the present invention is explained.

2-1 Configuration of Laser Printer (Image Forming Apparatus)

Figure 6A:
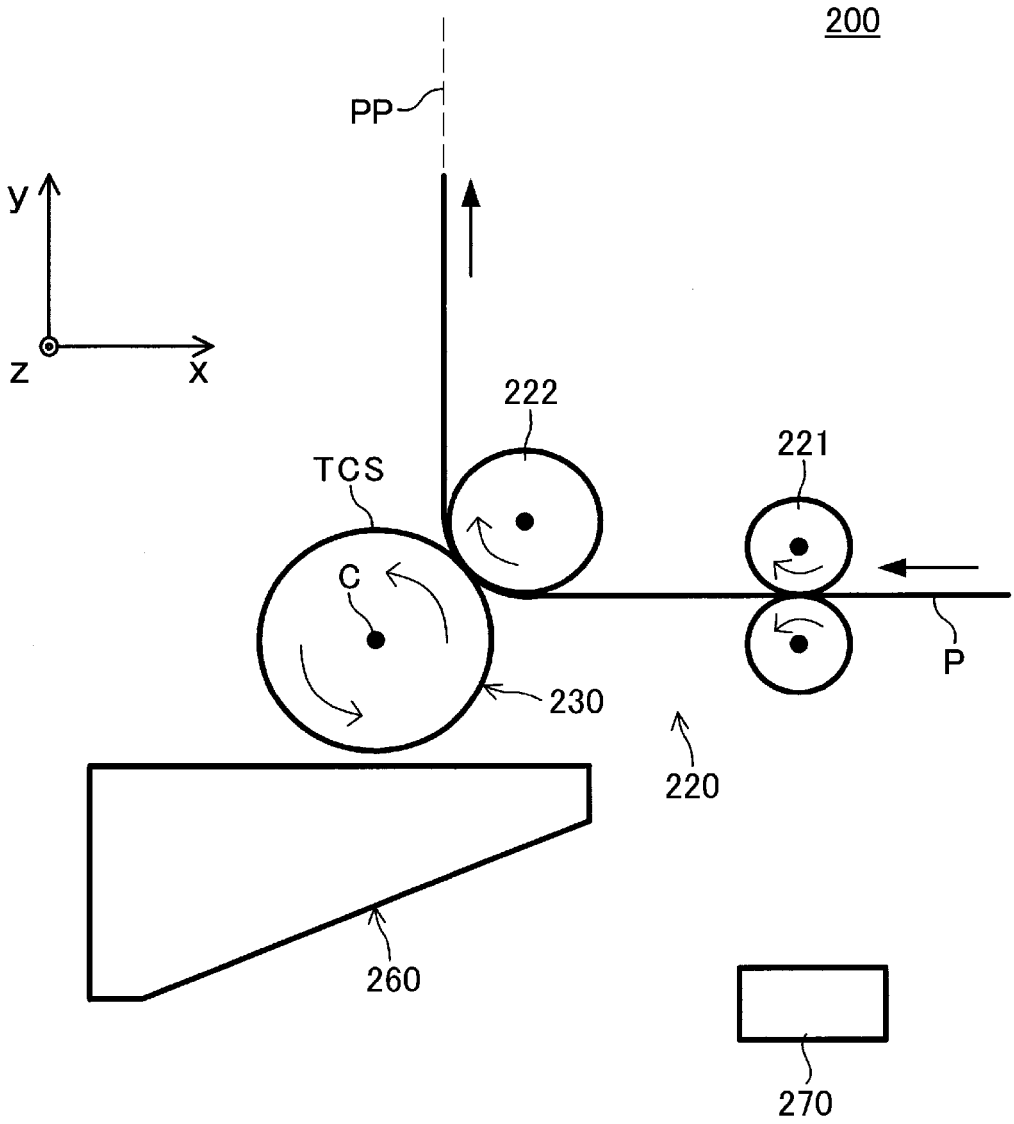
FIG. 6A is a side view illustrating a schematic configuration of an image forming unit in a laser printer according to a second embodiment of the present invention.

FIG. 6A is a side view showing an outline configuration of a laser printer 200 of the second embodiment, exemplary showing the present invention.

As shown in FIG. 6A, the laser printer 200 (image forming apparatus) includes a document transfer mechanism 220, an intermediate transfer drum 230 (developer image supporting body, subject to supply), a toner supply apparatus 260 (developer supply apparatus), and a control device 270.

On a paper feed tray not shown figures included inside of the laser printer 200, sheets of papers P are stored in a stacked state. The document transfer mechanism 220 is configured so that it can transfer a sheet of paper P along a predetermined document transfer path PP. Specifically, the document transfer mechanism 200 has a pair of resist rollers and a transfer roller 222.

The resist roller 221 is configured such that it can send the sheet of paper P at a predetermined timing to the gap between the intermediate transfer drum 230 and the transfer roller 22.

The transfer roller 222 is facing to the intermediate transfer drum 230, while pinching a sheet of paper P. The transfer roller 222 is configured to be rotary driven in the direction indicated by the arrow (clockwise) in the figure.

The intermediate transfer drum 230 (developer image supporting body) is a cylindrical assembly made of a conductive material, and is configured to be rotary driven in the direction indicated by the arrow (counterclockwise) in the figure, while the center of rotation being at the center axis C. On a peripheral surface of the intermediate transfer drum 230, the above described toner carrying surface TCS (developer image supporting surface) is formed. The toner carrying surface TCS is a cylindrical surface showing conductivity, and it is formed in parallel to the main scanning direction (z direction in the figure).

The toner supply apparatus 260 (developer supply apparatus) is arranged to face with the intermediate transfer drum 230. Namely, the toner carrying surface TCS can move relatively to the toner supply apparatus 260 along the sub-scanning direction which is perpendicular to the main scanning direction, when the intermediate transfer drum 230 is rotary driven as described above. The detailed configuration of the toner supply apparatus is described later.

The control device 270 is configured to control behavior of each unit (driving unit or voltage applying unit, etc.) included in the laser printer 200.

2-1-1 Toner Supply Apparatus

Figure 7:
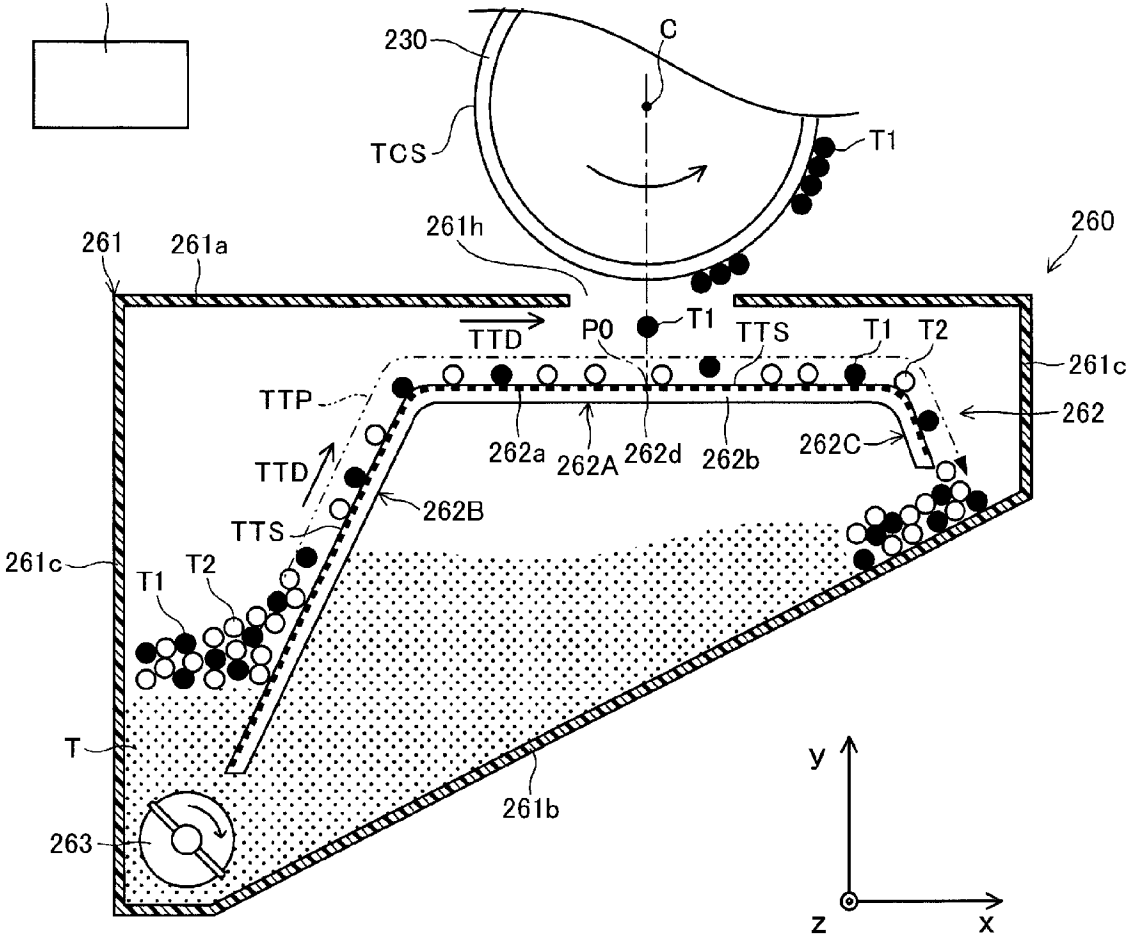
FIG. 7 is an overall cross-sectional side view magnifying a portion where an intermediate transfer drum and a toner supply apparatus, shown in FIG. 6A, are facing.

Next, a more detailed configuration of the toner supply apparatus is explained. FIG. 7 is a sectional view magnifying the portion shown in FIG. 6A where the intermediate transfer drum 230 and the toner supply apparatus 260 are facing.

Hereinafter, with reference to FIG. 7, the toner supply apparatus 260 is configured as below so that it can carry a toner T which is dry type developer in a power state along a toner transfer path TTP in the toner transfer direction TTD and supply the toner to the toner carrying surface TCS, while the toner T being in a charted state.

A toner box 261 which forms a casing of the toner supply apparatus 260 includes a top plate 261*a*, a bottom plate 261*b*, and a side plate 261*c*. Almost the same amount of a toner T1 with a positive charging characteristic and a toner T2 with a negative charging characteristic are in a state in which these are mixed together and stored inside of the toner box 261.

The top plate 261*a* is a rectangular shaped plate-like member in plain view, and is arranged in parallel with the horizontal plane. The bottom plate 261*b* is a rectangular shaped plate-like member in plain view, and is arranged below the top plate 261*a*. The bottom plate 261*b* is arranged at a slant such that when a point moves in the positive direction along the x-axis, the point is raised in the positive direction in the y-axis. Outer four edges of the top plate 261*a* and that of the bottom plate 261*b* are connected to four pieces of the side plates 261*c* (two out of the four pieces the side plates 261*c* are shown in FIG. 7). With this configuration, the toner box 261 can store a toner T without leaking the toner.

A toner passage hole 261*h* is formed on the top plate 261*a*. The toner passage hole 261*h* is formed at a position where the top plate 261*a* and the toner transfer surface are approaching together. The toner passage hole 261*h* is formed in a rectangular shape in plain view having a longer side which has substantially the same length as the width of the toner carrying surface TCS in the main scanning direction (z-axis direction in the figure) and a shorter side in parallel with the sub-scanning direction (x-axis direction in the figure). The toner passage hole 261*h* is formed such that the toner T can pass through it when the toner T moves from the inside of the toner box 261 to the toner carrying surface TCS along the y-axis direction in the figure.

2-1-2 Toner Transfer Body

A toner transfer body 262 is stored inside of the toner box 261. The toner transfer body 262 is a planar assembly having a predetermined thickness. The toner transfer body 262 includes a central component 262A, an upstream component 262B, and a downstream component 262C.

The central component 262A is formed substantially in a rectangular shape in plain view having a long side which has substantially the same length as the width of the intermediate transfer drum 230 in the main scanning direction and a short side which is longer than the diameter of the intermediate transfer drum 230. The central component 262A is placed in a position such that its center in the sub-scanning direction (x-axis direction in the figure) matches with the center of the toner passage hole 261*h* in the sub-scanning direction. Namely, the central component 262A is arranged substantially in parallel with the top plate 261*a* so that it faces with the toner carrying surface TCS through the toner passage hole 261*h*.

The upstream component 262B is placed at further upstream of an upstream end of the central component 262A in the toner transfer direction TTD and extending obliquely downward. Namely, the upstream component 262B is provided as a plate-like member extending obliquely upward toward the central component 262A. Further, the upstream component 262B is provided such that a portion (bottom part) of the upstream component 262B is embedded in the toner T even if the amount of the toner T remaining is low by extending the most upstream end in the toner transfer direction TTD of the upstream component 262B to the neighborhood of the deepest portion of the toner box 261.

The downstream component 262C is placed at further downstream of a downstream end of the central component 262A in the toner transfer direction TTD and extending obliquely downward. Namely, the upstream component 262B is provided as a plate-like member extending obliquely downward apart from the central component 262A. Further, the downstream component 262C is provided such that the most downstream end of the downstream component 262C in the toner transfer direction TTD reaches to a neighborhood of the bottom plate 261*b* of the toner box 261 and the neighborhood of the most downstream side plate 261*c* in the toner transfer direction TTD (namely, the shallowest portion of the toner box 261), so that the toner T can flow back to the bottom plate 261*b* smoothly.

The toner transfer body 262 has a toner transfer surface TTS parallel to the main scanning direction. The toner transfer body 262 is arranged so that the toner transfer surface TTS faces to the toner carrying surface TCS on the intermediate transfer drum 230. The toner transfer body 262 includes a transfer electrode 262*a*, a support film 262*b*, and a covering layer 262*c*.

Figure 8:
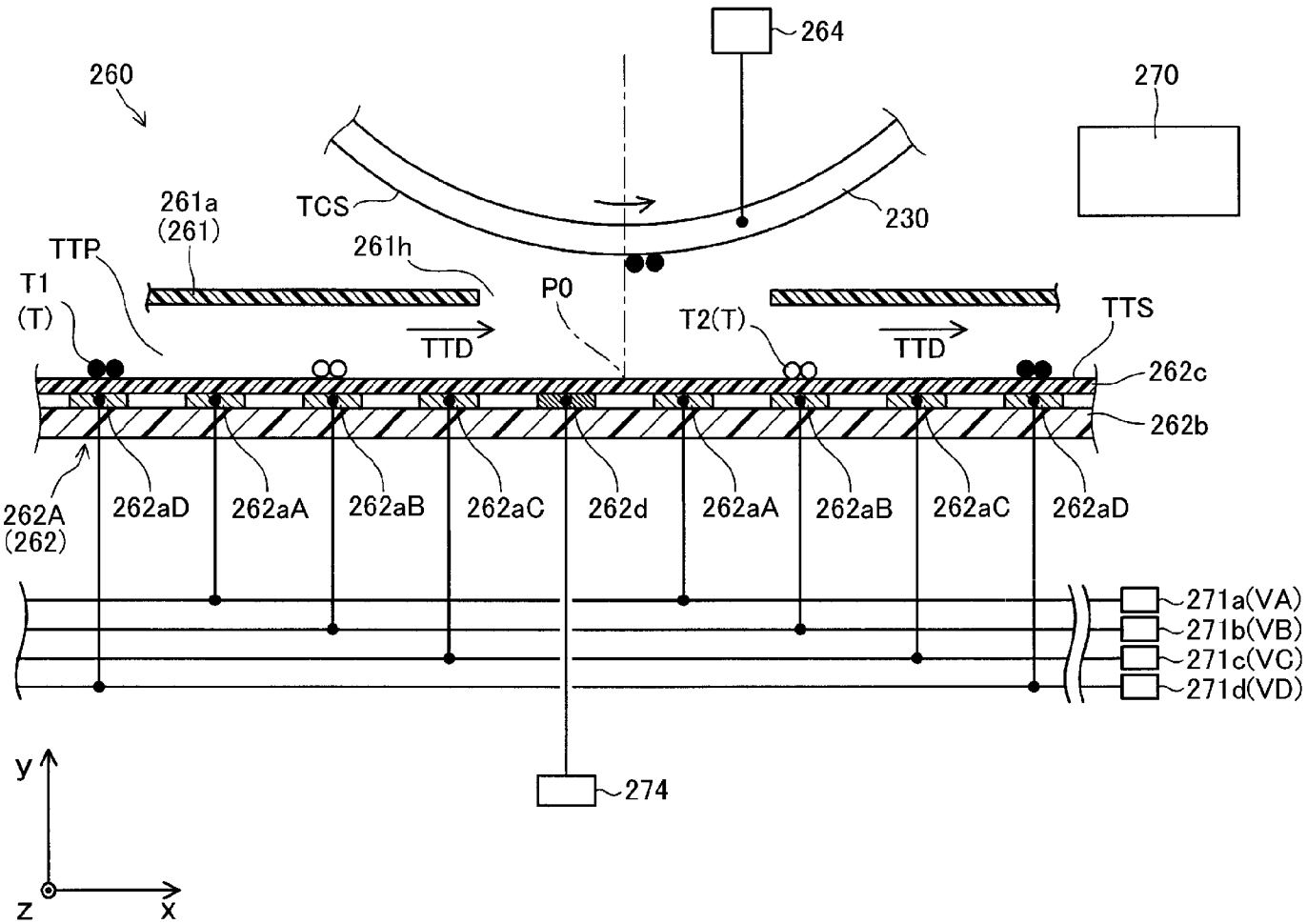
FIG. 8 is an overall cross-sectional side view magnifying a portion where a toner transfer body and an intermediate transfer drum, shown in FIG. 7, are facing.
Figure 9A:
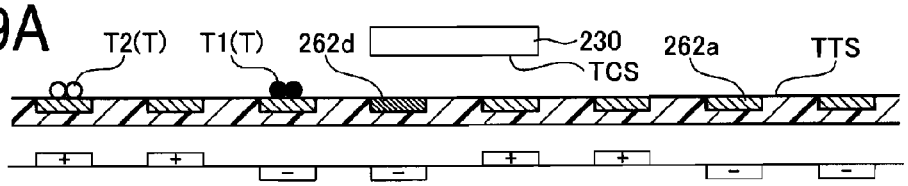
FIGS. 9A-FIG. 9F show a diagram illustrating a toner transfer operation by transfer electrodes and pixel electrodes, and a situation of a pixel forming operation by pixel electrodes (when an image is not formed and only a toner transfer operation is performed by transfer electrodes and pixel electrodes), shown in FIG. 8.
Figure 9B:
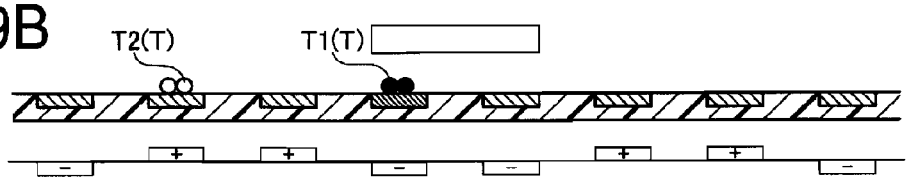
Figure 9C:
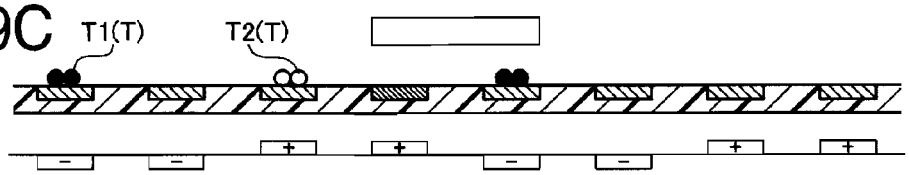
Figure 9D:
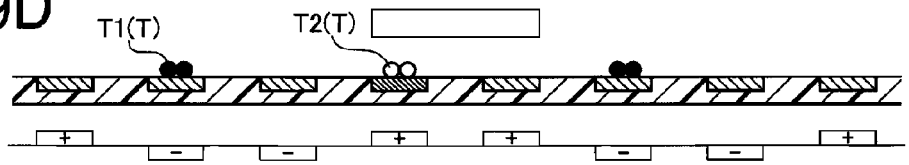
Figure 9E:
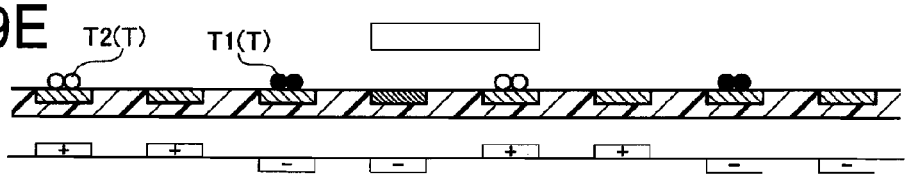
Figure 9F:
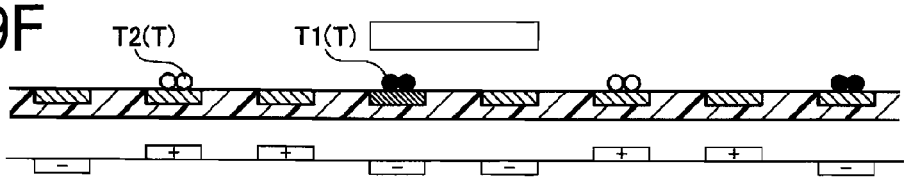

FIG. 8 is a sectional side view magnifying the portion where the toner transfer body 262 and the intermediate transfer drum 230 are facing with each other as shown in FIG. 7. Hereinafter, an internal configuration of the toner transfer body 262 is explained with reference to FIG. 7 and FIG. 8.

2-1-3 Transfer Electrodes, Pixel Electrodes

A plurality of transfer electrodes 262*a* are arranged along the toner transfer path TTP (namely, along the toner transfer surface TTS). Each transfer electrode 262*a* is a thin wire-like wired pattern made of a metal thin film (about 0.1 mm in thickness, about 0.2 mm in pitch). These electrodes are arranged in parallel to each other so as to have the longitudinal direction in the main scanning direction. These transfer electrodes 262*a* are equally spaced apart along the sub-scanning direction (in FIG. 7 or FIG. 8, for the sake of clarity, sizes and positional relationships of the transfer electrodes 262*a* and other portions are exaggerated than they are).

In a neighborhood of the closest position P0 where the transfer electrode 262*a* should be placed, and where the toner transfer body 262 and the intermediate transfer drum 230 become closest to each other (the distance between the toner transfer surface TTS and the toner carrying surface becomes the shortest), instead of one transfer electrode 262*a*, a plurality of pixel electrodes 262*d* are arranged in one line in the main scanning direction so that these pixel electrodes 262*d* correspond to a plurality of pixels to be formed on the toner carrying surface along the main scanning direction. Specifically, in this embodiment, the pixel electrodes 262*d* are provided at a position immediately forward of the closest position P0 in the position where the transfer electrode 262*a* should be provided (further, in this embodiment, the closest position P0 is set to be the middle position between two neighboring positions where the transfer electrodes 262*a* should be placed, respectively).

The transfer electrodes 262*a* and the pixel electrodes 262*d* are formed on the support film 262*b* which is a board-shaped member made of a synthetic resin. With reference to FIG. 8, the surface of the support film 262*b* on which the transfer electrodes 262*a* and the pixel electrodes 262*d* are formed is covered with the covering layer 262*c* made of a synthetic resin. In this embodiment, the toner transfer surface TTS is composed of the surface of the covering layer 262*c* made of the synthetic resin.

Again, with reference to FIG. 7, at the deepest portion of the toner box 261, lower than the lower end of the upstream component 262B in the toner transfer body 262, there is provided an agitator 263. The agitator 263 is configured to be rotatable in the direction indicated by the arrow (clockwise) in the figure so that it agitates the toner T at the deepest portion of the toner box 261 and causes the toner T to be flown, and it can charge the toner T by producing frictions between the toner T and the toner transfer surface or frictions among themselves (between the toner T1 with the positive charging characteristic and the toner T2 with the negative charging characteristic).

2-1-4 Voltage Applying Unit

With reference to FIG. 8, the intermediate transfer drum 230 is electrically connected to a developing bias applying unit 264 (bias applying unit). The developing bias applying unit 264 is configured to set the surface potential (potential of the toner carrying surface TCS) of the intermediate transfer drum 230 to a predetermined developing bias potential.

The plural transfer electrodes 262*a* are divided into four groups per every three of them. These groups are connected to transfer voltage applying units 271*a*, 271*b*, 271*c*, and 271*d*, respectively. Namely, a plurality of transfer electrodes 262*a*A-D are connected to the transfer voltage applying unit 271*a-d*, respectively, so that a transfer electrode 262*a*A connected to the transfer voltage applying unit 271*a*, a transfer electrode 262*a*B connected to the transfer voltage applying unit 271*b*, a transfer electrode 272*a*C connected to the transfer voltage applying unit 271*c*, a transfer electrode 262*a*D connected to the transfer voltage applying unit 271*d*, a transfer electrode 262*a*A connected to the transfer voltage applying unit 271*a*, a transfer electrode 262*a*B connected to the transfer voltage applying unit 271*b*, . . . , are in a condition in which these electrodes are provided in this order in the toner transfer direction TTD.

The transfer voltage applying units 271*a-d* are power circuits for applying transfer voltages in a shape of a travelling wave to the plurality of transfer electrodes 262*a*, and they are configured to generate alternating currents having almost the same shape but their phases are shifted by ¼ wavelength each. Specifically, the transfer voltage applying units 271*a-d* output sinusoidal voltages where the above described developing bias voltage is regarded as the center value (reference value).

The plurality of pixel electrodes 262*d* is electrically connected to the pixel forming voltage applying unit 274. The pixel forming voltage applying unit 274 outputs the same voltages as that of the transfer voltage applying unit 271*d*, when pixels are not formed on the toner transfer surface TCS. Further, the pixel forming voltage apply unit 274 is configured such that it can apply the pixel forming voltages to the plurality of pixel electrodes 262*d*, respectively.

Specifically, when pixels are formed on the toner carrying surface TCS with a toner T1 with a positive charging characteristic, the pixel forming voltage applying unit 274 outputs a pixel forming voltage that offset in a positive polarity than the transfer voltage so as to fly the positively charged toner T1 to the toner carrying surface TCS at a timing when the positively charged toner T1 should pass above the image forming electrodes 262*d*. Further, when pixels are formed on the toner carrying surface TCS with a toner T2 with a negative charging characteristic, the pixel forming voltage applying unit 274 outputs a pixel forming voltage that offset in a negative polarity than the transfer voltage so as to fly the negatively charged toner T2 to the toner carrying surface TCS at a timing when the negatively charged toner T2 should pass above the pixel electrodes 262*d*.

Namely, when the pixel electrodes 262*d* are operated as transfer electrodes 262*a* (when the toner transfer operation is performed by the pixel electrodes), the image forming voltage applying unit 274 applies the same voltage as applied to the transfer electrode 262*a*D to all the pixel electrodes 262*d*. Further, the pixel forming voltage applying unit 274 outputs a higher voltage (a voltage with a large offset amount) than the transfer voltage with respect to the above described central value (reference value) at a timing when one of the toner T1 with the positive charging characteristic and the toner T2 with the negative charging characteristic, with which pixels should be formed (which should be carried on the toner carrying surface, this time), should pass over the pixel electrodes 262*d*, with the corresponding polarity to a specific pixel electrode 262*d*.

Further, in this embodiment, the pixel forming voltage applying unit 274 realizes density gradation characteristics for respective pixels by varying output voltages depending on the change of the densities of the pixels on the toner carrying surface TCS.

The control device 270 is electrically connected to the developing bias applying unit 264, the pixel forming voltage applying unit 274, and the transfer voltage applying units 271*a*-271*d*, and controls output states of the voltages (voltages and timings) in these units.

2-2 Overview of Operation of Image Forming Apparatus

Next, an overview of the operation of the laser printer 200 is explained with reference to respective figures.

With reference to FIG. 6A, a tip of a sheet of paper P loaded on a document feeding tray, not shown in the figures, is sent to the resist roller 221. At the resist roller 221, a skew of the sheet of paper P is corrected, and the transfer timing is adjusted. Then, the sheet of paper P is transferred to a transfer position where the intermediate transfer drum 230 and the transfer roller 222 are facing to each other.

An image by toner T (hereinafter referred to as "toner image") is carried on the toner carrying surface TCS, as described below, which is a peripheral surface of the intermediate transfer drum 230, while the sheet of paper P is transferred to the transfer position.

The toner image carried on the toner carrying surface TCS of the intermediate transfer drum 230 is transferred to the transfer position by the rotation of the toner carrying surface TCS in the direction indicated by the arrow in the figure (counterclockwise). Then, at the transfer position, the toner image is transferred from the toner carrying surface TCS to the sheet of paper P. Further, since both of the toner T1 with the positive charging characteristic and the toner T2 with the negative charging characteristic are carried on the toner carrying surface, as described below, it is difficult to transfer the toner to the sheet of paper P with a conventionally known method in which a bias having an opposite polarity with respect to that of the toner is applied to the transfer roller 222. Instead, in this embodiment, a method is used in which the transfer roller 222 is pressed against the transfer drum 230 at the transfer position, and the toner on the toner carrying surface TCS is transferred to the sheet of paper P, which passes through the transfer position, by pressure.

2-2-1 Toner Transfer and Pixel Forming

FIG. 9 through FIG. 11 are figures illustrating toner transfer operations by the transfer electrodes 262*a* and the pixel electrodes 262*d* and pixel forming operations by the pixel electrodes 262*d*. Further, in each figure, suffixes from A to F show steps of elapsed time (the longer the time is spent, the greater the number becomes). Further, for the sake of clarity in these figures, at the step B or later, reference numerals are omitted as appropriate.

FIG. 9 shows a case in which pixel formation is not performed and only the transfer operations of the toner T are performed by the transfer electrodes 262*a* and the pixel electrodes 262*d*. As shown in FIG. 9, ideally, the toner T1 with the positive charging characteristic and the toner T2 with the negative charging characteristic are carried in different phases. In practice, due to the occurrence of aggregates of the toner T1 with the positive charging characteristic and the toner T2 with the negative charging characteristic, it is not always happen that on a specific transfer electrode 262*a* or on a pixel electrode 262*d*, only the toner T1 with the positive charging characteristic exists, or only the toner T2 with the negative charging characteristic exists. However, in many cases, the toner T1 with the positive charging characteristic and the toner T2 with the negative charging characteristic are separated by the application of the transfer voltages, even if there exists a toner which is charged in an opposite polarity with respect to a predetermined polarity, or there are some mixing of the above described aggregates, their ratios are low. Therefore, an ideal state as shown in FIG. 9, etc., can be assumed.

FIG. 10 and FIG. 11 show cases where pixels composed of the toner T1 with the positive charging characteristic and pixels composed of the toner T2 with the negative charging characteristic are alternatively formed. As shown in FIG. 10B and FIG. 10C, when pixels are formed with the toner T1 with the positive charging characteristic at this time, an image forming voltage (refer to FIG. 10C), which is offset in the positive polarity in comparison with the transfer voltage, and which is higher than the transfer voltage, is applied to the pixel electrodes 262*d*, at a timing when the toner T1 with the positive charging characteristic should pass through the pixel forming electrodes 262*d*. With this, the toner T1 with the positive charging characteristic flies toward the toner carrying surface TCS, and carried by the toner carrying surface TCS.

Figure 10A:
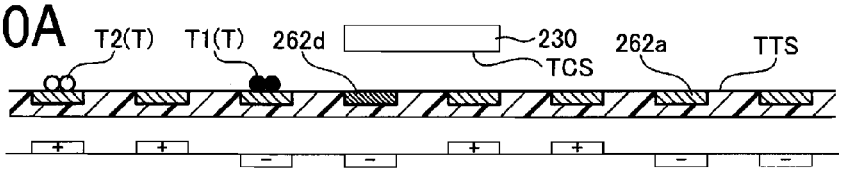
FIGS. 10A-FIG. 10F show a diagram illustrating a toner transfer operation by transfer electrodes and pixel electrodes, and a situation of a pixel forming operation by pixel electrodes (when pixels by positively charged toners and pixels by negatively charged toners are alternatively formed), shown in FIG. 8.
Figure 10B:
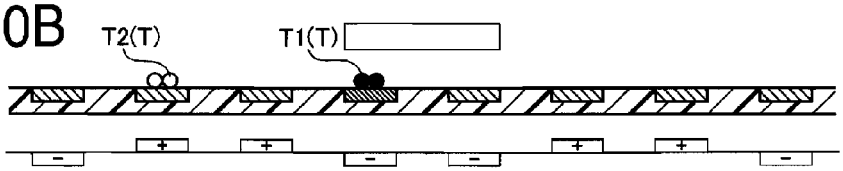
Figure 10C:
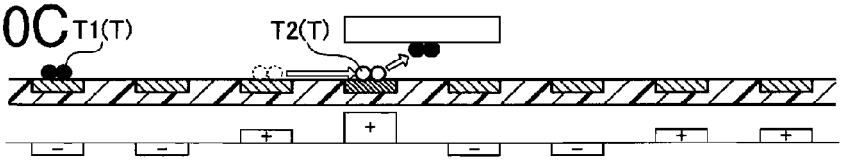
Figure 10D:
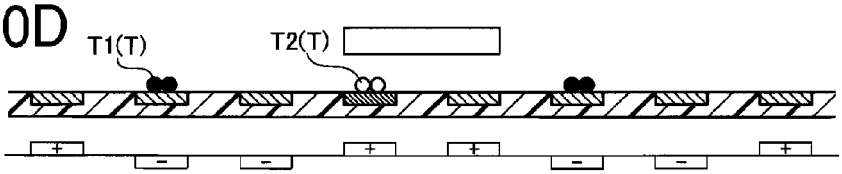
Figure 10E:
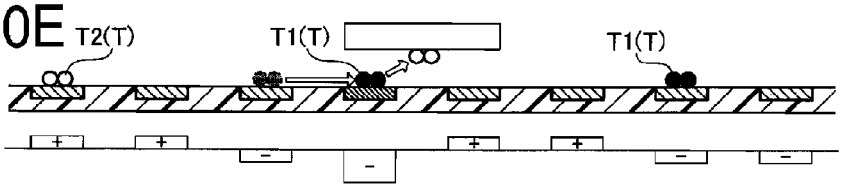
Figure 10F:
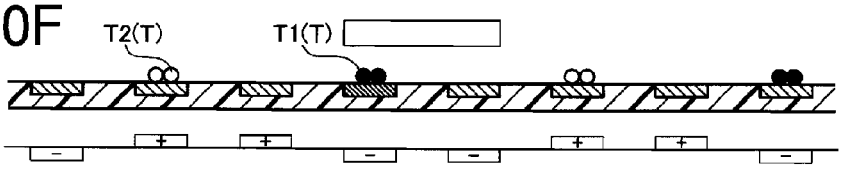
Figure 11A:
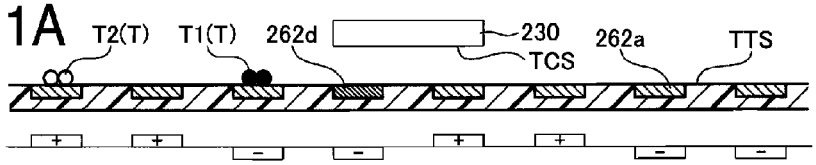
FIGS. 11A-FIG. 11F show a diagram illustrating a toner transfer operation by transfer electrodes and pixel electrodes, and a situation of a pixel forming operation by pixel electrodes (when pixels by positively charged toners and pixels by negatively charged toners are alternatively formed, and when higher density pixels than that of FIG. 10 are formed), shown in FIG. 8.
Figure 11B:
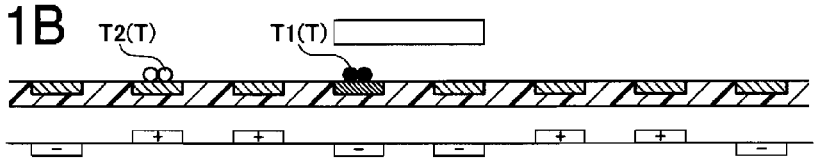
Figure 11C:
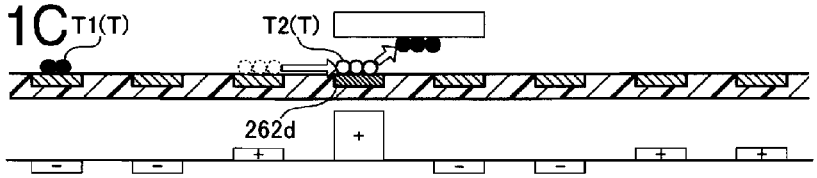
Figure 11D:
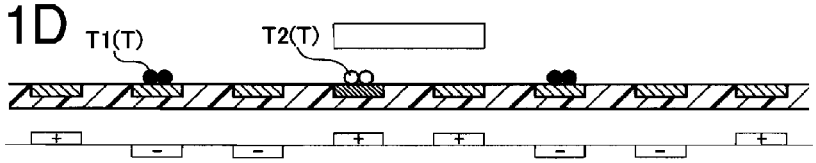
Figure 11E:
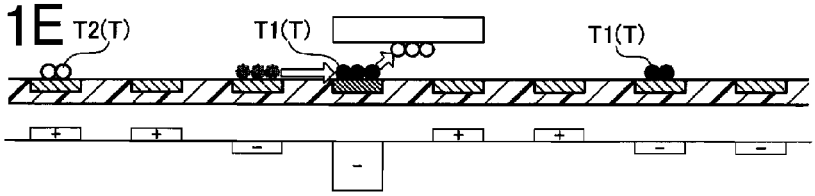
Figure 11F:
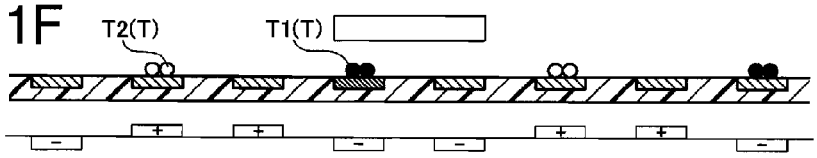

Similarly, as shown in FIG. 10D and FIG. 10E, when pixels are formed with the toner T2 with the negative charging characteristic at this time, an image forming voltage (refer to FIG. 10E), which is offset in the negative polarity in comparison with the transfer voltage, and which is higher than the transfer voltage, is applied to the pixel electrodes 262*d*. With this, the toner T2 with the negative charging characteristic flies toward the toner carrying surface TCS, and carried by the toner carrying surface TCS.

Further, with reference to FIG. 10 and FIG. 11, by controlling the magnitude of the image forming voltage, density gradation characteristics for pixels can be realized (refer to C and D in the figures). Namely, for example, by applying a higher voltage than in the case of FIG. 10, the pixels of higher density can be formed as shown in FIG. 11.

2-3 Action and Effect of Configuration According to Second Embodiment

In this embodiment, the toner T, in which the toner T1 with the positive charging characteristic and the toner T2 with negative charging characteristic are mixed, is carried in the toner transfer direction TTD by the traveling wave shaped electric fields generated by the transfer voltage. With this, occurrence of an insufficient transfer of the toner T caused by an excessive charging of the toner T or the toner transfer body 262 can be effectively suppressed. Namely, according to this embodiment, a toner T is successfully carried by traveling wave electric fields.

In this embodiment, a high pixel forming voltage corresponding to the toner T1 with the positive charging characteristic is applied to the pixel electrodes 262*d* at a timing when the toner T1 with the positive charging characteristic should pass over the pixel electrodes 262*d*. Further, a high pixel forming voltage corresponding to the toner T2 with the negative charging characteristic is applied to the pixel electrodes 262*d* at a timing when the toner T2 with the negative charging characteristic should pass over the pixel electrodes 262*d*. With this, the toner T, in which the toner T1 with the positive charging characteristic and the toner T2 with negative charging characteristic are mixed, is successfully carried by the traveling wave shaped electric fields, and an image formation with a toner T having a desired polarity (characteristic) can be successfully performed.

2-4 Modified Example

Hereinafter, some representative modified examples of the second embodiment are exemplified. In the explanations of the modified examples below, for an assembly having a similar configuration and capability, the same reference numerals are used as in the case of the second embodiment. Further, for the explanation of such an assembly, an explanation in the above second embodiment can be cited to the extent that the explanation does not technically contradict.

(1) There is no particular limitation for the basic configuration of an image forming apparatus according to the second embodiment of the present invention.

Figure 6B:
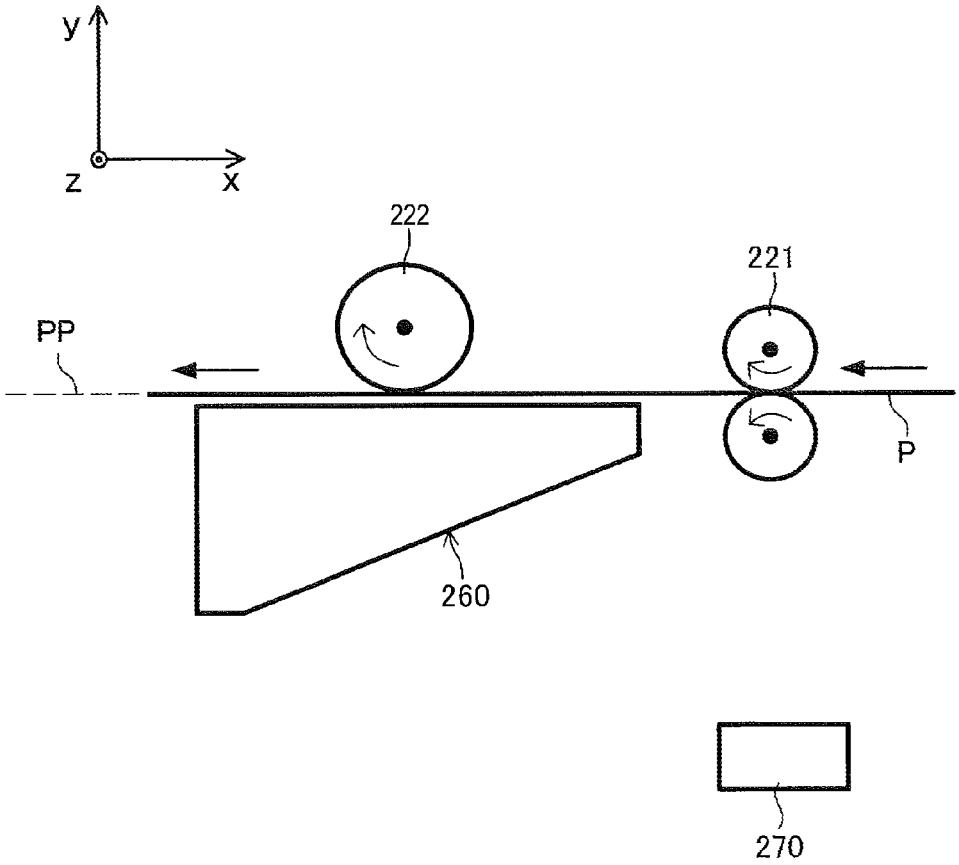
FIG. 6B is a side view illustrating a schematic configuration of a modified example of an image forming unit according to the second embodiment of the present invention.

As one of modified examples of the second embodiment, for example, a configuration can be considered in which the intermediate transfer drum 230 in the above second embodiment is omitted and the toner, which flies from the toner supply apparatus 260 by the pixel forming voltage, adheres directly to the sheet of paper P, and the toner image can be formed. Specifically, as shown in FIG. 6B, a configuration can be considered in which the pixel electrodes 262*d* of the toner supply apparatus 260 are placed in close proximity of the document transfer path PP, and a support roller is arranged to face with the pixel electrodes 262*d* through the sheet of paper P.

As another example, instead of the intermediate transfer drum 230 in FIG. 6A, a photosensitive drum can be provided. Namely, by applying pixel forming voltages to the pixel electrodes 262*d* placed at positions corresponding to a line or an image in an electrostatic latent image on the photosensitive drum (pixel forming voltages are not applied to the pixel electrodes 262*d* corresponding to no line and no image portion, namely, a white background), a covering of a white background can be suppressed well. In this case, transfer voltages and pixel forming voltages, in which an electric potential corresponding to an exposed area in the electrostatic latent image (about +50V of residual electric potential for positive charging) is used as a reference value, can be used.

(2) The present invention is not limited by the specific configurations of the devices of respective parts in the second embodiment, described above.

For example, an intermediate transfer belt can be used instead of the intermediate transfer drum 230.

Further, the pixel electrodes 262*d* can be provided at a position immediately afterward of the closest position P0 in the position where the transfer electrode 262*a* should be provided.

Further, the closest position P0 can be set at a position where the transfer electrode 262*a* or the pixel electrode 262*d* is provided.

Further, the covering layer 262*c* can be omitted. Namely, the toner transfer surface TTS is formed by a surface of the transfer electrode 262*a* and that of the pixel electrode 262*d*. In this case, it is preferable to provide a spacer portion to fill a concaved portion formed between the neighboring electrodes.

(3) A transfer voltage is not limited to be 4-phased as in the above described embodiment. For example, a transfer voltage can be a 3-phased. In this case, the plurality of transfer electrodes 262*d* is connected to the same transfer voltage applying unit per every two of them.

(4) The toner T1 with the positive charging characteristic and the toner T2 with the negative charging characteristic can have the same color or different colors.

When the toner T1 with the positive charging characteristic and the toner T2 with the negative charging characteristic have the same color, one of them can have lower density (one having a lower component ratio of the colorant) than the other one. With such a configuration, unconsidered mixture of other color in the same pixel can be prevented well (corresponding to an application of so-called a photo ink in an ink jet method), and further high qualification of image can be achieved.

(5) The present invention can be applied well to a configuration in which an image is formed only with one of the toner T1 with the positive charging characteristic or the toner T2 with the negative charging characteristic among the toners T. In this case, the one with which pixels are not formed is called a dummy toner or an electric neutralizer.

Or, the present invention can be applied well to a configuration such that after an image has been formed with one of the toner T1 with the positive charging characteristic and the toner T2 with the negative charging characteristic, an image is formed again with the other one (for example, refer to Japanese Patent Provisional Publication HEI05-19616).

(6) In addition, within the scope that does not deviate from the gist of the present invention, various other modifications can be considered.

3 Third Embodiment

Next, a third embodiment of the present invention is explained.

3-1 Overall Configuration of Laser Printer (Image Forming Apparatus)

FIG. 1 is a schematic side view showing the configuration of a laser printer 300 in accordance with the exemplary third embodiment of the present invention.

First, overall configuration of the laser printer 300 is explained with reference to FIG. 1. The laser printer 300 (image forming apparatus) includes a document transfer mechanism 320, a photosensitive drum 330 (electrostatic latent image carrying body), a charger 340, a scanner unit 350 (exposure assembly), a toner supply apparatus 360 (developer supply apparatus), and a control device 370.

In a document feeding tray, not shown in the figure, placed inside of the laser printer 300, sheets of paper P are stored in a stacked state. The document transfer mechanism 320 is configured to eject the sheet of paper P from the above described document feeding tray, and configured to be able to transfer the sheet of paper P along a predetermined document transfer path PP.

On the outer surface of the photosensitive drum 330 (electrostatic latent image carrying body, subject to supply), an electrostatic latent image carrying surface LS is provided. The electrostatic latent image carrying surface LS is formed in the shape of the cylindrical surface that is parallel to a main scanning direction (the z-axis direction in the figure).

The photosensitive drum 330 is configured such that an electrostatic latent image by a distribution of positive electric charges is formed on the electrostatic latent image carrying surface LS and the toner charged in the positive polarity in a powder form is carried at a position corresponding to the electrostatic latent image.

Further, the photosensitive drum 330 is configured to be able to be rotary driven in the direction indicated by the arrow in the figure (clockwise in FIG. 1), while the center of rotation being at the center axis C parallel to the main scanning direction. Namely, the photosensitive drum 330 is configured such that the electrostatic latent image carrying surface LS can move along a sub-scanning direction (typically, the x-axis direction in the figure) perpendicular to the main scanning direction.

The charger 340 is placed to face with the electrostatic latent image carrying surface LS. The charger 340 is a charger of Korotoron type or Sukorotoron type, and configured to be able to uniformly and positively charge the electrostatic latent image carrying surface LS prior to forming an electrostatic latent image.

The scanner unit 350 generates a laser beam LB of a predetermined band of wavelength and modulated based on image data (ON/OFF of emission of light is controlled depending on existence or non-existence of a pixel), and is configured to cause the laser beam LB to provide an image at a scan position SP in the electrostatic latent image carrying surface LS. Here, a scan position SP is provided at a position downstream of the charger 340 in the direction of the rotation of the photosensitive drum 330 (the direction indicated by the arrow in FIG. 1: clockwise in the figure).

Further, the scanner unit 350 is configured to be able to form an electrostatic latent image on the electrostatic latent image carrying surface LS by causing the position where the laser beam LB provides an image to move at a constant speed along the main scanning direction on the electrostatic latent image carrying surface LS, which is uniformly charged by the charger 340.

The toner supply apparatus 360 is placed to face with the photosensitive drum 330. The toner supply apparatus 360 is configured to be able to supply a toner in a charged state to the electrostatic latent image carrying surface LS at a developing position DP. The detailed configuration of the toner supply apparatus 360 is explained later.

The control device 370 is configured to control operations of respective units (such as a driving unit, or a voltage applying unit) included in the laser printer 300, based on input information from a user interface or from various sensors.

3-2 Configuration of Each Unit of Laser Printer

Next, a more detailed configuration of each unit of the laser printer 300 is explained.

The document transfer mechanism 320 includes a pair of resist rollers 321 and a transfer roller 322.

The resist rollers 321 are configured to be able to send out a sheet of paper P to a gap between the photosensitive drum 330 and the transfer roller 322 at a predetermined timing.

The transfer roller 322 is placed to face with the electrostatic latent image carrying surface LS through a sheet of paper P, which is an outer surface of the photosensitive drum 330, at a transfer position TP. Further, the transfer roller 322 is configured so that it can be rotary driven in the direction indicated by the arrow in the figure (counterclockwise).

Further, in this embodiment, the transfer roller 322 is connected to a bias power supply circuit, not shown in the figure. Namely, a predetermined transfer bias voltage for transferring toners (developers) adhering on the electrostatic latent image carrying surface LS is applied between the transfer roller 322 and the photosensitive drum 330.

Figure 12:
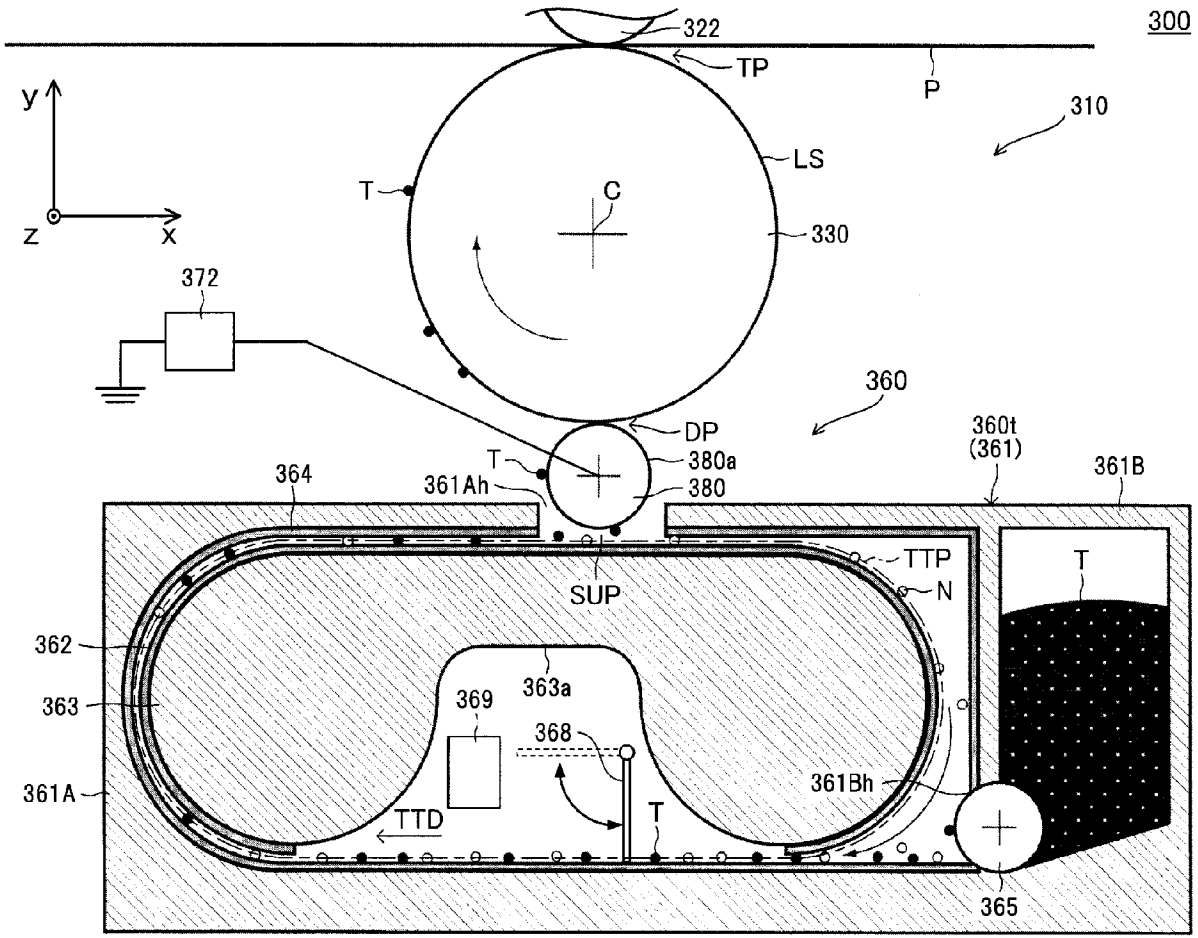
FIG. 12 is an overall cross-sectional side view (a cross-sectional view by a plane perpendicular to a main scanning direction) magnifying a toner supplying apparatus shown in FIG. 1.

FIG. 12 is a sectional side view (sectional view by a surface perpendicular to the main scanning direction) magnifying the toner supply apparatus 360 shown in FIG. 1. Hereinafter, an internal configuration of the toner supplying unit 360 is explained with reference to FIG. 12.

The toner supply apparatus 360 includes a developing roller 380 (toner transfer body). The developing roller 380 is provided to face with the photosensitive drum 330 at the developing position DP. The developing roller 380 is a substantially columnar assembly, and a toner carrying surface 380*a*, which is a peripheral surface of the developing roller 380, carries the toner T thereon. Further, in this embodiment, a black-colored toner with a positive charging characteristic and composed of a single nonmagnetic component is used as toner T.

The toner supply apparatus 360 further includes a toner transfer device 360*t*. The toner transfer device 360*t* is provided to face with the developing roller 380 at a supply position SUP. The toner transfer device 360*t* is configured as below so as to supply toner T to the toner carrying surface 380*a* in the developing roller 380 at the supply position SUP by carrying the charged toner T with traveling wave electric fields in the toner transfer direction TTD along the toner transfer path TTP which is substantially oval-shaped, in a sectional view including the supply position SUP.

Further, the toner transfer direction TTD is a tangent line direction at an arbitrary position on the toner transfer path TTP, perpendicular to the main scanning direction, and it is the direction in which the toner T actually moves, during the image forming operation.

The developing roller 380 is electrically connected to a bias applying unit 372. The bias applying unit 372 applies a bias voltage having an opposite polarity with respect to that of the toner T (the same polarity with an electric neutralizer N described later) for attracting toner T to the developing roller 380 with an electrostatic force.

3-2-2 Toner Electric Field Transfer Device

A casing 361 of the toner transfer device 360*t* is a box-shaped assembly, including a toner circulating unit 361A and a toner storing unit 361B.

The toner circulating unit 361A is provided to face with the developing roller 380 at the supply position SUP. A toner passage aperture 361Ah is provided in the toner circulating unit 361A at a position corresponding to the supply position SUP. The toner passage aperture 361Ah is a through-hole, and it is provided to let the internal space of the toner circulating unit 361A be communicated with outside of the toner supply apparatus 360.

In the toner circulating unit 361A, the above described electric neutralizer is reserved. The electric neutralizer N is a material in powder form for electrically neutralizing a toner transfer surface TTS (for suppressing charge-up of the toner transfer surface TTS) described later, and it is composed to be charged in an opposite polarity with respect to that of the toner T (namely, in the negative polarity). Specifically, the electric neutralizer N includes materials to be charged in the opposite polarity with respect to that of the toner T.

The toner storing unit 361B is provided to be adjacent with the toner circulating unit 361A. In the space inside of the toner storing unit 361B, the toner T is reserved. A toner supply aperture 361Bh is provided in the toner storing unit 361B. The toner supply aperture 361Bh is a through-hole, and it is provided to let the space inside of the toner circulating unit 361A be communicated with the space inside of the toner storing unit 361B.

In the space inside of the toner circulating unit 361A, a toner transfer body 362 is stored. The toner transfer body 362 is configured to be able to transfer the charged toner T and the electric neutralizer N, simultaneously, in the toner transfer direction TTD with the traveling wave electric fields.

Figure 13:
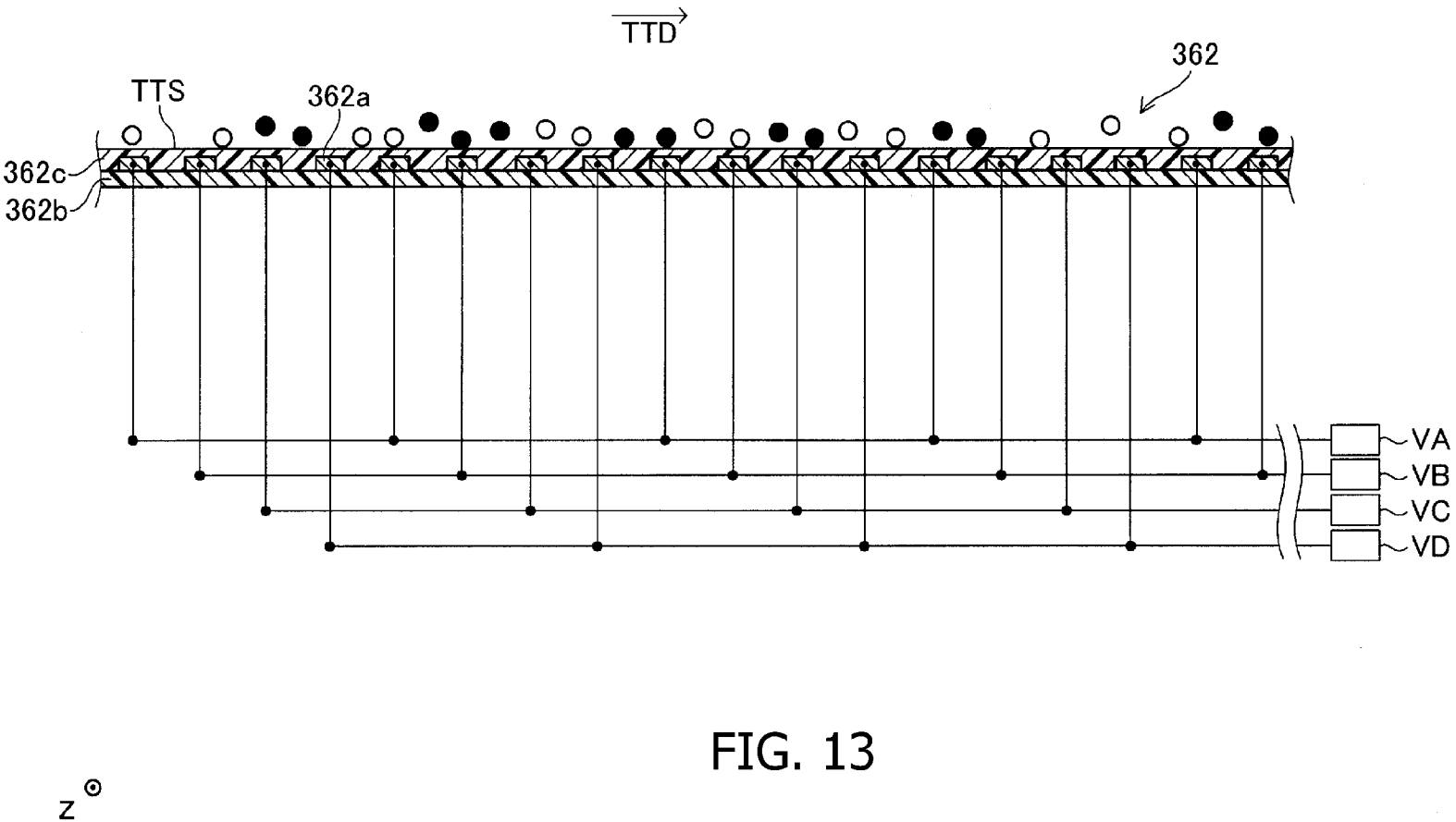
FIG. 13 is an overall cross-sectional side view magnifying a transfer electrode substrate shown in FIG. 12.

FIG. 13 is a sectional side view where the toner transfer body 362 shown in FIG. 12 is magnified. Hereinafter, with reference to FIG. 13, the toner transfer body 362 is a laminated member and has a configuration like a flexible printed circuit board.

Specifically, the toner transfer body 362 includes a plurality of transfer electrodes 362*a*. A single transfer electrode 362*a* is a linear electrode formed in parallel with the main scanning direction, and it is made of a copper foil with thickness of about dozens μm. And many more transfer electrodes 362*a* are arranged along the toner transfer path TTP (cf., FIG. 12).

Each of the many transfer electrodes 362*a* arranged along the toner transfer path TTP (cf., FIG. 12) is connected to the same power supply circuit per every three of them. Namely, the transfer electrode 362*a* connected to the power supply circuit VA, the transfer electrode 362*a* connected to the power supply circuit VB, the transfer electrode 362*a* connected to the power supply circuit VC, the transfer electrode 362*a* connected to the power supply circuit VD, the transfer electrode 362*a* connected to the power supply circuit VA, the transfer electrode 362*a* connected to the power supply circuit VB, the transfer electrode 362*a* connected to the power supply circuit VC, . . . , are arranged along the toner transfer path TTP (cf., FIG. 12) in this order.

In this embodiment, the power supply circuits from VA to VD are configured to be able to output driving voltages (transfer voltages), respectively, that are alternating-current voltages having substantially the same wave form. In addition, the power supply circuits from VA to VD are configured such that in respective wave forms of the voltages generated by the power supply circuits from VA to VD, the phases are different by 90 degrees. Namely, the phases of the voltages are retarded by 90 degrees each, in the order from the power supply circuit VA toward the power supply circuit VD (if these shifts of the phases are reversed, then the direction in which the toner T and the electric neutralizer N are transferred is reversed).

In this manner, the toner transfer body 362 is configured to be able to transfer the positively charged toner T and the negatively charged electric neutralizer N, simultaneously, along the toner transfer path TTP, through applying the above described transfer voltages to the respective transfer electrodes 362*a* and generating the traveling wave shaped electric fields along the sub-scanning direction.

The plurality of transfer electrodes 362*a* is supported on a support film 362*b*. The support film 362*b* is a flexible film-shaped member, and is made of an insulating resin such as polyimide resin.

A covering layer 362*c* is made of an insulating resin. The covering layer 362*c* is provided to cover the surface of the support film 362*b*, where the transfer electrodes 362*a* are provided, and the transfer electrodes 362*a*. Further, the above described toner transfer surface TTS is made of the surface of the covering layer 362*c*, and it is formed as a smooth surface with very few unevenness.

Referring to FIG. 12 again, the toner transfer body 362 is supported by a substrate support 363 in a reversed U shape, opening toward the opposite side of the photosensitive drum 330 (downward in the figure), in side view. In the middle part in the longitudinal direction (the direction perpendicular to the main scanning direction and the upward direction) of the substrate support 363, a concaved portion 363*a* is provided at a position corresponding to an opening in the above described reversed U shape.

On the inner wall surface in the space inside of the toner circulating unit 361A, a facing electrode substrate 364 is provided to face with the toner transfer body 362. The facing electrode substrate 364 has a configuration similar to the above described toner transfer body 362.

A toner supply unit 365 is provided at a position corresponding to the toner supply aperture 361Bh in the toner storing unit 361B. The toner supply unit 365 is a member composing a toner supply source with the toner storing unit 361B, and it is configured to supply the toner T stored in the toner storing unit 361B to the toner transfer path TTP. Specifically, the toner supply unit 365 in this embodiment is made of a roller-shaped member provided as if it blocks the toner supply aperture 361Bh, and the amount of the toner T supplied to the toner transfer path TTP is variable depending on an amount of rotation or an applied bias voltage.

In the toner circulating unit 361A, a shutter 368 and a transfer state detecting unit 369 are placed inside of the above described concaved portion 363*a*. The shutter 368 is placed upstream in the toner transfer direction TTD than the transfer state detecting unit 369. This shutter 368 enables the transfer state detecting unit 369 to face with the surface of the toner transfer body 362 (the toner transfer surface TTS in FIG. 13) where the toner T and the electric neutralizer N are removed, by shutting off the transfer of the toner T and the electric neutralizer N, temporarily.

The transfer state detecting unit 369 is arranged to face with the toner transfer path TTP. The transfer state detecting unit 369 generates an output depending on the existence ratio of the toner T and the electric neutralizer N transferred on the toner transfer path TTP. Specifically, in this embodiment, the transfer state detecting unit 369 is a surface electric potential sensor, and it is configured and arranged to detect the surface electric potential (charge-up state) of the toner transfer body 362 corresponding to the above described existence ratio.

And, the toner supply apparatus 360 derives the toner supply unit 365 depending on the output of the transfer state detecting unit 369, under control of the controlling device 370.

3-3 Operation of Laser Printer of Third Embodiment

Hereinafter, an outline of an operation of the laser printer 300, configured as described above, is explained with reference to each figure, as appropriate.

3-3-1 Image Formation

With reference to FIG. 1, a tip of a sheet of paper P loaded on the document feeding tray, described above and not shown in the figure, is sent to the resist roller 321. At the resist roller 321, a skew of the sheet of paper P is corrected, and the transfer timing is adjusted. After that, the sheet of paper P is transferred to a transfer position TP.

While the sheet of paper P is transferred to the transfer position TP, as below, an image by the toner T is carried on the electrostatic latent image carrying surface LS, which is the outer surface of the photosensitive drum 330.

Firstly, the electrostatic latent image carrying surface LS of the photosensitive drum 330 is uniformly charged in the positive polarity by the charger 340.

The electrostatic latent image carrying surface LS which is uniformly charged by the charger 340 moves to the scan position SP where it faces with (exposed to) the scanner unit 350, by the rotation of the photosensitive drum 330 in the direction (clockwise) indicated by the arrow in the figure.

At this scan position SP, a laser beam LB, which is modulated based on image information, is irradiated on the electrostatic latent image carrying surface LS, while it is scanned in the main scanning direction. Depending on the modulated state of the laser beam LB, some portions are created, on which positive charges are vanished, on the electrostatic latent image carrying surface LS. With this, an electrostatic latent image by patterns of positive charges (image-shaped distribution) is formed on the electrostatic latent image carrying surface LS.

The electrostatic latent image formed on the electrostatic latent image carrying surface LS moves toward the developing position DP where it faces with the developing roller 380 (cf., FIG. 12) in the toner supply apparatus 360, by the rotation of the photosensitive drum 330 in the direction indicated by the arrow (clockwise) in the figure.

In this manner, a positively charged toner T (cf., FIG. 12) is supplied by the toner supply apparatus 360 to a portion of the electrostatic latent image carrying surface LS, which reaches to the developing position DP and on which an electrostatic latent image is formed. Then, the toner T adheres to the portions on the electrostatic latent image, where positive charges are vanished, on the electrostatic latent image carrying surface LS. Namely, the electrostatic latent image formed on the electrostatic latent image carrying surface LS is developed with the toner T. With this, an image by the toner T (hereinafter, referred to as "toner image") is carried on the electrostatic latent image carrying surface LS.

The toner image carried on the electrostatic latent image carrying surface LS of the photosensitive drum 330 as described above is transferred toward the transfer position TP as the electrostatic latent image carrying surface LS rotates in the direction indicated by the arrow (clockwise) in the figure. And, at this transfer position TP, the toner image is transferred from the electrostatic latent image carrying surface LS to the sheet of paper P.

3-3-2 Transfer Control of Toner and Electric Neutralizer

As the above described predetermined multiphase alternate current voltages are applied to the toner transfer body 362 and the facing electrode substrate 364, the toner T and the electric neutralizer N are simultaneously transferred in the toner transfer direction along the toner transfer path TTP.

Here, during the image forming operation, the toner T moves from the toner transfer path TTP to the side of the developing roller 380, little by little, by the above described bias voltage through the bias applying unit 372. On the other hand, the electric neutralizer does not move to the side of the developing roller 380 by the above described bias voltage through the bias applying unit 372, and keeps on circulating on the toner transfer path TTP.

Here, as described above, the existence ratio of the toner T and the electric neutralizer N transferred on the toner transfer path TTP varies, as the toner T moves to the side of the developing roller 380 during the image forming operation. A charge-up occurs on the surface of the toner carriage body 362, when this existence ratio deviates from the predetermined ratio greatly. A defect of image formation occurs, when the amount of the toner T is short.

Thus, in this embodiment, the surface electric potential (charge-up state) of the toner transfer body 362 is detected by the transfer state detecting unit 369, and depending on the detection result, the toner supply unit 365 is driven. With this, the existence ratio of the toner T and the electric neutralizer N on the toner transfer path TTP is maintained close to a predetermined ratio, successfully and stably. Therefore, according to the configuration of this embodiment, a successful image forming operation is stably performed.

3-4 Modified Examples

Hereinafter, some representative modified examples of the third embodiment are exemplified. In the explanations of the modified examples below, for an assembly having a similar configuration and capability as explained in the third embodiment described above, the same reference numerals are used as in the case of the above described embodiment. Further, for the explanation of such an assembly, an explanation in the above described embodiment can be cited to the extent that the explanation does not technically contradict.

3-4-1 Modified Example 1

In the third embodiment explained above, a mechanism is adopted in which developing is performed through adhering the toner to the electrostatic latent image formed on the photosensitive drum 330, by using the photosensitive drum 330. However, the present invention is not limited to an application to an electrophotographic method using a photosensitive drum. For example, the present invention can be applied to another image formation method where a toner image is formed using static electricity, such as an image formation method of the second embodiment where pixel electrodes and an intermediate transfer drum are used.

Figure 16:
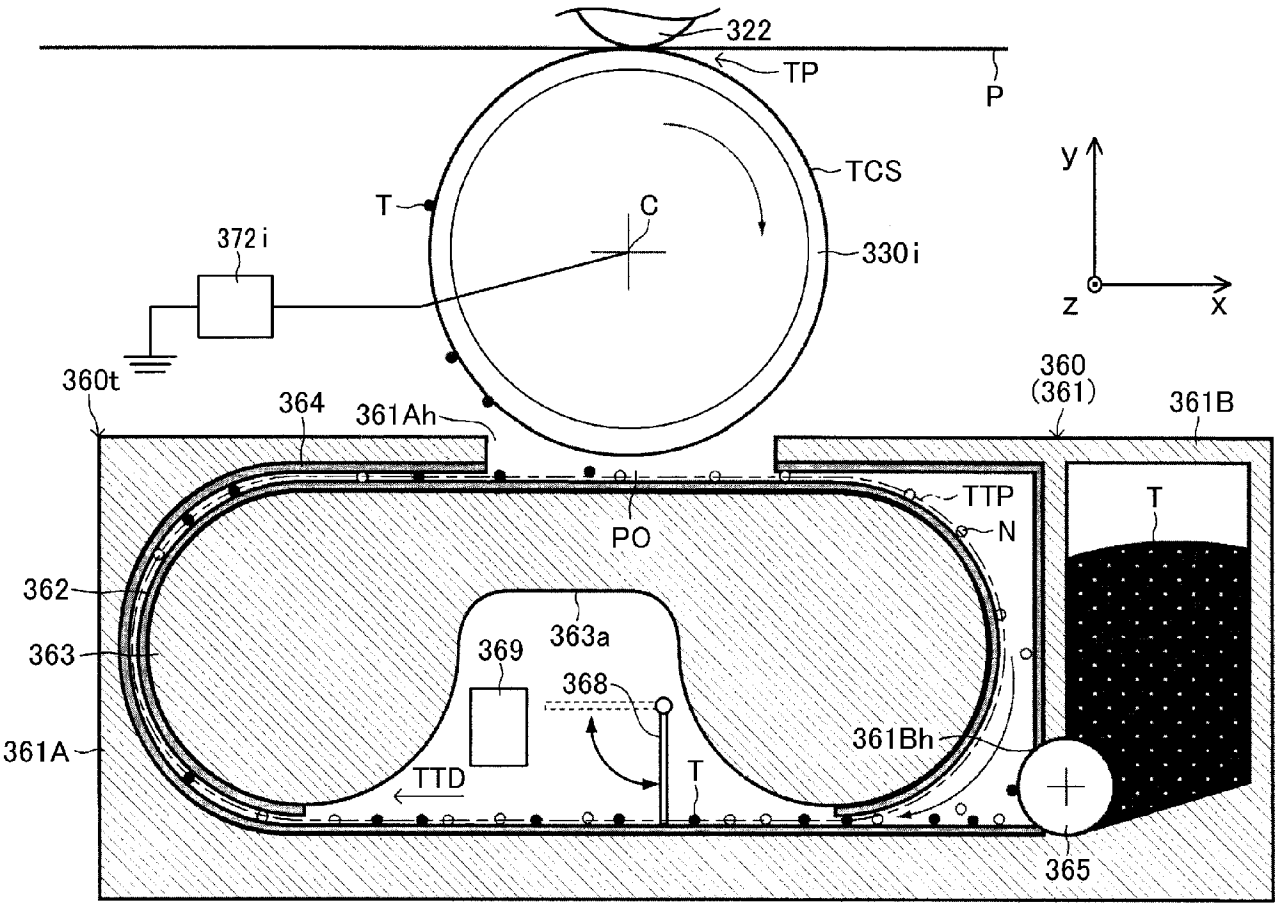
FIG. 16 is a diagram illustrating a schematic configuration of modified example 1 according to a third embodiment of the present invention.
Figure 17:
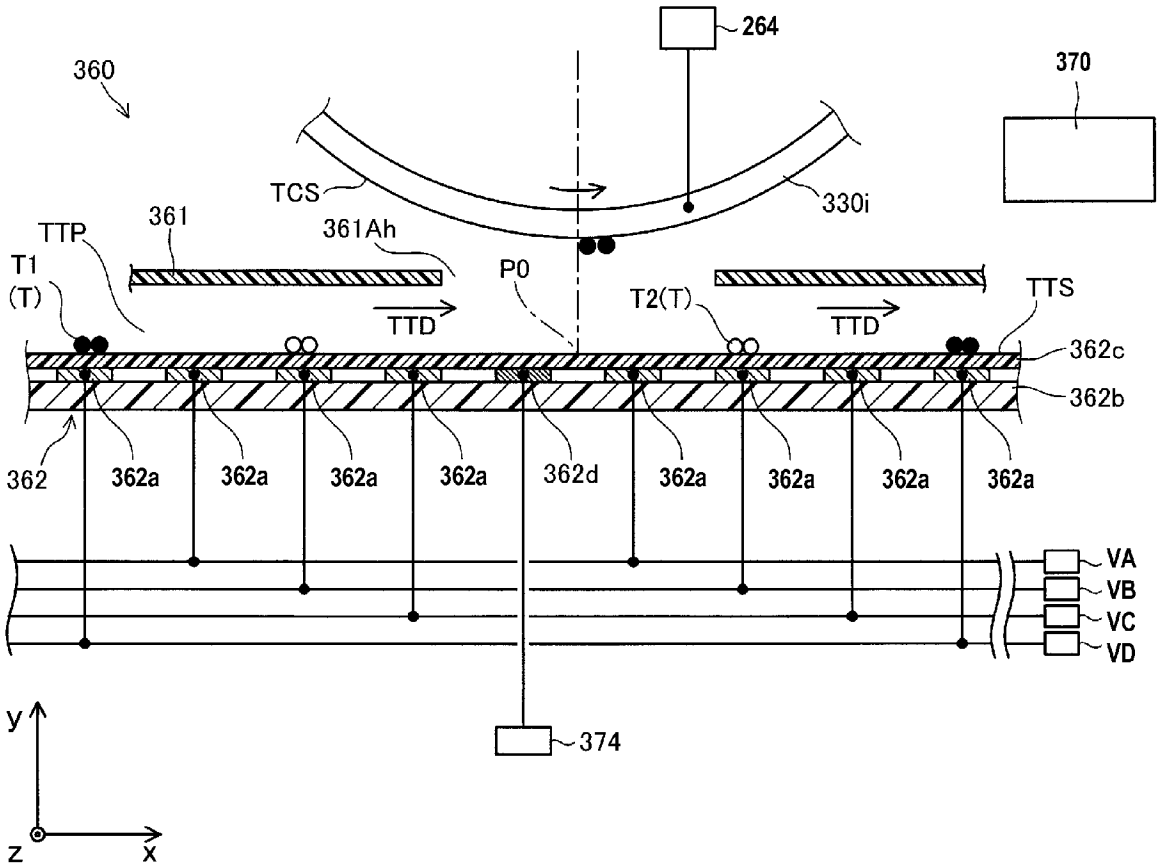
FIG. 17 is an outline cross-sectional side view magnifying a portion where a toner transfer body and an intermediate transfer drum are facing, shown in FIG. 16.

The modified example 1 explained below is an example in which a configuration of the third embodiment of the present invention is applied to an image formation method using pixel electrodes and an intermediate transfer drum. FIG. 16 is a schematic diagram magnifying a neighborhood of the toner supply apparatus 360 in a laser printer according to the modified example 1 of the third embodiment. In addition, FIG. 17 is a schematic diagram magnifying a neighborhood of the toner supply position SUP of the toner supply apparatus 360 in the modified example 1 (in other words, the closest position P0 of the intermediate transfer drum 330 and the toner transfer body 362).

In the modified example 1, instead of the photosensitive drum 330 of the third embodiment, an intermediate drum 330*i* is arranged. Further, the toner supply apparatus 360 of the modified example 1 does not include the developing roller 380. Further, a part of the transfer electrodes 362*a* of the toner transfer body 362 placed at the closest position P0 are configured to function as the pixel electrodes 362*d*. Further, in the modified example 1, a toner with opposite charging characteristic, which becomes the same series of color as the color of the toner T by adding a colorant to the electric neutralizer, is used. Specifically, in the modified example 1, a developer is composed of a toner T1 with a positive charging characteristic which is charged in the positive polarity through agitation of the developer and a toner T2 with a negative charging characteristic which is charged in the negative polarity through agitation of the developer. Further, the intermediate transfer drum 330*i* is electrically connected to a developing bias applying unit 372*i*, and a predetermined voltage is applied. Further, in the toner supply apparatus 360, a toner having an electric charging characteristic used for developing is stored. A detailed explanation is omitted, since the configuration of the modified example is the same as that of the above described third embodiment, except for the above described points. Further, a configuration and an operation regarding pixel formation (namely, a developing bias voltage applied to the intermediate transfer drum 330*i*, and an operation to form an image on the toner carrying surface TCS of the intermediate transfer drum 330*i* with the values and the timing of the pixel forming voltages applied to the pixel electrodes 362*d*) are the same as that of the second embodiment.

3-4-2 Other Modified Examples

Next, some effective modified examples are exemplified.

(1) Subject of the present invention is not limited to monochrome laser printers. For example, the present invention can be preferably applied to so-called electrophotographic image forming apparatuses such as a color laser printer or monochrome and color copiers.

In this case, it is not required that a photoreceptor is drum-shaped as in the above described embodiments. For example, it can be shaped like a flat plate or an endless belt. Further, as an exposing source, exposing sources other than a laser scanner (LED, EL (electroluminescence) element, phosphor, etc) can be used preferably.

When the present invention is configured to be able to form a multicolored (full color, for example) image, a plurality of transfer rollers 322, photosensitive drums 330, chargers 340, scanner units 350, and toner supply apparatuses are arranged along the document transfer path PP.

Or, the present invention can be preferably applied to an image forming apparatus using a method other than the above described electrophotographic method (for example a toner jet method without using a photoreceptor, an ion-flow method, or a multi-stylus electrode method).

(2) A configuration of an element of the present invention is not limited to concrete examples shown in the above described embodiments. For example, the following configurations can be considered. However, it is needless to say that these are within the technical scope of the present invention.

For example, in the toner storing unit 361B, a suitable means for agitating the toner T stored therein (a moving vane or an oscillator) can be provided.

Figure 14:
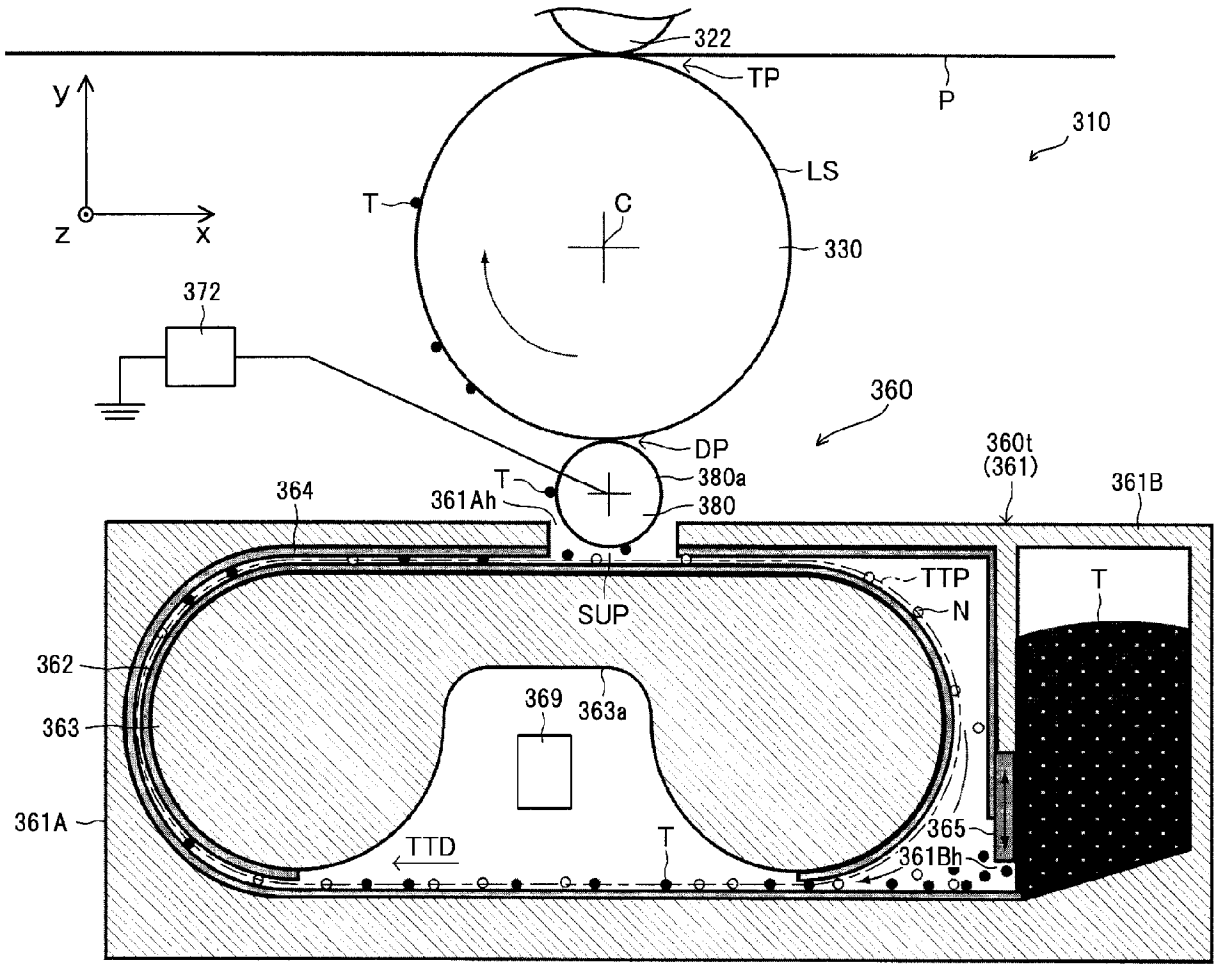
FIG. 14 is a cross-sectional side view illustrating a schematic configuration of a modified example of a toner supply apparatus shown in FIG. 12.

FIG. 14 is a side sectional view illustrating the configuration of an modified example of the toner supply apparatus 360 shown in FIG. 12. As shown in FIG. 14, the toner supply unit 365 can be a shutter.

In addition, as shown in FIG. 14, as for the transfer state detecting unit 369, an optical sensor can be used instead of the surface electric potential sensor. In this case, the shutter 368 shown in FIG. 12 is omitted. Namely, the transfer state of the toner T or the electric neutralizer N during image forming operation can be detected in real time, by the transfer state detecting unit 369 including the optical sensor.

Figure 15:
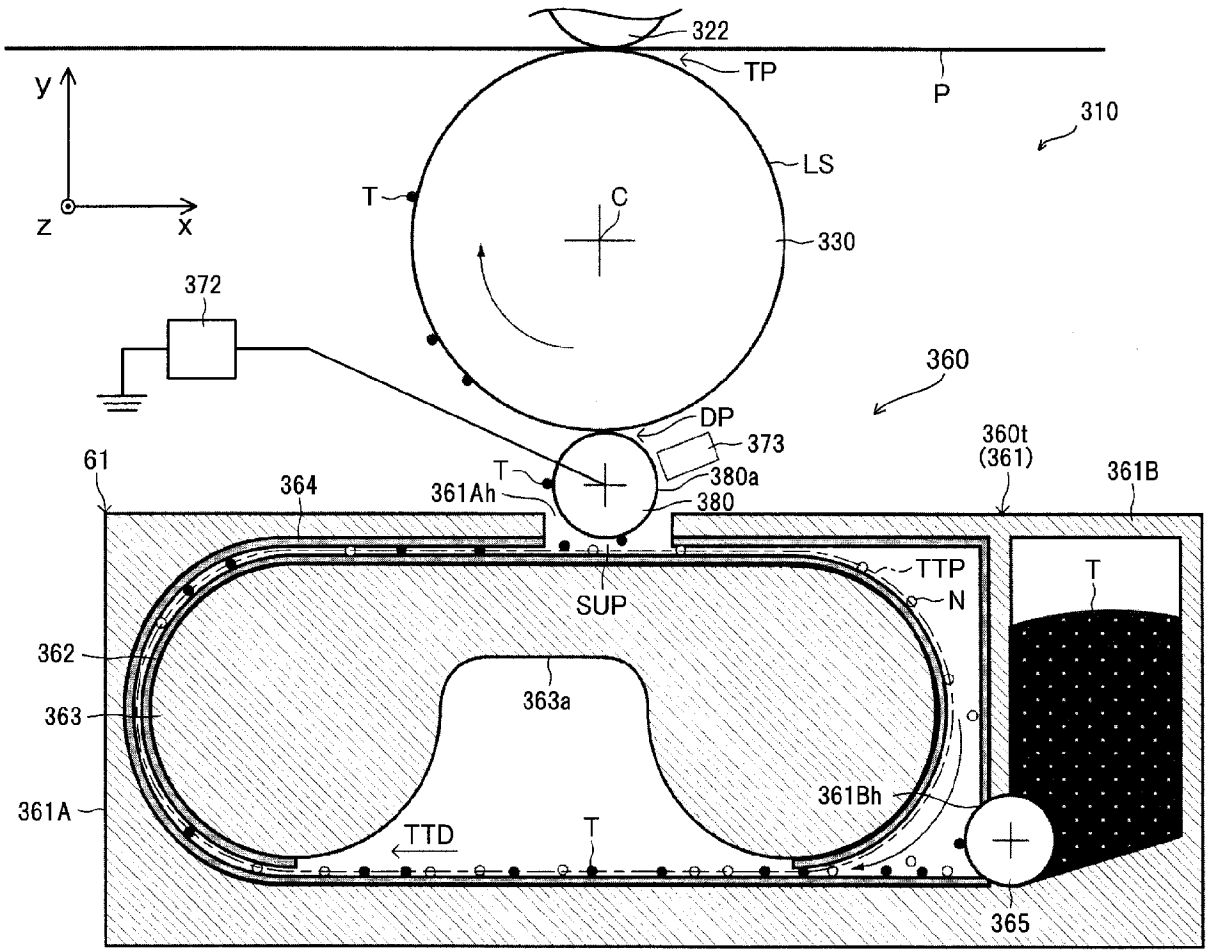
FIG. 15 is a cross-sectional side view illustrating a schematic configuration of another modified example of a toner supply apparatus shown in FIG. 12.

Further, as shown in FIG. 15, instead of the transfer state detection unit 369 placed to face with the toner transfer path TTP (toner transfer surface TTS: cf., FIG. 13), a toner carrying amount sensor 373 provided to face with the developing roller 380 can be used. The toner carrying amount sensor 373 can include an optical sensor or a surface electric potential sensor, for example. Since a transfer state of the toner T in the toner transfer path TTP is reflected as an amount of the toner T carried on the toner carrying surface 380*a* in the developing roller 380, the toner carrying amount sensor 373 can function as a transfer state detecting unit.

(3) In addition, within the scope that does not deviate from the gist of the present invention, various other modifications can be considered.

4 Fourth Embodiment

Next, the fourth embodiment of the present invention is explained.

4-1 Overall Configuration of Laser Printer (Image Forming Apparatus)

FIG. 1 is a side view showing the overall configuration of the laser printer 400 in accordance with the fourth embodiment of the present invention.

First, overall configuration of the laser printer 400 is explained with reference to FIG. 1. The laser printer 400 (image forming apparatus) includes a document transfer mechanism 420, a photosensitive drum 430 (subject to supply, electrostatic latent image carrying body), a charger 440, a scanner unit 450 (exposure assembly), a toner supply apparatus 460 (developer supply apparatus), and a control device 470.

In a document feeding tray, not shown in the figure, placed inside of the laser printer 400, sheets of paper P are stored in a stacked state. The document transfer mechanism 420 is configured to eject the sheet of paper P from the above described document feeding tray, and configured to be able to transfer the sheet of paper P along a predetermined document transfer path PP.

On the outer surface of the photosensitive drum 430 (electrostatic latent image carrying body, subject to supply), an electrostatic latent image carrying surface LS is provided. The electrostatic latent image carrying surface LS is formed in the shape of the cylindrical surface that is parallel to a main scanning direction (the z-axis direction in the figure).

The photosensitive drum 430 is configured such that an electrostatic latent image by a distribution of positive electric charges is formed on the electrostatic latent image carrying surface LS and toners charged in the positive polarity in a powder form are carried at a position corresponding to the electrostatic latent image.

Further, the photosensitive drum 430 is configured to be able to be rotary driven in the direction indicated by the arrow in the figure (clockwise in FIG. 1), while the center of rotation being the center axis C parallel to the main scanning direction. Namely, the photosensitive drum 430 is configured such that the electrostatic latent image carrying surface LS can move along a sub-scanning direction (typically, the x-axis direction in the figure) perpendicular to the main scanning direction.

The charger 440 is placed to face with the electrostatic latent image carrying surface LS. The charger 440 is a charger of Korotoron type or Sukorotoron type, and configured to be able to uniformly and positively charge the electrostatic latent image carrying surface LS prior to forming an electrostatic latent image.

The scanner unit 450 generates a laser beam LB of a predetermined band of wavelength and modulated based on image data (ON/OFF of emission of light is controlled depending on existence or non-existence of a pixel), and is configured to cause the laser beam LB to provide an image at a scan position SP in the electrostatic latent image carrying surface LS. Here, a scan position SP is provided at a position downstream of the charger 440 in the direction of the rotation of the photosensitive drum 430 (the direction indicated by the arrow in FIG. 1: clockwise in the figure).

Further, the scanner unit 450 (exposure assembly) is configured to be able to form an electrostatic latent image of the electrostatic latent image carrying surface LS by causing the position where the laser beam LB provides an image to move at a constant speed along the main scanning direction on the electrostatic latent image carrying surface LS, which is uniformly charged by the charger 440.

The toner supply apparatus 460 is placed to face with the photosensitive drum 430. The toner supply apparatus 460 is configured to be able to supply toners in a charged state to the electrostatic latent image carrying surface LS at a developing position DP. The detailed configuration of the toner supply apparatus 460 is explained later.

The control device 470 is configured to control operations of respective units (such as a driving unit, or a voltage applying unit) included in the laser printer 400, based on input information from a user interface or from various sensors.

4-2 Configuration of Each Unit of Laser Printer

Next, a more detailed configuration of each unit of the laser printer 400 is explained.

The document transfer mechanism 420 includes a pair of resist rollers 421 and a transfer roller 422.

The resist rollers 421 are configured to be able to send out a sheet of paper P to a gap between the photosensitive drum 430 and the transfer roller 422 at a predetermined timing.

The transfer roller 422 is placed to face with the electrostatic latent image carrying surface LS through a sheet of paper P, which is an outer surface of the photosensitive drum 430, at a transfer position TP. Further, the transfer roller 422 is configured so that it can be rotary driven in the direction indicated by the arrow in the figure (counterclockwise).

Further, in this embodiment, the transfer roller 422 is connected to a bias power supply circuit, not shown in the figure. Namely, a predetermined transfer bias voltage for transferring toners (developers) adhering on the electrostatic latent image carrying surface LS is applied between the transfer roller 422 and the photosensitive drum 430.

4-2-1 Toner Supply Apparatus

Figure 18:
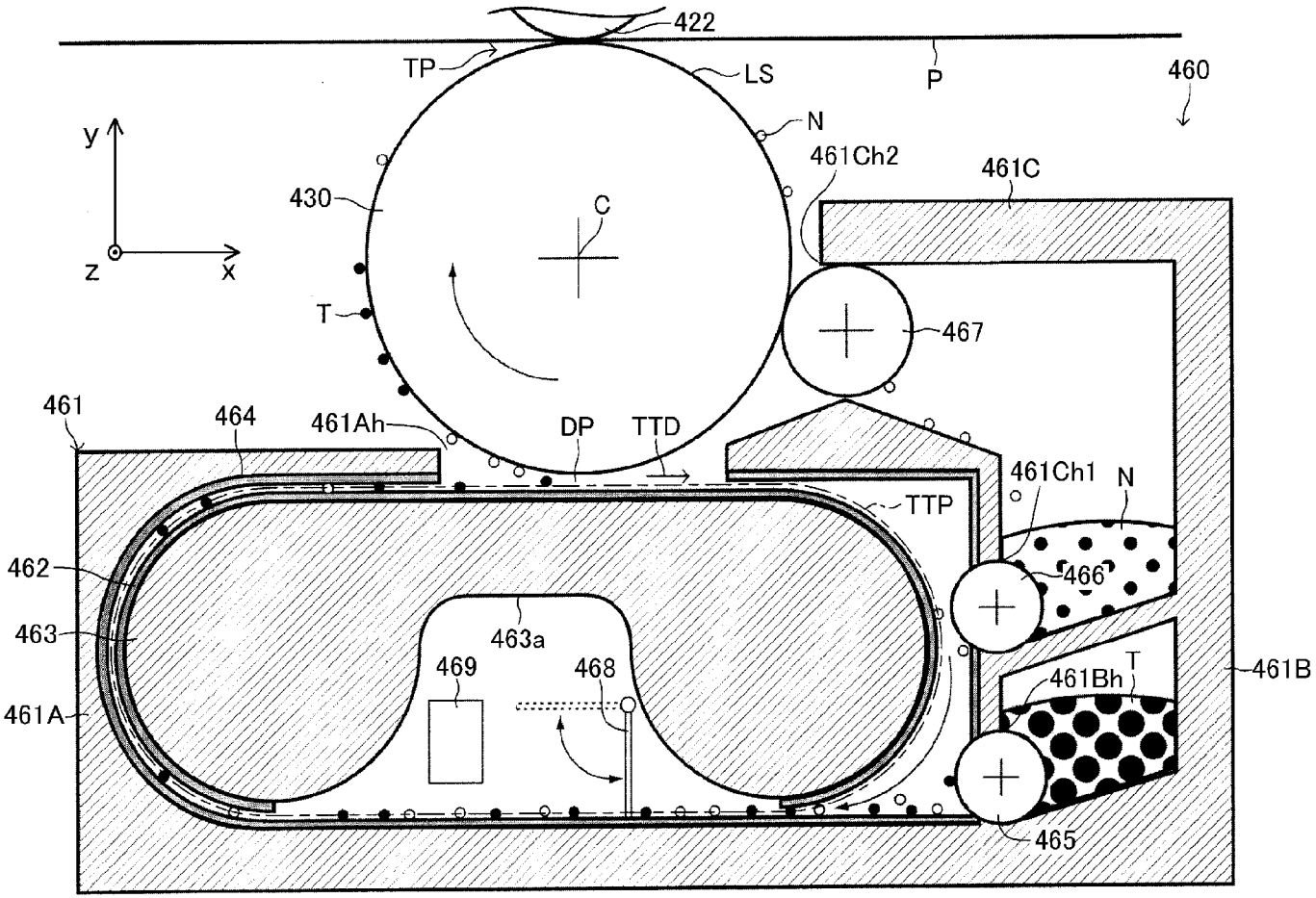
FIG. 18 is a cross-sectional side view (a cross-sectional view by a plane perpendicular to a main scanning direction) magnifying a toner supply apparatus shown in FIG. 1.

FIG. 18 is a sectional side view (sectional view by a surface perpendicular to the main scanning direction) magnifying the toner supply apparatus 460 shown in FIG. 1. Hereinafter, an internal configuration of the toner supplying unit 460 is explained with reference to FIG. 18.

The toner transfer device 460 is configured as below so as to supply toner T to the electrostatic latent image carrying surface LS in the photosensitive drum 430 at the developing position DP by carrying the charged toner T with traveling wave electric fields in the toner transfer direction TTD along the toner transfer path TTP which is substantially oval-shaped, in sectional view including the developing position DP.

Further, in this embodiment, a black-colored toner with a positive charging characteristic and composed of a single nonmagnetic component is used as toner T. In addition, the toner transfer direction TTD is a tangent line direction at an arbitrary position on the toner transfer path TTP perpendicular to the main scanning direction, and it is the direction in which the toner T actually moves, during the image forming operation.

With reference to FIG. 18, a casing 461 of the toner supply apparatus 460 is a box-shaped assembly, including a toner circulating unit 461A, a toner storing unit 461B, and an electric neutralizer storing unit 461C.

The toner circulating unit 461A is provided to face with the photosensitive drum 430 at the developing position DP. A toner passage aperture 461Ah is provided in the toner circulating unit 461A at a position corresponding to the developing position DP. The toner passage aperture 461Ah is a through-hole, and it is provided to let the internal space of the toner circulating unit 461A be communicated with outside of the toner supply apparatus 460.

The toner storing unit 461B is provided to be adjacent with the toner circulating unit 461A. In the space inside of the toner storing unit 461B, the toner T is reserved. A toner supply aperture 461Bh is provided in the toner storing unit 461B. The toner supply aperture 461Bh is a through-hole, and it is provided to let the space inside of the toner circulating unit 461A be communicated with the space inside of the toner storing unit 461B.

The electric neutralizer storing unit 461C is provided to be adjacent with the toner circulating unit 461A and with the photosensitive drum 430. In the bottom part of the space inside the electric neutralizer storing unit 461, the electric neutralizer N in powder form is reserved. The electric neutralizer N is a material in powder form for electrically neutralizing a toner transfer surface TTS (for suppressing charge-up of the toner transfer surface TTS) described later, and it is composed to be charged in an opposite polarity with respect to that of the toner T (namely, in the negative polarity). Specifically, the electric neutralizer N includes materials to be charged in the opposite polarity with respect to that of the toner T.

An electric neutralizer supply aperture 461Ch1 and an electric neutralizer collect aperture 461Ch2 are provided in the electric neutralizer storing unit 461C. The electric neutralizer supply aperture 461Ch1 is a through-hole, and it is provided to let the space inside of the toner circulating unit 461A be communicated with the space inside of the electric neutralizer storing unit 461C (a portion where the electric neutralizer N is reserved). The electric neutralizer collect aperture 461Ch2 is a through-hole, and it is provided to face with the photosensitive drum 430 above the electric neutralizer supply aperture 461Ch1 and the toner circulating unit 461A. Namely, the electric neutralizer collect aperture 461Ch2 is formed such that it allows the electric neutralizer collected from a portion of the electrostatic latent image carrying body LS, which has gone through the transfer position TP, pass through itself, and to reach to the bottom part of the space inside the electric neutralizer storing unit 461C, where the electric neutralizer N is reserved, through the effect of the gravity.

In the space inside of the toner circulating unit 461A, a toner transfer body 462 (toner transfer assembly) is stored. The toner transfer body 462 is configured to be able to transfer the charged toner T and the electric neutralizer N simultaneously in the toner transfer direction TTD with the traveling wave electric fields.

Figure 19:
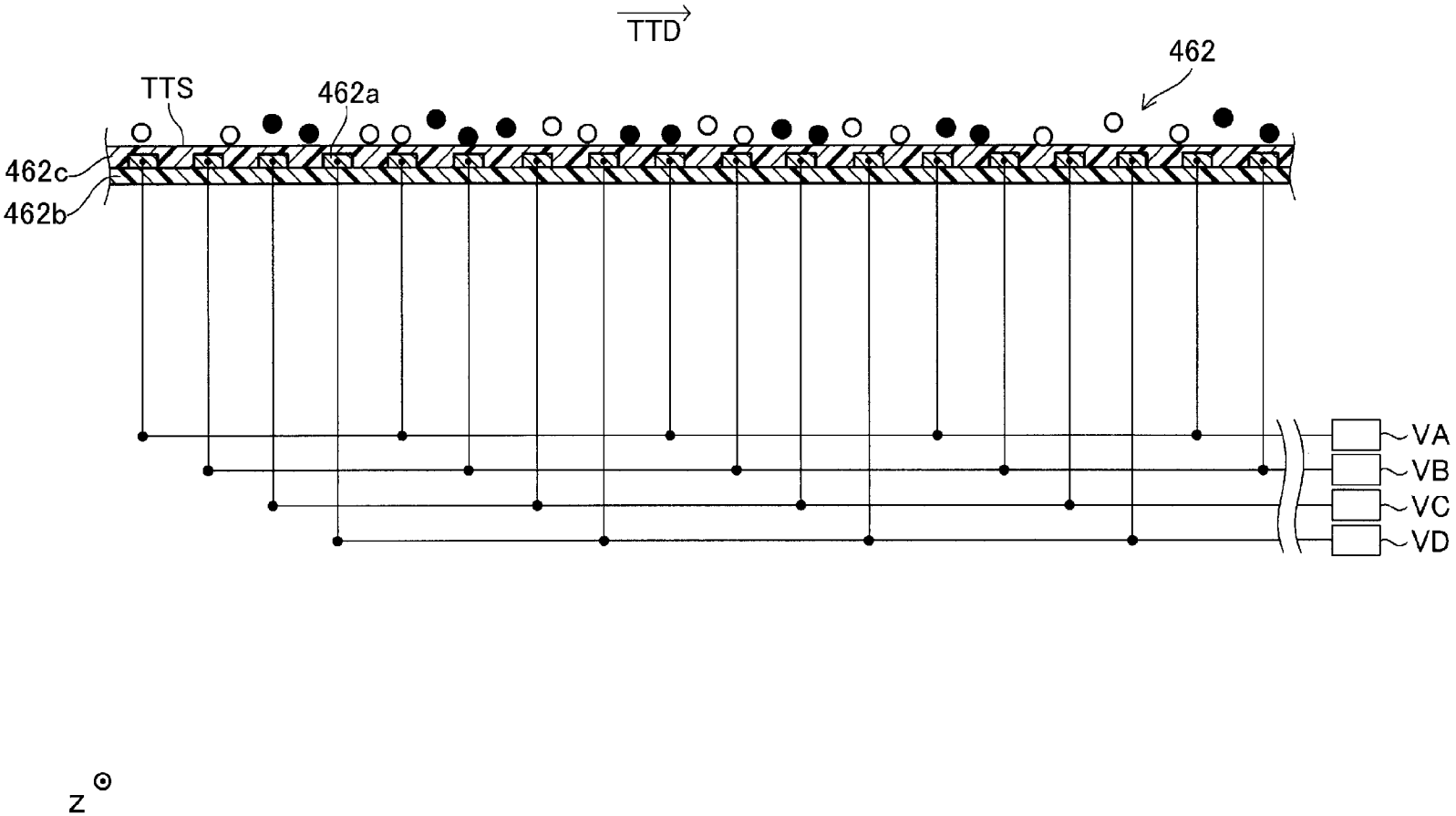
FIG. 19 is a cross-sectional side view magnifying a transfer electrode substrate shown in FIG. 18.

FIG. 19 is a sectional side view where the toner transfer body 462 shown in FIG. 18 is magnified. Hereinafter, with reference to FIG. 19, the toner transfer body 462 is a laminated member and has a configuration like a flexible printed circuit board.

Specifically, the toner transfer body 462 includes a plurality of transfer electrodes 462*a*. A single transfer electrode 462*a* is a linear electrode formed in parallel with the main scanning direction, and it is made of a copper foil with thickness of about dozens μm. And many more transfer electrodes 462*a* are arranged along the toner transfer path TTP (cf., FIG. 18).

Each of the many transfer electrodes 462*a* arranged along the toner transfer path TTP (cf., FIG. 18) is connected to the same power supply circuit per every three of them. Namely, the transfer electrode 462*a* connected to the power supply circuit VA, the transfer electrode 462*a* connected to the power supply circuit VB, the transfer electrode 462*a* connected to the power supply circuit VC, the transfer electrode 462*a* connected to the power supply circuit VD, the transfer electrode 462*a* connected to the power supply circuit VA, the transfer electrode 462*a* connected to the power supply circuit VB, the transfer electrode 462*a* connected to the power supply circuit VC, . . . , are arranged along the toner transfer path TTP (cf., FIG. 18).

In this embodiment, the respective power supply circuits from VA to VD are configured to be able to output driving voltages (transfer voltages) that are alternating-current voltages having substantially the same wave form. In addition, the power supply circuits from VA to VD are configured such that in respective wave forms of the voltages generated by the power supply circuits from VA to VD, the phases are different by 90 degrees. Namely, the phases of the voltages are retarded by 90 degrees each, in the order from the power supply circuit VA toward the power supply circuit VD (if these shifts of the phases are reversed, then the direction in which the toner T and the electric neutralizer N are transferred is reversed).

In this manner, the toner transfer body 462 is configured to be able to transfer the positively charged toner T and the negatively charged electric neutralizer N, simultaneously, along the toner transfer path TTP, through applying the above described transfer voltages to respective transfer electrodes

462*a* and generating the traveling wave shaped electric fields along the sub-scanning direction.

The plurality of transfer electrodes 462*a* is supported on a support film 462*b*. The support film 462*b* is a flexible film-shaped member, and is made of an insulating resin such as polyimide resin.

A covering layer 462*c* is made of an insulating resin. The covering layer 462*c* is provided to cover the surface in the support film 462*b* where the transfer electrodes 462*a* are provided and the transfer electrodes 462*a*. Further, the above described toner transfer surface TTS is made of the surface of the covering layer 462*c*, and it is formed as a smooth surface with very few unevenness.

Referring to FIG. 18 again, the toner transfer body 463 is supported by a substrate support 463 in a reversed U shape, opening toward the opposite side of the photosensitive drum 430 (downward in the figure), in side view. In the middle part in the longitudinal direction (the direction perpendicular to the main scanning direction and the upward direction) of the substrate support 463, a concaved portion 463*a* is provided at a position corresponding to opening in the above described reversed U shape.

On the inner wall surface in the space inside of the toner circulating unit 461A, a facing electrode substrate 464 is provided to face with the toner transfer body 462. The facing electrode substrate 464 has a configuration similar to the above described toner transfer body 462.

A toner supply unit 465 is provided at a position corresponding to the toner supply aperture 461Bh in the toner storing unit 461B. The toner supply unit 465 is a member composing a toner supply source with the toner storing unit 461B, and it is configured to supply the toner T stored in the toner storing unit 461B to the toner transfer path TTP. Specifically, the toner supply unit 465 in this embodiment is made of a roller-shaped member provided as if it blocks the toner supply aperture 461Bh, and the amount of the toner T supplied to the toner transfer path TTP is variable depending on an amount of rotation or an applied bias voltage.

An electric neutralizer supply unit 466 is provided at a position corresponding to the electric neutralizer supply aperture 461Ch1 in the electric neutralizer storing unit 461C. The electric neutralizer supply unit 466 is a member composing an electric neutralizer supply source with the electric neutralizer storing unit 461C, and it is configured to supply the electric neutralizer N stored in the electric neutralizer storing unit 461C to the toner transfer path TTP. Specifically, the electric neutralizer supply unit 466 in this embodiment is made of a roller-shaped member provided as if it blocks the electric neutralizer supply aperture 461Ch1, and the amount of the electric neutralizer N supplied to the toner transfer path TTP is variable depending on an amount of rotation or an applied bias voltage.

An electric neutralizer collect unit 467 is provided at a position corresponding to the electric neutralizer collect aperture 461Ch2 in the electric neutralizer storing unit 461C. The electric neutralizer collect unit 467 collects the electric neutralizer N adhering on the electrostatic latent image carrying surface LS, by transferring from the toner transfer body 462 to the photosensitive drum 430, to the electric neutralizer storing unit 461C. Specifically, the electric neutralizer collect unit 467 is made of a roller-shaped member provided to face with the photosensitive drum 430, and a predetermined bias voltage is applied thereof to collect the electric neutralizer N.

In the toner circulating unit 461A, a shutter 468 and a transfer state detecting unit 469 are placed inside of the above described concaved portion 463*a*. The shutter 468 is placed upstream in the toner transfer direction TTD than the transfer state detecting unit 469. This shutter 468 enables the transfer state detecting unit 469 to face with the surface of the toner transfer body 462 (the toner transfer surface TTS in FIG. 19) where the toner T and the electric neutralizer N are removed, by shutting off the transfer of the toner T and the electric neutralizer N, temporarily.

The transfer state detecting unit 469 is arranged to face with the toner transfer path TTP. The transfer state detecting unit 469 generates an output depending on the existence ratio of the toner T and the electric neutralizer N transferred on the toner transfer path TTP. Specifically, in this embodiment, the transfer state detecting unit 469 is a surface electric potential sensor, and it is configured and arranged to detect the surface electric potential (charge-up state) of the toner transfer body 462 corresponding to the above described existence ratio.

And, the toner supply apparatus 460 derives the toner supply unit 465 and the electric neutralizer supply unit 466 depending on the output of the transfer state detecting unit 469, under control of the controlling device 470.

4-3 Operation of Laser Printer of Third Embodiment

Hereinafter, an outline of an operation of the laser printer 400, configured as described above, is explained with reference to each figure, as appropriate.

4-3-1 Image Formation

With reference to FIG. 1, a tip of a sheet of paper P loaded on the document feeding tray, described above and not shown in the figure, is sent to the resist roller 421. At the resist roller 421, a skew of the sheet of paper P is corrected, and the transfer timing is adjusted. After that, the sheet of paper P is transferred to a transfer position TP.

While the sheet of paper P is transferred to the transfer position TP, as below, an image by the toner T is carried on the electrostatic latent image carrying surface LS, which is the outer surface of the photosensitive drum 430.

Firstly, the electrostatic latent image carrying surface LS of the photosensitive drum 430 is uniformly charged in the positive polarity by the charger 440.

The electrostatic latent image carrying surface LS which is uniformly charged by the charger 440 moves to the scan position SP where it faces with (exposed to) the scanner unit 450, by the rotation of the photosensitive drum 430 in the direction (clockwise) indicated by the arrow in the figure.

At this scan position SP, a laser beam LB which is modulated based on image information is irradiated on the electrostatic latent image carrying surface LS, while it is scanned in the main scanning direction. Depending on the modulated state of the laser beam LB, some portions are created, on which positive charges are vanished, on the electrostatic latent image carrying surface LS. With this, an electrostatic latent image by patterns of positive charges (image-shaped distribution) is formed on the electrostatic latent image carrying surface LS.

The electrostatic latent image formed on the electrostatic latent image carrying surface LS moves toward the developing position DP where it faces with the toner circulating unit 461A (cf., FIG. 19) in the toner supply apparatus 460, by the rotation of the photosensitive drum 430 in the direction indicated by the arrow (clockwise) in the figure.

In this manner, a positively charged toner T (cf., FIG. 18) is supplied to a portion of the electrostatic latent image carrying surface LS, which reaches to the developing position and on which an electrostatic latent image is formed, by the toner supply apparatus 460. Then, the toner T adheres to the portions on the electrostatic latent image, where positive charges are vanished, on the electrostatic latent image carrying surface LS. Namely, the electrostatic latent image formed on the electrostatic latent image carrying surface LS is developed with the toner T. With this, an image by the toner T (hereinafter, referred to as "toner image") is carried on the electrostatic latent image carrying surface LS.

The toner image carried on the electrostatic latent image carrying surface LS of the photosensitive drum 430 as described above is transferred toward the transfer position TP as the electrostatic latent image carrying surface LS rotates in the direction indicated by the arrow (clockwise) in the figure. And, at this transfer position TP, the toner image is transferred from the electrostatic latent image carrying surface LS to the sheet of paper P.

4-3-2 Transfer Control of Toner and Electric Neutralizer

As the above described predetermined multiphase alternate current voltages are applied to the toner transfer body 462 and the facing electrode substrate 464, the toner T and the electric neutralizer N are simultaneously transferred in the toner transfer direction along the toner transfer path TTP.

Here, during the image formation, the toner T and the electric neutralizer N are discharged, little by little, from the toner transfer path TTP. Namely, as the image formation progress, the toner T is consumed. In addition, although the amount is small, the electric neutralizer N can transfer to the side of the electrostatic latent image carrying body LS.

As described above, the existence ratio of the toner T and the electric neutralizer N transferred on the toner transfer path TTP varies, as the toner T and the electric neutralizer N are discharged from the toner transfer path TTP during the image forming operation. A charge-up occurs on the surface of the toner carriage body 462, when this existence ratio deviates from the predetermined ratio greatly. A defect of image formation occurs, when the amount of the toner T is short.

Thus, in this embodiment, the surface electric potential (charge-up state) of the toner transfer body 462 is detected by the transfer state detecting unit 469, and depending on the detection result, the toner supply unit 465 and the electric neutralizer supply unit 466 are driven. With this, the existence ratio of the toner T and the electric neutralizer N on the toner transfer path TTP is maintained close to a predetermined ratio, successfully and stably.

Further, the electric neutralizer N which has moved to the side of the electrostatic latent image carrying body LS is collected to the electric neutralizer storing unit 461C by the electric neutralizer collect unit 467.

4-4 Effect of Configuration of Fourth Embodiment

According to the configuration of this embodiment, the transfer state of the toner T and the electric neutralizer N on the toner transfer path TTP can be well controlled, while successfully collecting the electric neutralizer N which has moved to the side of the electrostatic latent image carrying body LS to the electric neutralizer storing unit 461C by the electric neutralizer collecting unit 67. With this, transfer of the toner T by the traveling wave electric fields is performed more successfully. Therefore, according to the configuration of this embodiment, a successful image forming operation can be stably performed.

4-5 Modified Examples

Hereinafter, some representative modified examples of the fourth embodiment are exemplified. In the explanations of the modified examples below, for an assembly having a similar configuration and capability as explained in the fourth embodiment described above, the same reference numerals are used as in the case of the above described embodiment. Further, for the explanation of such an assembly, an explanation in the above described embodiment can be cited to the extent that the explanation does not technically contradict.

4-5-1 Modified Example 1

In the fourth embodiment explained above, a mechanism is adopted in which developing is performed through adhering the toner to the electrostatic latent image formed on the photosensitive drum 430, by using the photosensitive drum 430. However, the present invention is not limited to an application to an electrophotographic method using a photosensitive drum. For example, the present invention can be applied to another image formation method where a toner image is formed using static electricity, such as an image formation method of the second embodiment where pixel electrodes and an intermediate transfer drum are used.

Figure 21:
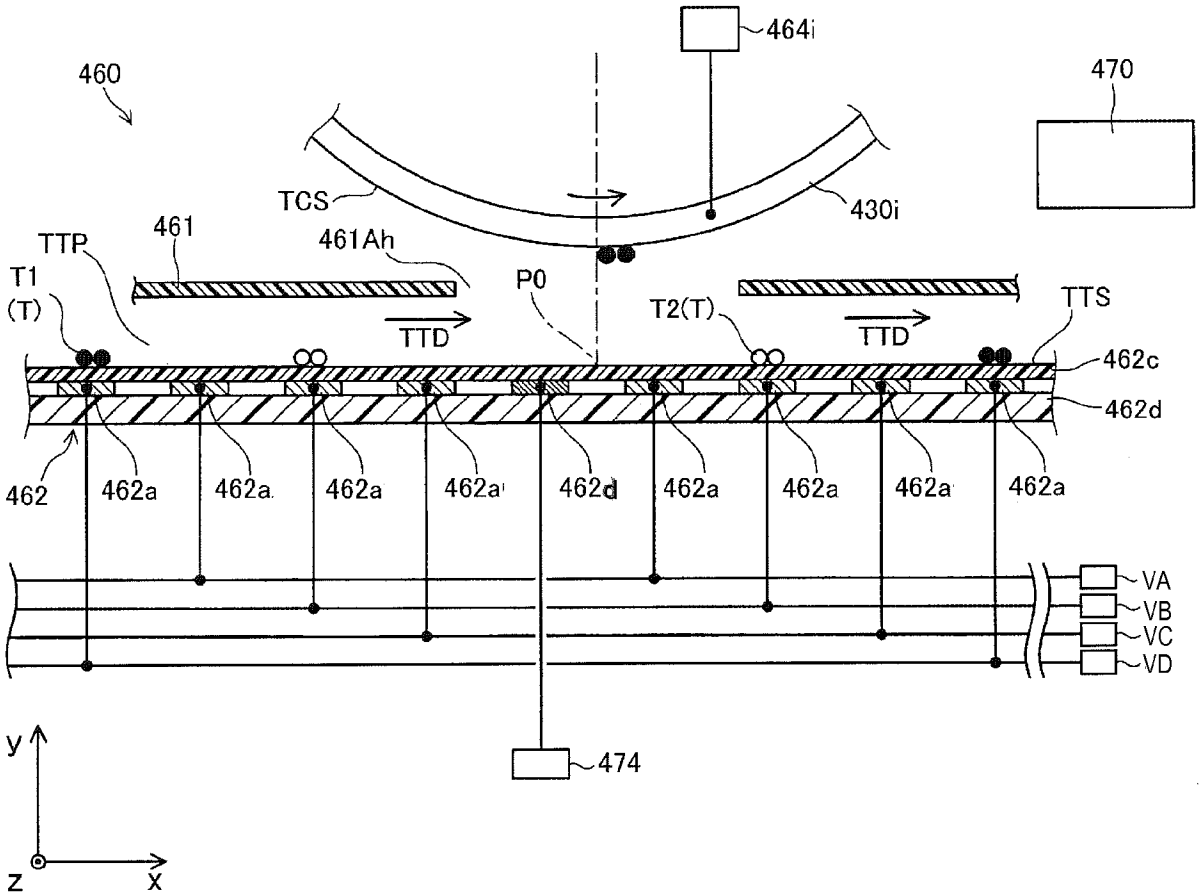
FIG. 21 is an outline cross-sectional side view magnifying a portion where a toner transfer body and an intermediate transfer drum are facing in modified example 1 according to a fourth embodiment of the present invention.

The modified example 1 explained below is an example in which a configuration of the fourth embodiment of the present invention is applied to an image formation method using pixel electrodes and an intermediate transfer drum. FIG. 21 is a schematic diagram magnifying a neighborhood of the closest position P0 of the intermediate transfer drum 430*i* and the toner transfer body 462 in the modified example 1. In the modified example 1, instead of the photosensitive drum 430 of the fourth embodiment, an intermediate drum 430*i* is arranged. Further, a part of the transfer electrodes 462*d* of the toner transfer body 462 placed at the closest position P0 are configured to function as the pixel electrodes 462*a*. Further, in the modified example 1, a toner with opposite charging characteristic which becomes the same series of color as the color of the toner T by adding a colorant to the electric neutralizer is used. Specifically, in the modified example 1, a developer composed of a toner T1 with a positive charging characteristic which is charged in the positive polarity through agitation of the developer and a toner T2 with a negative charging characteristic which is charged in the negative polarity through agitation of the developer. Further, the intermediate transfer drum 430*i* is electrically connected to a developing bias applying unit 464*i*, and a predetermined voltage is applied. A detailed explanation is omitted, since the configuration of the modified example is the same as that of the above described fourth embodiment, except for the above described configuration and operation regarding the pixel formation. Further, a configuration and an operation regarding pixel formation, including the configuration of the developer, are the same as that of the second embodiment.

4-5-2 Other Modified Examples

In addition to the above described modified example 1, the fourth embodiment of the present invention can be applied the following modifications.

(1) Subject of the present invention is not limited to monochrome laser printers. For example, the present invention can be preferably applied to so-called electrophotographic image forming apparatuses such as a color laser printer or monochrome and color copiers.

In this case, it is not required that a photoreceptor is drum-shaped as in the above described fourth embodiment. For example, it can be shaped like a flat plate or an endless belt. Further, as an exposing source, exposing sources other than a laser scanner (LED, EL (electroluminescence) element, phosphor, etc) can be used preferably.

When the present invention is configured to be able to form a multicolored (full color, for example) image, a plurality of transfer rollers 422, photosensitive drums 430, chargers 440, scanner units 450, and toner supply apparatuses are arranged along the document transfer path PP.

Or, the present invention can be preferably applied to an image forming apparatus using a method other than the above described electrophotographic method (for example a toner jet method without using a photoreceptor, an ion-flow method, or a multi-stylus electrode method).

(2) A configuration of an element of the present invention is not limited to concrete examples shown in the above described embodiments. For example, the following configurations can be considered. However, it is needless to say that these are within the technical scope of the present invention.

For example, in the toner storing unit 461B, a suitable means for agitating the toner T stored therein (a moving vane or an oscillator) can be provided. Similarly, in the electric neutralizer storing unit 461C, a suitable means for agitating the toner T stored therein can be provided.

Figure 20:
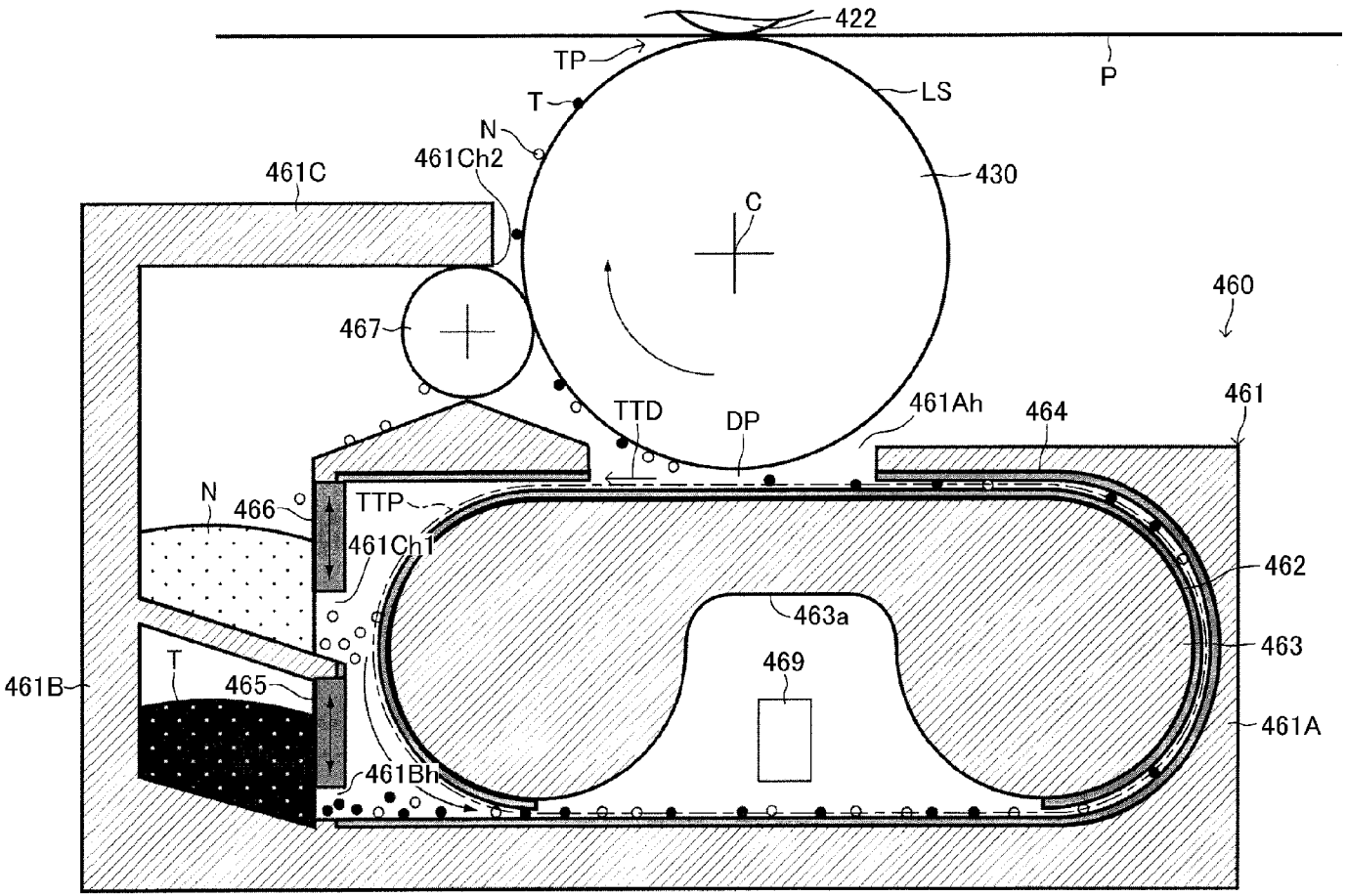
FIG. 20 is a cross-sectional side view illustrating a configuration of a modified example of a toner supply apparatus shown in FIG. 18.

FIG. 20 is a side sectional view illustrating the configuration of an modified example of the toner supply apparatus 360 shown in FIG. 18. As shown in FIG. 20, the toner supply unit 465 can be a shutter.

In addition, as shown in FIG. 20, the electric neutralizer collect unit 467 can be provided at a front position before passing through the transfer position TP to face with the electrostatic latent image carrying surface LS (prior to transferring the toner image to the sheet of paper P at the transfer position TP).

In addition, as for the transfer state detecting unit 469, an optical sensor can be used instead of the surface electric potential sensor. In this case, the shutter 468 is omitted. Namely, the transfer state of the toner T or the electric neutralizer N during image forming operation can be detected in real time, by the transfer state detecting unit 469 including the optical sensor.

(3) In addition, although it is not mentioned anymore because there is no limit, within the scope that does not deviate from the gist of the present invention, various other modifications can be considered.

Further, for each element included in a means to solve a problem of the present invention, an element expressed in terms of an effect or function includes any configuration which can realize such an effect or function, in addition to the specific configurations disclosed in the above described embodiments or modified examples.

5 Summary

Finally, the above explained embodiments of the present invention are summarized in a concise expression.

According to an embodiment of the present invention, there provide a developer storage body that stores developer in powder form and a developer supply apparatus configured to supply toner to a supply object, which includes a transfer body that transfer the developer along a developer transfer path by traveling wave electric fields. The developer used in an embodiment of the present invention includes a toner having a predetermined charging characteristic and an electric neutralizer having an opposite charging characteristic with respect to that of the toner.

An electric neutralizer can be a form of toner including an adhesive resin, or it can be a form of toner without including a colorant. It is preferable that the developer includes the electric neutralizer of more than or equal to 10 parts by mass and less than or equal to 70 parts by mass with respect to the total amount of 100 parts by mass of the toner and the electric neutralizer. It is preferable that an electric neutralizer has the same or greater average particle diameter than that of the toner. It is preferable that the average particle diameter of an electric neutralizer is greater than or equal to 5 μm and less than or equal to 25 μm. A developer supply apparatus according to an embodiment of the present invention can suppress a cohesion or a blocking of the toner on the transfer body.

A toner can have a positive charging characteristic. It is preferable that the transfer body transfers a toner and an electric neutralizer simultaneously along the developer transfer path. It is preferable that an electric neutralizer does not have a magnetic property.

The supply object can be an electrostatic latent image carrying body on which an electrostatic latent image is formed and which has an electrostatic image carrying surface on which a toner charged in a predetermined polarity is carried in association with the electrostatic latent image.

An electric neutralizer can be a toner with opposite charging characteristic which includes a colorant. It is preferable that the toner with opposite charging characteristic has the same series of color as that of the toner. It is more preferable that the toner with opposite charging characteristic has the same color as the color of the toner. In a typical embodiment, a toner is a positively charged toner which is charged in the positive polarity, and a toner with opposite charging characteristic is a negatively charged toner which is charged in the negative polarity.

Typically, the supply object is an electrostatic latent image carrying body having a developer image carrying surface. The developer image carrying surface is a surface in parallel with the main scanning direction, and an image developed by the developer is carried on the developer image carrying surface. In addition, the supply object and a plurality of transfer electrode arranged along the developer transfer surface facing with developer transfer path is placed in a neighborhood of the closest position where a distance between the developer image carrying surface and the developer transfer surface attains the minimum value. In this case, it is preferable that the supply object further includes a plurality of pixel electrodes arranged in a single line along the main scanning direction so as to correspond to a plurality of pixels formed on the developer image carrying surface along the main scanning direction, a transfer voltage applying unit which is electrically connected to the plurality of transfer electrodes so as to apply traveling wave shaped transfer voltages to the plurality of transfer electrodes, and an pixel forming voltage applying unit which is electrically connected to the plurality of pixel electrodes so as to apply pixel forming voltages which offset, with respect to a central value of electric potentials in the transfer voltages, in a polarity corresponding to a charging polarity of one of the toner and the toner having the opposite charging characteristic, which is to be adhered on the developer image carrying surface.

The pixel forming voltage applying unit can be configured so as to apply the pixel forming voltages which offset in the charging polarity of the toner to the pixel electrodes at a timing when the toner should pass over the pixel electrodes, and/or, the pixel forming voltages offset in the charging polarity of the toner having the opposite charging characteristic to the pixel electrodes at a timing when the toner having the opposite charging characteristic should pass over the pixel electrodes.

It is preferable that the pixel forming voltage applying unit applies the pixel forming voltages, which offset with respect to the central value of electric potentials in the transfer voltage, to the plurality of pixel electrodes so as to cause the toner to fly toward the developer image carrying surface at a timing when the toner should pass over the pixel electrodes, and to cause the toner having the opposite charging characteristic to fly toward the developer image carrying surface at a timing when the toner having the opposite charging characteristic should pass over the pixel electrodes.

It is preferable that the plurality of pixel electrodes includes the transfer electrodes placed in the neighborhood of the closest position among the plurality of transfer electrodes. Further, it is preferable that the pixel forming voltage applying unit applies the transfer voltages to all of the plurality of pixel electrodes during a transfer operation to transfer the developer, and at a pixel forming timing when pixels are formed with the developer on the developer image carrying surface, the pixel forming voltage applying unit outputs high voltages having large amount of offset from the central value than the voltages during the transfer operation as the pixel forming voltages to the specific pixel electrodes involved in the pixel formation.

The pixel forming voltage applying unit varies output voltages depending on densities of the pixels, when the pixels are formed on the developer image carrying surface with the developer.

In addition, a bias applying unit can be included, the bias applying unit being configured to apply a voltage to the conductive developer image carrying surface so that an electric potential of the developer image carrying surface becomes the central value.

A toner supply source for supplying the toner to the developer transfer path, and a transfer state detecting unit which is placed to face with the developer transfer path and which generates an output depending on an existence ratio of the toner and the toner having the opposite charging characteristic transferred along the developer transfer path, can be included. In this case, the toner supply source is driven depending on the output from the transfer state detecting unit.

A toner supply source for supplying the toner to the developer transfer path, and a transfer state detecting unit which is placed to face with the developer transfer path and which generates an output depending on an existence ratio of the toner and the electric neutralizer transferred along the developer transfer path, can be further included. In this case, it is preferable that the transfer body includes a plurality of transfer electrodes which generate traveling wave electric fields when transfer voltages are applied and which are arranged along the developer transfer path including a supply position where the toner is supplied to the supply object, the supply object being applied a bias voltage having an opposite polarity to the charging polarity of the toner, and an insulating covering layer which is provided to cover the plurality of transfer electrodes. With such a configuration, the toner supply source can be driven depending on the output from the transfer state detecting unit.

The supply object can be an electrostatic latent image carrying body having an electrostatic latent image carrying surface on which an electrostatic latent image is formed, the toner charged in a predetermined polarity being carried by the electrostatic latent image correspondingly to the electrostatic latent image.

A toner carrying body can be further included, the toner carrying body has a toner carrying surface which is placed to face with the electrostatic latent image carrying body, the toner being carried on the toner carrying surface.

In an embodiment, a toner supply source for supplying the toner to the developer transfer path, an electric neutralizer supply source for supplying the electric neutralizer to the developer transfer path, an electric neutralizer collecting unit for collecting the electric neutralizer adhering to the supply object through moving from the transfer body to the side of the supply object to the electric neutralizer supplying source, and a transfer state detecting unit which is placed to face with the developer transfer path and which generates an output depending on an existence ratio of the toner and the electric neutralizer transferred along the developer transfer path, can be further included. In addition, it is preferable that the transfer body includes a plurality of transfer electrodes which generate traveling wave electric fields when transfer voltages are applied and which are arranged along the developer transfer path including a supply position where the toner is supplied to the supply object, and a covering layer for covering the plurality of transfer electrodes.

The toner supply apparatus according to the above embodiment, wherein the supply object is an electrostatic latent image carrying body having an electrostatic latent image carrying surface on which an electrostatic latent image is formed, and the toner charged in a predetermined polarity being carried by the electrostatic latent image correspondingly to the electrostatic latent image.

An opposite charging characteristic toner supply source for supplying the toner having the opposite charging characteristic to the developer transfer path, and an opposite charging characteristic toner collecting unit for collecting the toner having the opposite charging characteristic adhering to the supply object through moving from the transfer body to the side of the supply object to the opposite charging characteristic toner supply source can be further included. In this case, it is preferable that the opposite charging characteristic toner supply source is driven depending on the output from the transfer state detecting unit.

Further, by an embodiment of the present invention, an image forming apparatus is provided, the image forming apparatus including an electrostatic latent image carrying body having an electrostatic latent image carrying surface on which an electrostatic latent image is formed, the toner charged in a predetermined polarity being carried by the electrostatic latent image correspondingly to the electrostatic latent image; and the above developer supply apparatus which is placed to face with the electrostatic latent image carrying body. In this case, it is preferable that the transfer body of the developer supply apparatus includes a plurality of transfer electrodes which generate the traveling wave electric fields when transfer voltages are applied and which are arranged along the developer transfer path including a developing position where the toner is supplied to the electrostatic latent image carrying surface; and an insulating covering layer which covers the plurality of transfer electrodes.

What is claimed is:

1. A developer supply apparatus for supplying toner to a supply object comprising:

a developer storing body that stores developer in a powder form including a toner having a predetermined charging characteristic, and a transfer body that transfers the developer along a developer transfer path with traveling wave electric fields, wherein the developer further includes an electric neutralizer having an opposite charging characteristic which is opposite to the predetermined charging characteristic of the toner, and wherein the electric neutralizer is the toner having the opposite charging characteristic and including a colorant.

2. The developer supply apparatus according to claim 1, wherein the electric neutralizer is a toner-like agent including an adhesive resin.

3. The developer supply apparatus according to claim 1, wherein the developer includes more than or equal to 10 parts by mass and less than or equal to 70 parts by mass of the electric neutralizer per a total amount of 100 parts by mass of the toner and the electric neutralizer.

4. The developer supply apparatus according to claim 1, wherein the electric neutralizer has an average particle diameter that is equal to or greater than that of the toner.

5. The developer supply apparatus according to claim 1, wherein an average particle diameter of the electric neutralizer is greater than or equal to 5 μm and less than or equal to 25 μm.

6. The developer supply apparatus according to claim 1, wherein cohesion or blocking of the toner is able to be suppressed on the transfer body.

7. The developer supply apparatus according to claim 1, wherein the toner has a positive charging characteristic.

8. The developer supply apparatus according to claim 1, wherein the transfer body transfers the toner and the electric neutralizer simultaneously along the developer transfer path.

9. The developer supply apparatus according to claim 1, wherein the electric neutralizer does not have a magnetic property.

10. The developer supply apparatus according to claim 1, wherein the supply object is an electrostatic latent image carrying body having an electrostatic latent image carrying surface on which an electrostatic latent image is formed, the toner charged in a predetermined polarity being carried by the electrostatic latent image correspondingly to the electrostatic latent image.

11. An image forming apparatus comprising:

an electrostatic latent image carrying body having an electrostatic latent image carrying surface on which an electrostatic latent image is formed, a powdery toner charged in a predetermined polarity being carried by the electrostatic latent image corresponding to the electrostatic latent image; and the developer supply apparatus according to claim 10 which is placed to face the electrostatic image carrying body;

wherein the transfer body of the developer supply apparatus comprising:

a plurality of transfer electrodes which generate the traveling wave electric fields when transfer voltages are applied and which are arranged along the developer transfer path including a developing position where the toner is supplied to the electrostatic latent image carrying surface; and an insulating covering layer which covers the plurality of transfer electrodes.

12. The developer supply apparatus according to claim 1, wherein the toner having the opposite charging characteristic has the same series of color as the color of the toner.

13. The developer supply apparatus according to claim 12, wherein the toner having the opposite charging characteristic has the same color as the color of the toner.

14. The developer supply apparatus according to claim 13, wherein the toner has a positive charging characteristic and is to be charged in a positive polarity, and wherein the toner having the opposite charging characteristic has a negative charging characteristic and is to be charged in a negative polarity.

15. The developer supply apparatus according to claim 1, wherein the supply object is an electrostatic latent image carrying body having a developer image carrying surface, the developer image carrying surface being a surface in parallel with a main scanning direction on which an image developed by the developer is carried, the supply object further comprising:

a plurality of transfer electrodes arranged along a developer transfer surface facing the developer transfer path;

a plurality of pixel electrodes placed in a neighborhood of the closest position where a distance between the developer image carrying surface and the developer transfer surface attains the minimum value, and arranged in a single line along the main scanning direction so as to correspond to a plurality of pixels formed on the developer image carrying surface along the main scanning direction;

a transfer voltage applying unit which is electrically connected to the plurality of transfer electrodes so as to apply traveling wave shaped transfer voltages to the plurality of transfer electrodes; and a pixel forming voltage applying unit which is electrically connected to the plurality of pixel electrodes so as to apply pixel forming voltages which offset, with respect to a central value of electric potentials in the transfer voltages, in a polarity corresponding to a charging polarity of one of the toner and the toner having the opposite charging characteristic, which is to be adhered on the developer image carrying surface.

16. The developer supply apparatus according to claim 15, wherein the pixel forming voltage applying unit applies the pixel forming voltages which offset in the charging polarity of the toner to the pixel electrodes at a timing when the toner is expected to pass over the pixel electrodes, and/or, the pixel forming voltage applying unit applies the pixel forming voltages offset in the charging polarity of the toner having the opposite charging characteristic to the pixel electrodes at a timing when the toner having the opposite charging characteristic is expected to pass over the pixel electrodes.

17. The developer supply apparatus according to claim 15, wherein the pixel forming voltage applying unit applies the pixel forming voltages, which offset with respect to the central value of electric potentials in the transfer voltage, to the plurality of pixel electrodes so as to cause the toner to fly toward the developer image carrying surface at a timing when the toner is expected to pass over the pixel electrodes, and to cause the toner having the opposite charging characteristic to fly toward the developer image carrying surface at a timing when the toner having the opposite charging characteristic is expected to pass over the pixel electrodes.

18. The developer supply apparatus according to claim 15, wherein the plurality of pixel electrodes includes the transfer electrodes placed in the neighborhood of the closest position among the plurality of transfer electrodes, wherein the pixel forming voltage applying unit applies the transfer voltages to all of the plurality of pixel electrodes during a transfer operation to transfer the developer, and wherein, at a pixel forming timing when pixels are formed with the developer on the developer image carrying surface, the pixel forming voltage applying unit outputs high voltages having large amount of offset from the central value than the voltages during the transfer operation as the pixel forming voltages to the specific pixel electrodes involved in the pixel formation.

19. The developer supply apparatus according to claim 15, wherein, when the pixels are formed on the developer image carrying surface with the developer, the pixel forming voltage applying unit is configured to vary output voltages depending on densities of the pixels.

20. The developer supply apparatus according to claim 15 further comprising:

a bias applying unit configured to apply a voltage to the conductive developer image carrying surface so that an electric potential of the developer image carrying surface becomes the central value.

21. The developer supply apparatus according to claim 15 wherein the transfer body transfers the toner and the toner having the opposite charging characteristic simultaneously along the developer transfer path.

22. The developer supply apparatus according to claim 15, wherein the toner has a positive charging characteristic and is to be charged in the positive polarity, and wherein the toner having the opposite charging characteristic has the negative charging characteristic and is to be charged in the negative polarity.

23. The developer supply apparatus according to claim 15, further comprising:

a toner supply source for supplying the toner to the developer transfer path; and a transfer state detecting unit which is placed to face the developer transfer path and which generates an output depending on an existence ratio of the toner and the toner having the opposite charging characteristic transferred along the developer transfer path, wherein the toner supply apparatus drives the toner supply source depending on the output from the transfer state detecting unit.

24. The developer supply apparatus according to claim 23, further comprising:

an opposite charging characteristic toner supply source for supplying the toner having the opposite charging characteristic to the developer transfer path; and an opposite charging characteristic toner collecting unit for collecting the toner having the opposite charging characteristic adhering to the supply object through moving from the transfer body to the side of the supply object to the opposite charging characteristic toner supply source;

wherein the developer supply apparatus drives the opposite charging characteristic toner supply source depending on the output from the transfer state detecting unit.

25. An image forming apparatus comprising:

a developer image carrying body having a developer image carrying surface which is a surface in parallel with the main scanning direction and on which an image developed by the developer is carried; and the developer supply device according to claim 15 which is placed to face the developer image carrying body.

26. A developer supply apparatus for supplying toner to a supply object comprising:

a developer storing body that stores developer in a powder form including a toner having a predetermined charging characteristic;

a transfer body that transfers the developer along a developer transfer path with traveling wave electric fields;

a developer supply source for supplying the toner to the developer transfer path; and a transfer state detecting unit which is placed to face the developer transfer path and which generates an output depending on an existence ratio of the toner and an electric neutralizer transferred along the developer transfer path, wherein the developer further includes the electric neutralizer having an opposite charging characteristic which is opposite to the predetermined charging characteristic of the toner, wherein the transfer body comprises:

a plurality of transfer electrodes which generate traveling wave electric fields when transfer voltages are applied and which are arranged along the developer transfer path including a supply position where the toner is supplied to the supply object, the supply object being applied with a bias voltage having an opposite polarity to the charging polarity of the toner; and an insulating covering layer which is provided to cover the plurality of transfer electrodes, and wherein the developer supply apparatus drives the developer supply source depending on the output from the transfer state detecting unit.

27. The developer supply apparatus according to claim 26, wherein the transfer body transfers the toner and the electric neutralizer simultaneously on the developer transfer path.

28. The developer supply apparatus according to claim 26, wherein the supply object is an electrostatic latent image carrying body having an electrostatic latent image carrying surface on which an electrostatic latent image is formed and toner charged in a predetermined polarity is carried in association with the electrostatic latent image.

29. The developer supply apparatus according to claim 28, wherein the developer supply apparatus further comprises:

a toner carrying body having a toner carrying surface which is placed to face the electrostatic latent image carrying body, the toner being carried on the toner carrying surface.

30. The toner supply apparatus according to claim 29, wherein the supply object is an electrostatic latent image carrying body having an electrostatic latent image carrying surface on which an electrostatic latent image is formed, and the toner charged in a predetermined polarity is carried by the electrostatic latent image corresponding to the electrostatic latent image.

31. An image forming apparatus comprising:

an electrostatic latent image carrying body having an electrostatic image carrying surface on which an electrostatic latent image is formed, the toner charged in a predetermined polarity being carried by the electrostatic latent image corresponding to the electrostatic latent image; and the developer supply apparatus according to claim 30 placed to face the electrostatic latent image carrying body.

32. The image forming apparatus according to claim 31, wherein the transfer body of the developer supply apparatus transfers the toner and the electric neutralizer simultaneously along the developer transfer path.

33. The developer supply apparatus according to claim 28, wherein the transfer body transfers the toner and the electric neutralizer simultaneously along the developer transfer path.

34. An image forming apparatus comprising:

an electrostatic latent image carrying body having an electrostatic latent image carrying surface on which an electrostatic latent image is formed and on which a powdery toner being charged in a predetermined polarity is carried in association with the electrostatic latent image;

the developer supply apparatus according to claim 28 which is placed to face the electrostatic latent image carrying body; and a bias applying unit being electrically connected to a toner carriage body so as to apply a bias voltage having an opposite polarity which is opposite to the predetermined polarity to the toner carriage body, the bias voltage being a voltage for attracting the toner to the toner carriage body of the developer supply apparatus through an electrostatic force.

35. The image forming apparatus according to claim 34, wherein the transfer body of the developer supply apparatus transfers the toner and the electric neutralizer simultaneously along the developer transfer path.

36. A developer supply apparatus for supplying toner to a supply object comprising:

a developer storing body that stores developer in a powder form including a toner having a predetermined charging characteristic;

a transfer body that transfers the developer along a developer transfer path with traveling wave electric fields;

a toner supply source for supplying the toner to the developer transfer path;

an electric neutralizer supply source for supplying an electric neutralizer to the developer transfer path;

an electric neutralizer collecting unit for collecting the electric neutralizer adhering to the supply object through moving from the transfer body to the side of the supply object to the electric neutralizer supplying source; and a transfer state detecting unit which is placed to face the developer transfer path and which generates an output depending on an existence ratio of the toner and the electric neutralizer transferred along the developer transfer path, wherein the developer further includes the electric neutralizer having an opposite charging characteristic which is opposite to the predetermined charging characteristic of the toner, wherein the transfer body comprises:

a plurality of transfer electrodes which generate traveling wave electric fields when transfer voltages are applied and which are arranged along the developer transfer path including a supply position where the toner is supplied to the supply object; and a covering layer for covering the plurality of transfer electrodes, and wherein the developer supply apparatus drives the toner supply source and the electric neutralizer supply source depending on the output from the transfer state detection unit.

* * * * *